US008550125B2

(12) United States Patent
Hattori

(10) Patent No.: US 8,550,125 B2
(45) Date of Patent: Oct. 8, 2013

(54) LINKED COIL FORMATION DEVICE AND METHOD OF FORMING LINKED COILS

(75) Inventor: Kaoru Hattori, Tokyo (JP)

(73) Assignee: Tamura Corporation, Tokyo (JP)

( * ) Notice: Subject to any disclaimer, the term of this patent is extended or adjusted under 35 U.S.C. 154(b) by 285 days.

(21) Appl. No.: 12/747,481

(22) PCT Filed: Feb. 25, 2009

(86) PCT No.: PCT/JP2009/053360

§ 371 (c)(1),
(2), (4) Date: Jun. 10, 2010

(87) PCT Pub. No.: WO2009/107633

PCT Pub. Date: Sep. 3, 2009

(65) Prior Publication Data

US 2010/0319802 A1 Dec. 23, 2010

(30) Foreign Application Priority Data

Feb. 29, 2008 (JP) ..... 2008-050591

(51) Int. Cl.
*H01F 5/00* (2006.01)
*B21F 3/00* (2006.01)

(52) U.S. Cl.
USPC ..... 140/71 C; 29/605; 242/437.3

(58) Field of Classification Search
USPC ..... 140/71 C, 103, 124; 29/602.1, 605; 242/437.1, 437.3, 443, 445
See application file for complete search history.

(56) References Cited

U.S. PATENT DOCUMENTS 8,091,211 B2 * 1/2012 Hasu et al. ..... 29/605

FOREIGN PATENT DOCUMENTS

| | | | |
|---|---|---|---|
| JP | 10172852 | A | 6/1998 |
| JP | 2000-195725 | A | 7/2000 |
| JP | 2003-124039 | A | 4/2003 |
| JP | 2003-133155 | A | 5/2003 |
| JP | 2003-181579 | A | 7/2003 |
| JP | 2004-055920 | A | 2/2004 |
| JP | 2005-057113 | A | 3/2005 |
| JP | 2005-093852 | A | 4/2005 |
| JP | 2005-304244 | A | 10/2005 |
| JP | 2006-271121 | A | 10/2006 |
| JP | 2006-288025 | A | 10/2006 |
| JP | 2008-198666 | A | 8/2008 |
| WO | WO 2007132558 | A1 * | 11/2007 |
| WO | WO-2007132558 | A1 | 11/2007 |

* cited by examiner

*Primary Examiner* — Debra Sullivan
(74) *Attorney, Agent, or Firm* — Arent Fox

(57) ABSTRACT

[Problem to be solved] A first coil and a second coil are efficiently formed in the shape of a rectangular cylinder and in parallel to each other, by bending and processing a flat wire, and a linking part of each of the coils, is linked with the same material without welding or folding.

[Means for solving the problem] Provided are: a first coil winding processing line having a first winding head forming a first coil part in the shape of a rectangular cylinder at one end part of a flat wire W; a second coil winding processing line disposed in parallel to the first coil winding processing line and having a second winding head on which a second coil part in the shape of a rectangular cylinder is formed at the other end part of the flat wire W and both of the coil parts are arranged to be adjacent to each other on an identical face; and a coil placement unit for conveying the flat wire W having the first coil part from the first coil winding processing line to the second coil winding processing line along each coil winding processing line.

12 Claims, 37 Drawing Sheets

Long inter-coil lead
Measured pulse: P1

Appropriate inter-coil lead
Measured pulse: P0

FIG. 37D1

LINKED COIL FORMATION DEVICE AND METHOD OF FORMING LINKED COILS

CROSS-REFERENCE TO RELATED APPLICATION

This application is a National Stage entry of International Application No. PCT/JP2009/053360, filed Feb. 25, 2009, which claims priority to Japanese Patent Application No. 2008-050591, filed Feb. 29, 2008, the entire specification claims and drawings of which are incorporated herewith by reference.

TECHNICAL FIELD

The present invention relates to a linked coil formation device and a method of forming linked coils, in particular to a linked coil formation device and a method of forming linked coils, which are suitable to be employed as reactor coils.

BACKGROUND TECHNOLOGY

A reactor is generally provided with a wire and a magnetic core, and an inductance is obtained by constituting a coil of which the wire is wound around the core. Conventionally, a reactor is employed in a step-up circuit, an inverter circuit, and an active filter circuit or the like. As such reactor, there has been often employed the one in which a core and a coil wound around the core are accommodated in a case made of a material such as a metal together with other insulation members or the like. In addition, in a reactor employed in a step-up circuit for vehicle-mounting, for example, two independent coils, each of which is formed by a predetermined winding diameter and the number of windings, are formed in parallel to each other in order to obtain a high inductance value in a high current flow area, and there are employed the coils structured to be linked (connected) with each other so that the directions of currents that flow through the parallel coils are opposite to each other.

As one example of the prior art of the coils described above, there is known the one in which the abovementioned two coils are formed by their individual wires, and end parts of the wires on the linking sides are connected to each other by welding them via a communication terminal (refer to Patent Document 1, for example). In addition, as another example of the prior art, there is known the one of the construction that: two coils in the same winding direction arranged in parallel to each other are formed by edgewise winding of one flat wire; and a linking part of the flat wire acting between the aforementioned two coils in series with each other is double-folded along a longitudinal direction so as to be included in an external form exerted by an end face of each of the coils (refer to Patent Document 2, for example).

In addition, techniques of integrally forming two coils by means of a linking part are disclosed in Patent Documents 3 to 6. Further, techniques of bending and processing the two coils that are integrally formed by means of the linking part from one wire rod are disclosed in Patent Documents 7 and 8.

Patent Document 1: Japanese Patent Application Laid-open No. 2003-124039

Patent Document 2: Japanese Patent Laid-open No. 3737461

Patent Document 3: Japanese Patent Laid-open No. 3398855

Patent Document 4: Japanese Patent Application Laid-open No. 2005-57113

Patent Document 5: Japanese Patent Laid-open No. 2000-195725

Patent Document 6: International Patent Application Publication No. WO 2007/132558

Patent Document 7: Japanese Patent Laid-open No. 3640207

Patent Document 8: Japanese Patent Application Laid-open No. 2005-93852

DISCLOSURE OF THE INVENTION

Problem to Be Solved by the Invention

Incidentally, in many cases, since a substantially ring-shaped core, for example, is inserted into a coil constituting a reactor, high arrangement precision is required to arrange the coil. On the other hand, in the aforementioned coils of the prior art, since the end parts of the wires on the linking sides in the two coils are linked with each other via the communication terminal, variation is prone to occur to coil arrangement, and the core cannot be occasionally inserted into the coil. In addition, in the coils of Patent Document 1, there is a need for a work of releasing the coat of each wire or the linking-side end part of the communication terminal for connection between each of the coils and the communication terminal, followed by welding the released part, and as a result, a manufacturing work has become very cumbersome. Further, the two coils that are formed by their individual wires are electrically connected to each other by means of welding via the communication terminal; therefore, reliability of the welding part becomes unavoidably problematic; and further, there has been a problem that variation occurs to electrical characteristics of the coils, depending upon the workmanship of welding.

Moreover, in the coils of Patent Document 2 mentioned previously, since two coils are formed by the same wire so as to double-fold their linking part, there is a need for a coil folding jig for ensuring arrangement precision of the two coils after folded. In addition, there is a need for a space of a folding part, and there is apprehension that variation occurs to the electrical characteristics of the coils, depending upon the workmanship of folding. Further, while there is no need for the step of connecting each of the coils and the communication terminal, there is a need for the above-mentioned process of operation for folding, and a problem that the manufacturing work becomes cumbersome can arise, accordingly.

In addition, while the technique of forming two coils from one wire rod is disclosed in Patent Documents 3 to 6 and the method of forming these coils is disclosed in Patent Documents 7 and 8, the method of forming these coils causes a problem. Specifically, since the coils are formed by respective rectangular winding of one wire rod at their respective ends, displacement occurs between the two coils, depending upon the feed quantity and bending degree of the wire rod at the time of rectangular winding; and however, means for solving the problem is not disclosed in these Patent Documents. Therefore, if the formation technique of Patent Documents 7 and 8 or the like is employed, while two coils can be formed without an occurrence of an inter-coil displacement in an ideal state, a problem still remains unsolved in applying this technique to an actual manufacturing process.

In fact, while a technique of correcting an offset quantity between two coils is disclosed in Patent Document 6, there is an improvement in efficiently manufacturing two coils by associating this technique with a manufacturing apparatus.

It is an object of the present invention to provide a linked coil formation device and a method of forming linked coils, which are capable of efficiently forming a first coil and a second coil by bending a flat wire into a rectangular cylinder shape and a parallel shape, and also linking the linking parts of these coils with the same material without welding or folding.

Means for Solving the Problems

In order to achieve the abovementioned object, the present invention is directed to a linked coil formation device, comprising: a first coil winding processing line having a first winding head employing a flat wire introduced from a material feed area, as a coil material, and sequentially winding one end part thereof in a rectangular shape, to form a first coil part in a shape of a rectangular cylinder; a second coil winding processing line having a second winding head which is disposed in parallel to the first coil winding processing line at predetermined intervals to form a second coil part in the shape of the rectangular cylinder at the other end part of the coil material and to arrange the second coil part to be adjacent to the first coil part on an identical face; and a material transfer unit for conveying the coil material having the first coil part formed in the first coil winding processing line into the second coil winding processing line on an extension of each of the first and second coil winding processing lines at an opposite side of the material feed area.

In order to achieve the abovementioned object, a method of forming linked coils, according to the present invention, is directed to a method of forming linked coils of which a first coil part and a second coil part are linked with each other on an identical face via a linking part and are disposed in parallel to each other, said method comprising: a first step of introducing a coil material such as a flat wire from a material feed area into a first coil winding processing line, and sequentially winding one end part thereof in a rectangular shape on the first coil winding processing line to form the first coil part in the shape of a rectangular cylinder; a second step of feeding a side of the first coil part of a coil material having the first coil part formed in the first step at one end part thereof to a material transfer unit and cutting a length of the coil material at a length required for a second coil part to be formed at the other end part thereof; a third step of transferring the coil material for which the other end part is specified as a site for forming the second coil onto a second coil winding processing line by actuating the material transfer unit; and a fourth step of conveying the coil material transferred via the material transfer unit from the other end part thereof into the second coil winding processing line, forming the second coil part in a shape of a rectangular cylinder at the other end part of the coil material, and arranging the second coil part to be adjacent to the first coil part on an identical face.

Effects of the Invention

According to the present invention, a first coil part is formed at one end part of a coil material in a first coil processing line, and subsequently thereto, a second coil part is formed at the other end of the coil material in a second coil winding processing line; in this duration, the coil material to which the first coil part is attached via a material transfer unit is continuously transferred to the second coil winding processing line; and therefore, the coil material is sequentially moved continuously in one direction from introduction to the end of processing of each coil, so that each coil can be processed speedily and efficiently. In addition, as described above, the material transfer unit is adapted to be compatible with the first and second coil winding processing lines that are disposed in parallel to each other, thus enabling the coil material having the first coil part that is formed in the first coil winding processing line to be smoothly and speedily transferred to the second coil winding processing line by means of the material transfer unit, so that processing/production efficiency of linked coils can be remarkably improved.

BEST MODE FOR CARRYING OUT THE INVENTION

Hereinafter, embodiments of a linked coil formation device and a method of forming linked coils, according to the present embodiment, will be described referring to the drawings. FIGS. 1 and 2 are a plan view and a side view, of a linked coil formation device 20 of the embodiments. In addition, FIGS. 3 and 4 are entire perspective views of a reactor 1 when a linked coil 10 formed by the linked coil formation device 20 is applied as a reactor coil (hereinafter, referred to as linked coil) 10.

First, an explanation of the reactor will be furnished referring to FIGS. 3 and 4. As shown in FIG. 3, the reactor 1 is used in an electric circuit as a device having forcible cooling means, for example, and is constructed to include the linked coil 10, a reactor core 2, a bobbin (not shown), a thermal conductive case 3, and an insulation-cum-radiation sheet (not shown). The abovementioned reactor 1 is constructed in such a manner that: the reactor core 2 is inserted into the linked coil 10; these core and coils are accommodated in the thermal conductive case 3; and thereafter, the accommodated core and coils are fixed by feeding a filling material 4. Reactor fixing holes 3A, which are provided at four corners of the thermal conductive case 3, are screw holes for fixing the thermal conductive case 3 to a forcibly cooled cabinet or the like, for example.

The linked coil 10 is formed to have a first coil part 11 and a second coil part 12 formed in a state in which: one flat wire W is wound at one side in a lengthwise direction and at the other end side, of the flat wire; and the rectangular winding part is laminated in the shape of a rectangular cylinder. A linking part 13 for linking the coil parts 11, 12 on the same face is provided between the first coil part 11 and the second coil part 12; and the linking part 13 is formed by the flat wire W that is a material positioned between the coil parts 11 and 12. In addition, the first coil part 11 and the second coil part 12 are disposed in parallel to each other. The rectangular winding means winding a coil in the shape of a rectangular cylinder, and is compared to circular winding which means winding a coil in a circular shape.

Lead parts 11A, 12A, which are end parts of the first coil part 11 and the second coil part 12 of the linked coil 10, respectively, are bent at an angle of 90 degrees as shown, immediately before starting each winding process, so as not to interfere with the respective coil parts 11, 12 when the two coils approach at the final stage of winding process of the second coil. The coat of each of the lead parts is released; a conductor is exposed; and a crimp-contact terminal or the like (not shown) is provided to be connected to another electric component or the like. In addition, the flat wire W is formed by applying coating to a cross-sectional, rectangular lead.

Although described later in detail, a portion 14 (hereinafter, referred to as an "offset portion"), of one edge on the side of the second coil 12 in the vicinity of a linking part 13 between the first coil part 11 and the second coil part 12, is wound (hereinafter, referred to as "offset-wound") to have an offset quantity in order to eliminate variation in distance between axial centers of the first and second coil parts 11 and 12, which may occur when the linked coil 10 is molded, and further, to be protruded outward from an external form of the rectangular cylinder shape. This offset portion 14 also serves as the linking part 13 for linking the first coil part 11 and the second coil part 12.

As shown in detail in FIG. 4, the first coil part 11 and the second coil part 12, of the linked coil 10, are formed in parallel to each other and in a winding direction identical to another one. The lead parts 11A, 12A of the two coil parts 11, 12 are on the same side in the axial direction of each of the coil parts 11, 12; and therefore, even if terminals (not shown) are attached to tip end parts of the lead parts 11A, 12A, the positions of the terminals can be aligned with each other.

In this linked coil 10, at a winding end part 12B of the second coil part 12, the flat wire is processed to be bent at an angle of substantial 90 degrees, whereas the wire is protruded by an interval length between the coil parts 11 and 12 from the side of the second coil part 12; the second coil part 12 is laminated in the same direction (indicated by the arrow B in FIG. 4) as the lamination direction of the first coil part 11 (indicated by the arrow A in FIG. 4) and are wound in a rectangular shape in the same direction as the winding direction of the first coil part 11; and at a time point when the winding of the second coil part 12 is completed, the first coil part 11 and the second coil part 12 are thereby continuously formed in parallel to each other, via the linking part 13.

In addition, since the linking part 13 is formed in the same orientation as that of the respective lead parts 11A, 12A of the first and second coil parts 11 and 12, when the linked coil 10 is assembled as shown in FIG. 1, there arises no interference with a protrusion or the like formed on a bottom face of the thermal conductive case 3, for example. This means that: there is no need to limit the position or shape of the protrusion formed on the bottom face of the case 3; and that an advantageous effect that the degree of freedom in design increases can be thereby attained.

As described above, the linked coil 10 is a double-linked coil 10 formed by: feeding out in advance the flat wire W of a length required to wind the second coil part 12 in a rectangular shape, after rectangular winding of the first coil part 11 has completed; and winding the second coil part 12 in a rectangular shape at the other end part of the flat wire W having the formed first coil part 11 at one end part. Therefore, accumulation of wire rod feed errors when forming each edge in the process of rectangular winding of the second coil part 12 may appear as variation in distance between the axial centers of the first and second coil parts 11 and 12.

As described previously, since two linear parts of the substantially ring-shaped reactor core 2 are inserted into the first and second coil parts 11 and 12, high dimensional precision is required for the distance between the axial centers of the first and second coil parts 11 and 12. Therefore, in order to eliminate the accumulation of wire rod feed errors, an offset portion 14 on the side of the second coil part 12, forming the linking part 13 between the first and second coil parts 11 and 12, is provided as an extra-length portion for adjusting the distance between the first and second coil parts 11 and 12, and is wound in a rectangular shape. In addition, as described previously, rectangular winding of a portion including this offset portion 14 is referred to as "offset winding."

Next, one embodiment of a linked coil formation device of the present invention, for forming the linked coil 10, will be described referring to FIGS. 1, 2, and 5.

A linked coil formation device 20 of the embodiment is constructed, having: a winder unit 21 disposed at a flat wire feed part A which is a material feed region; and a coil placement unit 23 which is a material transfer unit which is adjacent to the winder unit 21 and is disposed in opposite to the flat wire feed part A. In addition, a main control part 110 which controls a variety of equipment is provided together with these units. A winder base 22 having a top face 22A which is a substantially flat face is provided at the winder unit 21, and a coil placement base 24 having a top face 24A which is a substantially flat face is provided at the coil placement unit 23.

At the winder coil 21 and the coil placement unit 23 as described above, a first coil winding processing line (hereinafter, referred to as a first line) 25 and a second winding processing line (hereinafter, referred to as a second line) 26 are provided across these units 21 and 23 and in parallel to each other at predetermined intervals. That is, the first and second lines 25 and 26 are set to extend from a side end part of the flat wire feed part A, such as a bobbin (not shown), for feeding the flat wire W as a coil material in the winder unit 21 to an opposite end side of the coil placement unit 23. Here, the flat wire feed part A of the first line 25 is referred to as the most upstream of the flow in a feed direction K1 of the flat wire W, and a tip side of the flow in the feed direction K1 is referred to as a downstream. In addition, a position opposite to the downstream of the first line 25 of a feed direction K2 in the second line 26 is referred to as an upstream, and the tip side of the feed direction K2 in the second line 26 is referred to as the most downstream.

In addition, in the first line 25, one end part of the flat wire W is sequentially wound in a rectangular shape so that the first coil part 11 is formed in the shape of a rectangular cylinder. Further, in the second line 26, the second coil part 12 is formed at an opposite end part of the first coil part 11 of the flat wire W formed in the first line 25, and finally, the linked coil 10 is formed with both of the coil parts 11 and 12 being in parallel to each other.

In the first line 25, a first wire feeder 27 for feeding out the flat wire W fed to form the first coil part 11 to a subsequent process is disposed on a top face 22A of the winder base 22 and on the side of the flat wire feed portion A.

The first wire feeder 27 is constructed, having: one pair of pulleys 28 (see FIG. 2) disposed at the top and bottom; one pair of main body parts 29 to which these pulleys 28 are attached, respectively; and one pair of motors 30 with which these main body parts 29 are equipped, for rotating one pair of pulleys 28 in their directions opposite to each other. In this manner, the first wire feeder 27 is constructed in such a manner that: the flat wire W supplied from the flat wire feed part A is sandwiched between one pair of pulleys 28; one pair of pulleys 28 are rotated in their directions opposite to each other; and the flat wire W is fed to the subsequent process.

On the top face 22A of the winder base 22, a first winding head 32 is disposed at a position adjacent to the downstream side of the flow in the feed direction K1 of the flat wire W, of the first wire feeder 27. At the first winding head 32, the first coil part 11 in the shape of a rectangular cylinder is formed while one end part of the flat wire W fed out from the first wire feeder 27 is sequentially wound in a rectangular shape. As described previously, at the final stage of the winding process of the second coil part 12, the lead part 11A is bent at an angle of 90 degrees in the direction orthogonal to a surface of the coil part 11, by means of a mechanism or the like (not shown) before each winding process starts, so as not to interfere with the respective coil parts 11, 12 when the two coil parts 11, 12 approach (see FIGS. 3 and 4).

The first winding head 32, as shown in detail in FIG. 5, is provided with a winding part 33 for executing bending processing of the flat wire W at an angle of 90 degrees. The winding part 33 is comprised of a circular axis-shaped fixing jig 33A and a rectangular rod-shaped winding jig 33B, and these fixing jig 33A and winding jig 33B are provided at a head main body part 34. The fixing jig 33A serves to guide the flat wire W that is fed and fix a side face at one end side in a widthwise direction at the time of the bending processing of the flat wire W.

In addition, the winding jig 33B is constructed in such a manner that: a side face at the other end side in a widthwise direction is pressed against the side of the fixing jig 33A at the time of the bending processing of the flat wire W; and the flat wire is turnable at an angle of substantial 90 degrees as indicated by the arrow R in the bending processing direction of the flat wire W. The rectangular rod-shaped winding jig 33B serves to rotate while its tip end is in abutment with the side face at the other end side in the widthwise direction of the flat wire W.

Turning movement for the bending processing of the winding jig 33B at an angle of 90 degrees is adapted to be effected by turning the head main body part 34 or the like relative to a base 35 around the fixing jig 33A by means of a motor 38 in the direction indicated by the arrow R in FIG. 5. Reference numeral 36 designates a receiver member 36 for receiving the first coil part 11 formed at the first winding head 32.

In the top face of the winder base 22, a coil feed guide 37 is disposed on the downstream side of the flow in the flat wire feed direction K1 of the first winding head 32. The coil feed guide 37 serves to guide the flat wire W fed out by starting with the first coil part 11 processed to be wound by the first winding head 32 to the subsequent process, and extends from the vicinity of the first winding head 32 to a side end part of the coil placement unit 23 of the winder base 22. In addition, the coil feed guide 37, as shown in FIG. 5, is comprised of: a bottom face part 37A on which the flat wire W is to be placed; and a side wall part 37B erected at both ends in the widthwise direction of the bottom face part 37A, and both ends in the lengthwise direction are supported by a columnar member 38 (see FIG. 2 also) which is erected on the top face 22A of the winder base 22.

In the top face of the winding base 22, a cutter unit 40 is arranged on the downstream side of the flow in the flat wire feed direction K1 of the first winding head 32. The cutter unit 40 serves to cut the flat wire W to a length required to form the second coil part 12 at an opposite end part of the first coil part 11 in the second line 26 after the first coil part 11 completed on the first winding head 32 has been fed to the side of the coil feed guide 37 and the coil placement unit 23. In addition, the cutter unit 40 is arranged at a position partway of the lengthwise direction of the coil feed guide 37.

The cutter unit 40, as shown in detail in FIG. 5, is provided with: a mount base 41; and a cutter main body part 42 which is provided to be movable on the mount base 41 in a Y-axis direction (in the direction orthogonal to the flow direction K1 of the flat wire W). A cutting part (cutter), although is not shown, is provided at the cutter main body part 42. Therefore, the cutter main body part 42 is slid in the Y-axis direction, and the flat wire W fed out can be cut at a predetermined length by means of the cutter mounted to the cutter main body part 42.

Here, as to cutting of the flat wire W by means of the cutter unit 40, a position sensor is installed in the vicinity of the downstream end part of the coil guide 44 provided at the placement unit 23, for example. When the first coil part 11 of the flat wire W that is fed out from the coil feed guide 37 is detected by means of the position sensor, the other end part of the flat wire W is set so as to have a length required to form the second coil part 12. Therefore, the cutter unit may be constructed so as to cut the flat wire at the detected position.

Further, a coil introduction guide 44, for guiding and placing the flat wire W having the first coil part 11 formed at one end part, is provided on the downstream side of the flow in the flat wire feed direction K1 of the cutter unit 40 and on the top face of the coil placement base 24 of the coil placement unit 23. The coil introduction guide 44 is formed at a length exceeding a full length from one end part to the other end part, of the coil placement unit 23. This guide is formed of a bottom face part 44A for placing the flat wire W and a guide part 44B erected at both ends in the widthwise direction of the bottom face part 44A. The coil introduction guide 44 is formed to be larger than the full length of the flat wire W to such an extent as to enable the first coil part 11 to be formed at one end part of the flat wire and the second coil part 12 to be formed at the other end part of the flat wire.

A coil conveyance tray 45 is slidably provided at the coil introduction guide 44. The coil conveyance tray 45 is slidably movable from one end part to the other end part, of the coil introduction guide 44, while the first coil part 11 formed at one end part of the flat wire W is placed/retained on the top face of the tray.

A coil fixing/unfixing mechanism (not shown) for fixing the coil conveyance tray 45 to be embedded and unfixing the tray, is provided at one end part 47 of the coil introduction guide 44. In addition, when the coil conveyance tray 45 is locked with one end part 47, the first coil part 11 is placed on the coil conveyance tray 45 so as to make the coil conveyance tray 45 slidably movable after being unfixed at the fixed position. It is preferable that the coil fixing/unfixing mechanism use a cylinder, for example.

Here, when the coil conveyance tray 45 is fixed to the coil introduction guide 44, the top face of the coil conveyance tray 45 and a bottom face of the flat wire W that is fed out from the coil feed guide 37 are set at the substantially same height so as to enable the flat wire W that is fed via the coil feed guide 37 to be smoothly guided onto the coil conveyance tray 45. In addition, when the coil conveyance tray 45 slides the coil introduction guide 44, the coil conveyance tray 45 is constructed to slide after pushed up by a cylinder, for example.

The coil introduction guide 44 constructed as described hereinbefore, as shown in FIG. 1, can be reciprocally moved between the first line 25 and the second line 26, as described previously, by means of a flat wire movement unit 50. That is, the flat wire movement unit 50 is constructed, having: a plate-shaped support member 51 which is disposed at intervals between the first line 25 and the second line 26 on the top face of the coil placement base 24 of the coil placement unit 23; a guide rod 52 which extends along a movement direction and overhangs across the support member 51; and a cylinder 53 as a drive source which is securely fixed to one side face of the coil introduction guide 44 and slides the coil introduction guide 44.

Here, a guide block 54 for the guide rod 52 is provided on a back face of a bottom face part 44A in the coil introduction guide 44, and a link member 55 to be linked with a rod of the cylinder 53 is provided at one side wall part 44B. Since the flat wire movement unit 50 is constructed as described hereinbefore, the cylinder 53 is driven to advance and retract the rod 53A, and the coil introduction guide 44 can thereby reciprocally move between the first line 25 and the second line 26.

In the first line 25, a lead wire introduction mechanism 57 is arranged at a side end part of the coil introduction guide 44 on the coil placement unit 23. The lead wire introduction mechanism 57 serves to introduce the flat wire W of which the first coil part 11 is formed at one end part and the other end part is cut by means of the cutter unit 40 from the cut position into the coil introduction guide 44, with an end part of the flat wire being gripped at the coil placement unit 23.

The lead wire introduction mechanism 57 is constructed, having: a gripper main body 58 having a chuck (not shown)

for sandwiching and gripping the top and bottom faces on the rear-end side of the flat wire W; a movement cylinder 60 for moving the gripper main body 58 in the feed direction of the flat wire W; and two plate-shaped support members 61 for supporting the movement cylinder 60. The chuck provided at the gripper main body 58 is driven to be opened or closed by means of a top and bottom opening/closing cylinder 59.

The support members 61, as shown in FIG. 2, are erected at intervals in the feed direction K1 of the flat wire W on the top face 24A of the coil placement base 24 of the coil placement unit 23, and the movement cylinder 60 is attached to one of such support members 61. The movement cylinder 60 is disposed so that a rod 60A of the cylinder can be driven to advance to the side of the winder base 22. In addition, a guide member 62 overhangs so as to be disposed in a vertical direction with the rod 60A being sandwiched between the support members 61. In addition, the gripper main body 58 is provided at such guide member 62.

The gripper main body 58 is moved to a position at which the rod 60A is always advanced to the side of the coil feed guide 37 to its maximum, and the moved position is defined as a standby position. In addition, a movement distance when the rod 60A is most-retracted from the standby position is set so as to be substantially equal to a distance between a cut position of the flat wire W by means of the cutter unit 40 and a side end part of the winder base 22 of the coil introduction guide 44.

As a result, the flat wire W of which the first coil part 11 is formed at one end part is placed on the coil introduction guide 44; the other end part of the flat wire W is cut by means of the cutter unit 40 at a length at which the second coil part 12 can be formed; and thereafter, if an end part side of the flat wire W on the coil introduction guide 44 is gripped by means of the chuck of the gripper main body 58 set at the standby position to retract the rod 60A of the movement cylinder 60, the other end part of the flat wire W is entirely introduced onto the coil introduction guide 44. The abovementioned movement cylinder 60 is provided at the outside of the cylinder, taken along the coil introduction guide 44 in the first line 25.

In the coil placement unit 23, a lead wire feed mechanism 64 having a constitution similar to that of the lead wire introduction mechanism 57 is provided along the second line 26 and at the outside of the coil introduction guide 44 when being moved to the second line 26.

The lead wire feed mechanism 64 serves to feed the flat wire W, which is placed on the coil introduction guide 44 moved to the second line 26, to a second wire feeder 67 arranged at the most downstream side in the feed direction K2 of the flat wire W on the winder base 22. The lead wire feed mechanism 64 is constructed in such a manner that is similar to that of the lead wire introduction mechanism 57, as described above, and therefore, like constituent elements are designated by like reference numerals, and a detailed description thereof is omitted. However, the lead wire feed mechanism 64 and the lead wire introduction mechanism 57 are disposed in a layout such that these mechanisms are symmetrical to sandwich a center between the first line 25 and the second line 26 therebetween, namely in a mirror-image. In addition, in the gripper main body 58 of the lead wire feed mechanism 64, a standby position is defined as a position at which the rod 60A of the movement cylinder 60 is most-retracted to the upstream side in the feed direction K2 of the second line 26.

Therefore, in the second line 26, when the first coil part 11 is formed at one end part, on the coil introduction guide 44, and the flat wire W having a length of which the second coil part 12 can be formed at the other end part has been placed, if an end part side of the flat wire W on the coil introduction guide 44 is gripped by means of the chuck of the gripper main body 58 at the standby position to advance the rod 60A of the movement cylinder 60, the other end part of the flat wire W is fed to the second wire feeder 67.

The second wire feeder 67 is provided with one pair of pulleys 28 and a main body part 29 or the like, as in the first wire feeder 27, and has a structure which is substantially identical to that of the first feeder 27 as a whole. However, in the second wire feeder 67, one pair of pulleys 28 for sandwiching the main body part 29 and the flat wire W therebetween are structured to be retracted in a Y-axis direction orthogonal to the feed direction of the flat wire W that is a direction spaced from the flat wire W, and at this time, making passing of the flat wire W allowable. In addition, the second wire feeder 67 is arranged with the orientation of the layout of the first wire feeder 27 being varied by an angle of 180 degrees.

That is, one pair of pullers 28 and the main body part 29 are slidable in the Y-axis direction along left and right slide shafts 69 which are mounted to a frame body 68. The frame body 68 is constructed, having: support members 70 disposed at intervals in the Y-axis direction; and the slide shafts 69 allowed to overhang across these support members 70. Further, such frame body 68 is fixed to a top face of the winder base 22 in the winder unit 21.

In addition, as shown in FIGS. 6 to 10, the second wire feeder 67 is equipped with a coil receiver member 81 via a mount member 86. The coil receiver member 81 serves to receive the first coil part 11 when the first coil part 11 approaching the second coil part 12 is moved to the winder base 22 from the coil introduction guide 44 positioned in the second line 26 to the side of the winder base 22, as the second coil part 12 is processed to be wound around the other end part of the flat wire W by means of a second winding head 82 to be described subsequently. Since the second wire feeder 67 is movable in the Y-axis direction as described previously, the coil receiver member 81 having the second wire feeder 67 integrally equipped therewith also moves simultaneously when the second wire feeder 67 is retracted in the Y-axis direction.

A head feed unit 72 is disposed at the adjacent position at the most downstream side of the flow of the flat wire W, of the second wire feeder 67 in the second line 26. The head feed unit 72 is provided to feed the flat wire to the most downstream side in place of the second wire feeder 67 if the second wire feeder 67 is retracted in the Y-axis direction, and then, assist in execution of winding processing.

The head feed unit 72, as shown in detail in FIGS. 6 to 8, is constructed, having: a plate-shaped main body part 73 which is reciprocally slidable along the feed direction of the flat wire W; and a frame body 74 for supporting the main body part 73. The frame body 74 is constructed, having: support members 75 disposed at intervals in the feed direction of the flat wire W; and a slide shaft 76 which overhangs between both ends of these support members 75 to make the main body part 73 slidable.

In addition, a motor 77 serving as a drive source for slidably driving the main body part 73 is disposed at the opposite side of the second wire feeder 67 with the frame body 74 being sandwiched. A main shaft of the motor 77 is linked with a ball screw 78. A nut 79, which is screw-fitted with the ball screw 78, and a guide member 80 for guiding the slide shaft 76, are provided on a back face of the main body part 73. In this manner, the main body part 73 is slidable between the support members 75 along the slide shaft 76 by driving the motor 77 and by screw-fitting between the ball screw 78 and the nut 79.

A second winding head 82 is disposed on a top face of the main body part 73 of the head feed unit 72. The second winding head 82 serves to form the second coil part 12 in the shape of a rectangular cylinder by sequentially winding the other end part in a rectangular shape, at the other end part of the flat wire W that is fed out from the second wire feeder 67 or the head feed unit 72. At the final stage of the winding process of the second coil part 12, the lead part 12A is also bent at an angle of 90 degrees in the direction orthogonal to a surface of the coil part 12, by means of a mechanism or the like (not shown) before each winding process starts, so as not to interfere with the respective coil parts 11, 12 when the two coil parts 11, 12 approach (see FIGS. 3 and 4).

The second winding head 82 has a structure which is substantially identical to that of the first winding head 32. Therefore, like constituent elements are designated by like reference numerals, a detailed description of which is omitted. However, the second winding head 82 is disposed to enter a state in which the orientation of the layout of the first winding head 32 is varied by an angle of 180 degrees.

In addition, a top face guide 83A, which is slidable in the Y-axis direction by means of a cylinder 105, is provided at a coil receiver member 83 for receiving the second coil part 12. Further, the cylinder 105 is provided on a side face of the coil receiver member 83. The top face guide 83A is slidable in a parallel direction of the linked coil 10 so as to be removed without interfering with anywhere of the coil receiver member 83 and the fixing jig 33A, when the linked coil 10 is removed by being fed out from the coil receiver member 83 to the tip side in the feed direction of the flat wire W, or alternatively, by being pull out upward of the fixing jig 33A, after winding processing of the second coil part 12 by means of the second winding head 82 has been completed, and subsequently, a parallel-shaped linked coil 10 is completed to be associated with the first coil part 11. In FIGS. 1 and 31, the top face guide 83A is not shown.

On the top face taken along the second line 26 of the winder base 22, a coil takeout unit 84 is provided across both ends in the feed direction of the flat wire Win the winder base 22. The coil takeout unit 84, as shown in detail in FIGS. 9 to 11, is constructed, having: two columnar members 85 which are erected at predetermined intervals at two respective sites at both ends in the feed direction of the flat wire W of the winder base 22; and guide members 87 for chuck unit, which overhang between these columnar members 85.

A chuck unit 88 is engaged with the guide member 87 for chuck unit, and the chuck unit 88 is slidable along the feed direction K2 of the flat wire W. The chuck unit 88 is provided with a slider main body 89 formed in the shape of a rectangular box, and a horizontal through hole 89A which is engaged with the two guide members 87 for chuck unit is drilled on a side face in a thickness direction (vertical direction) of the slider main body 89. In addition, a hole 89B for rod 90A of a chuck movement cylinder 90, which is parallel to the through hole 89A and reaches a substantial center part in the lengthwise direction of the slider main body 89, is drilled at an intermediate position of the two guide members 87 for chuck unit on the side face of the slider main body 89.

The rod 90A of the chuck movement cylinder 90 securely fitted to the columnar member 85 is inserted into the hole 89B for rod 90A, and a tip end of the rod 90A is engagingly locked with a fixing portion (not shown) of the center part of the slider main body 89. In addition, the chuck movement cylinder 90 is attached at the most downstream side of the flow in the feed direction K2 of the flat wire W in the columnar member 85. Therefore, the chuck movement cylinder 90 is driven to move the rod 90A forward/backward, and the slider main body 89 thereby slides in the forward/backward direction along the guide members 87 for chuck unit.

A chuck mechanism 91 for gripping the linked coil 10 is provided at the slider main body 89. That is, the chuck mechanism 91, as shown in FIGS. 10 and 11, is mounted to the slider main body 89 via a support block 93, and the support block 93 is provided to be protruded upward at one side face in the direction orthogonal to the feed direction of the slider main body 89 and at a flat rectangular protrusion 89C.

The chuck mechanism 91 is linked with a vertical movement cylinder 94. That is, the support block 93 is provided on a top face of the protrusion 89C of the slider main body 89, and a cylinder hole pierced in a vertical direction, and a through hole for guide shaft 95, guiding vertical movement of the chuck mechanism 91, are drilled in the support block 93.

The chuck mechanism 91 is positioned downward of the support block 93, and is provided while the mechanism is suspended by the support block 93. In addition, a linking part 96 is provided at a lower end of the chuck mechanism 91; a rod of the vertical movement cylinder 94 is linked with a top face of the linking part 96; and the guide shaft 95 is erected at both sides of the rod in the linking part 96. Further, a chuck part 92 extending downward is provided at the linking part 96. The chuck part 92 is openable and closable by means of a known structure.

Therefore, if the vertical movement cylinder 94 is driven, the rod is advanced or retracted, whereby the chuck mechanism 91 is lowered or risen. When the chuck mechanism 91 is lowered to a predetermined position, the chuck part 92 is adapted to close so as to be capable of gripping the first coil part 11 fed to the predetermined position.

In the coil takeout unit 84 as described above, as shown in FIGS. 10 and 11, a movement stopper mechanism 98 for stopping movement of the slider main body 89 is provided on each side face in the widthwise direction of the slider main body 89. The movement stopper mechanism 98 is comprised of: a cylinder 99 which is mounted to each side face in the widthwise direction of the slider main body 89; and a stopper member (not shown) which is provided at a rod tip end of the cylinder 99. In addition, the abovementioned stopper member is allowed to come into contact with, or alternatively, to be spaced from, the guide member 87 by means of forward/backward movement of the rod, namely by means of radial movement of the guide member 87, the stopper member approaches and abuts; the guide member 87 is thereby compressed; and movement of the slider main body 89 or the chuck mechanism 91 is thereby stopped.

A sensor mount shaft 100 overhangs at the opposite side of the guide member 87 between the columnar members 85 disposed in parallel to each other. A coil position measurement sensor 101 for measuring a coil position is mounted at a predetermined position in the lengthwise direction of the sensor mount shaft 100. The coil position measurement sensor 101 serves to measure a position of the first coil part 11 that approaches the side of the second coil part 12 as winding processing of the second coil part 12 advances. As the measurement sensor 101, a transparent photosensor is employed, for example. On the other hand, a sensor dog 102 which corresponds to the sensor 101 is mounted on a top face of the slider main body 89 and on a diagonal line of the protrusion 89C. In addition, length measurement means 113 is comprised of the sensor 101 and the sensor dog 102. In this manner, when the slider main body 89 moves along the feed direction of the flat wire W, the sensor 101 detects movement of the sensor dog 102, and transmits the detected signal to a main control part 110 to be described later.

An interrelationship among a chuck unit 88, the second wire feeder 67, and the head feed unit 72, of the coil takeout unit 84 constructed as described hereinbefore, will be described referring to FIGS. 6 to 10. The first coil part 11 that is formed at the other end part of the flat wire W approaches the second wire feeder 67, as winding of the second coil part 12 is advanced by means of interlocking between the second wiring head 82 and the second wire feeder 67. When the first coil part 11 arrives at a predetermined position immediately preceding interference with the second wire feeder 67, a chuck mechanism 91 of the coil takeout unit 84 that is on standby at the predetermined position is lowered; and when the lowest point is reached, the chuck part 92 is closed, and the first coil part 11 is gripped. At this time, a stopper function of a movement stopper mechanism 98 is established in an inactive state, and a chuck movement cylinder 90 is established in a slide-free state in which a drive air pressure is not fed to either of the sides of a piston.

Next, the clamping of the flat wire W by means of one pair of pulleys 28 of the second wire feeder 67 is released, and the frame body 68 and the pulleys 28 of the second wire feeder 67 is moved in the Y-axis direction, and is then retracted in the direction spaced from the flat wire W.

Afterwards, as shown in FIG. 7, the fixing jig 33A is driven downward by means of a cylinder (not shown) which is linked with the fixing jig 33A, the flat wire W is thereby clamped, and while the flat wire is hooked by means of the fixing jig 33A, the motor 77 of the head feed unit 72 is driven to feed the main body part 73 by means of action between the ball screw 78 and the nut 79, and the flat wire W is thereby drawn out. At this time, the chuck mechanism 91 is free in movement, and the stopper function of the movement stopper mechanism 98 is established in an inactive state.

Next, as shown in FIG. 8, in order to perform bending processing of a next edge by means of the second winding head 82, after the flat wire W has been drawn out, the clamping exerted by means of the fixing jig 33A is released, and the head feed unit 72 is then returned by the length of one edge. At this time, if the movement of the chuck mechanism 91 is free with the first coil part 11 being gripped, the chuck mechanism moves together with the folding of the head feed unit 72, so that the stopper function of the movement stopper mechanism 98 is activated. Namely, the cylinder 99 is driven, a pad of a rod tip end of the cylinder is pressed against the guide member 87, and the chuck mechanism 91 is then stopped. At the time of winding, the stopper mechanism 98 is released, and the chuck mechanism 91 is set free in movement again.

By repeating the operations of FIGS. 6 to 8, after the linked coil 10 having the first and second coil parts 11 and 12 provided in parallel to each other has been completed, the coil receiver member 83 is slid to a position at which the linked coil 10 is removable; and thereafter, as shown in FIG. 10, the chuck mechanism 91 is risen from the position of the second winding head 82 with the first coil part 11 being gripped, the slider main body 89 is moved, and the linked coil 10 is then conveyed up to a completed linked coil takeout position B. Afterwards, the slider main body 89 moves to the side of the coil placement unit 23, is returned to its initial position, and then, is on standby there.

With the use of the linked coil formation device 20 that is constructed as described hereinbefore, an arithmetic and control part 110 which is a main control part for variably controlling a processing position setting operation of the first and second winding heads 32 and 82, etc., with a predetermined timing, based upon control information to be externally input, is provided together in order to form the first and second coil parts 11 and 12.

The arithmetic and control part 110, as shown in FIG. 12, is constructed, having: an input part 11 for a variety of instructions; a memory 112 having a variety of information stored therein; and length measurement means 113. In addition, the arithmetic and control part 110 exchange a signal with: the first wire feeder 27; the first winding head 32; the cutter unit 40; the lead wire introduction mechanism 57; the flat wire movement unit 50; the lead wire feed mechanism 64; the second wire feeder 67; the head feed unit 72; the second winding head 82; and the coil takeout unit 84 or the like, so as to enable control of these mechanisms.

To the arithmetic and control part 110, an instruction based upon a variety of information is input from the input part 111. Then, based upon the input instruction, between the arithmetic and control part 110 and the first wire feeder 27, a feed quantity and a feed velocity or the like, of the flat wire W fed from the flat wire feed part A, are controlled in the first processing line 25.

Between the arithmetic and control part 110 and the first winding head 32, based upon an instruction from the input part 111, the arithmetic and control part 110 performs control of a timing and bending velocity or the like of bending processing at an angle of 90 degrees by means of the winding part 33. Between the arithmetic and control part 110 and the cutter unit 40, based upon an instruction from the input part 111, the arithmetic and control part 110 controls: cutting by means of a cutter at a predetermined position of the flat wire W due to advancement in the Y-axis direction of the cutter main body part 42 of the cutter unit 40; and returning to its initial position, of the cutter main body part 73 after the cutting, etc.

Between the arithmetic and control part 110 and the lead wire introduction mechanism 57, based upon an instruction from the input part 111, the arithmetic and control part 110 controls an introducing operation from the coil feed guide 37 to the coil introduction guide 44 while the first coil part 11 is formed at one end part, and is placed on the coil introduction guide 44; and gripping the other end side of the flat wire W cut by means of the cutter unit 40. That is, timing of gripping the other end part of the flat wire W by means of the opening/closing cylinder 59 or a timing of driving the chuck movement cylinder 60 or opening the opening/closing cylinder 59, etc., is controlled.

Between the arithmetic and control part 110 and the flat wire movement unit 50, based upon an instruction from the input part 111, an operation of internally moving the coil introduction guide 44 having placed thereon the flat wire W of which the first coil part 11 is formed at one end part and the other end part is cut at a predetermined length from the first processing line 25 to the second processing line 26, is controlled on the coil placement base 24 of the coil unit 23 by means of the arithmetic and control part 110. That is, timing of driving the cylinder 53 of the flat wire movement unit 50 and a movement velocity, etc., of the coil introduction guide 44 moving from the first line 25 to the second line 26 are controlled.

Between the arithmetic and control part 110 and the lead wire feed mechanism 64, based upon an instruction from the input part 111, the arithmetic and control part 110 performs control of gripping the other end part of the flat wire W placed on the coil introduction guide 44 positioned on the second processing line 26 and feeding the flat wire to the second wire feeder 67. That is, timing of gripping the other end part of the flat wire W by means of the opening/closing cylinder 59, or alternatively, timing of driving the check movement cylinder or opening the opening/closing cylinder 59, etc., is controlled.

Between the arithmetic and control part 110 and the second wire feeder 67, based upon an instruction from the input part 111, the arithmetic and control part 110 performs control of feeding out the flat wire W to the second winding head 82 or retracting the feeder in the direction spaced from the flat wire W as required, in order to form the second coil part 12 at the other end part of the flat wire at the second winding head 82. That is, control of timing of retracting the second wire feeder 67 in the Y-axis direction and a retraction velocity or the like is performed, when the first coil part 11 approaching the side of the second coil part 12, as winding processing of the second coil part 12 advances, has reached a predetermined position on the second processing line 26.

Between the arithmetic and control part 110 and the head feed unit 72, based upon an instruction from the input part 111, the arithmetic and control part 110 performs control of conveying the flat wire W by reciprocally moving the head main body part 73 in the direction indicated by the arrow S in the case where the feed action of the flat wire W by the second wire feeder 67 is not influenced, etc.

Between the arithmetic and control part 110 and the second winding head 82, based upon an instruction from the input part 111, the arithmetic and control part 110 performs control of a timing of bending processing at an angle of 90 degrees by means of the winding part 33 and a bending velocity, etc., in order to form the second coil part 12 at the other end part of the flat wire W fed from the second wire feeder 67 or the head feed unit 72.

Between the arithmetic and control part 110 and the coil takeout unit 84, based upon an instruction from the input part 111, the arithmetic and control part 110 performs control of: gripping the first coil part 11 at a predetermined position at which the flat wire W having the first coil part 11 formed at one end part thereof approaches the second coil part 12 being formed; and taking out the linked coil 10 at a predetermined position after completion of the linked coil 10, subsequent to winding processing of the second coil part 12 by means of the head feed unit 72 and the second winding head 82.

A memory 112 stores a variety of information such as items of information on reference dimensions (set dimensions) of a gap between the first and second coil parts 11, 12 preset; width and thickness dimensions of the flat wire W; the number of laminate steps in winding in a rectangular cylinder shape; long-edge and short-edge dimensions of the rectangular cylinder shape; and full-length dimensions of the flat wire required to form the first and second coil parts 11, 12, for example.

In addition, the length measurement means 113 are connected to the arithmetic and control part 110, for measuring a parallel interval between corresponding coil edges of the coil parts 11, 12, as a linked site length, the interval including a length of the linked part 12 prior to final two turns in the second coil part 12 immediately before completion of the second coil part 12, the coil parts being positioned in the direction orthogonal to that of the linked part 13, and feeding the measured length to the arithmetic and control part 110.

Further, the arithmetic and control part 110 is provided with: a measurement data distribution function of distributing measurement data on the linked part length measured by the length measurement means 113 into use for disposition interval of both of the coils 11, 12 that are specified (set) in advance and use for coil edges including use for flat wire adjustment set for the second coil part 12; an offset quantity setting function of setting a predetermined offset quantity F at one edge of the last rectangular winding portion of the second coil part 12; and a disposition interval setting control function of setting/controlling the disposition interval of both of the coil parts 11, 12.

Next, referring to FIGS. 14 to 19, a method of forming linked coils by means of the linked coil formation device 20 of the present embodiment, will be described based on the flowchart of FIG. 13.

In the flowchart of FIG. 13, a description will be given on the presumption that the step of judgment when migrating to the next step (ST), i.e., judgment of whether or not a desired condition is met is Yes, namely is affirmative in all of the steps. In addition, the arithmetic and control part 110 in the entire linked coil formation device 20 is shown in FIG. 14 only, and indications of the flat wire feed directions K1, K2 and indications of the most upstream side and the most downstream side, etc., are also shown in FIG. 14 only. Further, although individual units and mechanisms, which are constituent elements of the linked coil formation device 20 shown in FIGS. 14 to 19, are different in shape from those of the aforementioned linked coil formation device 20 shown in FIGS. 3 to 11, these units and mechanisms are the merely simplified ones, and in the following description, like constituent elements or the like are designated by like reference numerals, and are explained.

First, in the first line 25, winding between the first and second coil parts 11 and 12, namely the flat wire W of its length sufficient to form the linked coil 10 is provided. The flat wire W is supplied from a flat wire feed part A such as a wire rod bobbin and is fed to the first feeder 27 in the first line 25, and then, from the first feeder 27, the flat wire W is fed to the first winding head 32.

Next, in the first step (ST1), bending processing is implemented as follows. That is, as shown in FIG. 14, in the first line 25, a tip end of the flat wire W is set in a winding-enable state after being passed through between the fixing jig 33A and the winding jig 33B of the winding part 33 on the first winding head 32; the first winding head 32 is driven by diving the arithmetic and control part 110 based upon an instruction from the input part 111; and the tip end part of the flat wire W is pinched between the winding jig 33B and the fixing jig 33A of the head main body part 34, whereas the winding jib 33B is turned at an angle of 90 degrees from its initial position in the direction indicated by the arrow shown in FIGS. 5 and 14. The first coil part 11 is completed by repeating the bending processing at an angle of 90 degrees and feeding-out of the flat wire W of a predetermined length by the first wire feeder 27, and then, winding up to a predetermined number of turns. As described previously, the lead part 11A of the first coil part 11 is bent at an angle of 90 degrees in the direction orthogonal to a surface of the coil part 11, immediately before the winding step starts.

Judgment of completion of the first coil part 11 can be effected by counting the number of turns of the winding jig 33B in the first winding head 32, for example. That is, the arithmetic and control part 110 effects control in such a manner that: the number of turns of the winding jig 33B leading up to the completion of the first coil part 11 is preset; the number of turns is stored in the memory 112; and when the preset number of turns is reached, the winding jib 33B does not turn and the wire feed function of the first wire feeder 27 is not driven.

Next, as shown in FIG. 15, in the first line 25, based upon an instruction from the input part 111, a wire rod bobbin and the first wire feeder 27 are driven by means of the arithmetic and control part 110; the flat wire W for forming the completed coil part 11 and the second coil part 12 is fed out by means of lead wire feeding which is normal feeding, along the flat wire feed direction K; and the first coil part 11 is drawn from the first winding head 32, and is moved to the downstream side of the flat wire feed direction K1.

At this time, the flat wire W for forming the first and second coil parts 11 and 12, which is drawn out from the first winding head 32, is introduced onto the coil introduction guide 44 that is on standby on the first line 25 of the coil placement unit 23 via the coil feed guide 37, and moves on the coil introduction guide 44.

The second step (ST2) is implemented as follows. That is, as shown in FIG. 16, in the first line 25, a rear end part in the feed direction of the flat wire W is cut by driving the cutter unit 40 after the flat wire W of its sufficient length has been drawn for forming the second coil part 12. In addition, at this time, since the rear end part of the flat wire W is present on the coil feed guide 37, the other side end part of the flat wire W is gripped by means of the gripper main body 58 of the lead wire introduction mechanism 57 that is on standby at one side end part of the winder unit 21; the movement cylinder 60 is driven to eject the flat wire from the coil feed guide 37; and the gripped flat wire W is introduced to the coil introduction guide 44. In this manner, a rear end of the flat wire W is moved onto the coil introduction guide 44 by a dimension LB and the first coil part 11 of one end is placed at the substantially most tip end part of the coil introduction guide 44. This position is then defined as an optimal position.

In addition, an end part of the cut flat wire W on the side of the first wire feeder 27 is returned by a dimension LA from the cut position up to the wiring start position exerted by the first winding head 32, by reversely rotating one pair of pulleys 28 of the first wire feeder 27.

Afterwards, the third step (ST3) is implemented as follows. That is, as shown in FIG. 17, in the first line 25, after release of the grip of the flat wire W by means of the gripper main body 58 of the lead wire introduction mechanism 57 of the first line 25, the movement cylinder 53 of the flat wire movement unit 50 is driven to move the coil introduction guide 44 on the first line 25 to the second line 26. Afterwards, in the first line 25, winding processing of the first coil part 11 for forming the next linked coil 10 is started by way of a cooperative work of the first line feeder 27 and the first winding head 32.

Next, in the first line 25, winding processing of the first coil part 11 is continued by way of a cooperative work between the first wire feeder 27 and the first winding head 32. On the other hand, in the second line 26, in order to feed to the side of winder unit 21 the flat wire W placed on the coil introduction guide 44 on the second line 26, the lead wire feed mechanism 64 is driven; the other end side of the flat wire W is gripped by means of the chuck part of the mechanism; the rod 60A of the movement cylinder 60 is advanced; and the flat wire W is fed from the coil introduction guide 44 to the second wire feeder 67.

In the first line 25, subsequently, winding processing of the first coil part 11 is continued by way of a cooperative work between the first wire feeder 27 and the first winding head 32, whereas in the second line 26, winding processing of the second coil part 12 is started as the fourth step (ST4) by way of: wire feeding of the second wire feeder 67 to the other end part of the flat wire W fed to the second winding head 82; and an action of the fixing jig 33A and the winding jig 33B, of the second winding head 82. As winding processing of the second coil part 12 advances, the first coil part 11 moves to side of the second coil part 12 and approaches there. Further, after winding of the second coil part 12 has advanced, if the first coil part 11 is completely released from the coil placement unit 23, the coil introduction guide 44 is moved to the first line 25 by returning the movement cylinder 53 of the flat wire movement unit 50.

Afterwards, as shown in FIG. 18, in the first line 25, wining processing is completed; the first coil part 11 is completed; as in the aforementioned second step (ST2), based upon an instruction from the input part 111, by means of the arithmetic and control part 110, the wire rod bobbin and the first wire feeder 27 are driven; the flat wire W for forming the completed first coil part 11 and the second coil part 12 is fed out by way of lead wire feeding along the flat wire feed direction K; and the first coil part 11 is drawn out from the first winding head 32, and is moved to the downstream side of the flat wire feed direction K1. At this time, if the coil introduction guide 44 is still present on the second line 26, a standby state is established until the coil introduction guide 44 returns to the first line 25.

On the other hand, in the second line 26, after it is verified that the number of turns of the second coil part 12 has reached a predetermined number of steps by way of wire feeding of the second wire feeder 67 and the action of the fixing jig 33A and the winding jig 33B, of the second winding head 82, the feeder main body part 73 of the second wire feeder 67 is moved in the Y-axis direction that is a direction spaced from the flat wire W, along the slide shaft 76. At this time, the first coil part 11 is moved up to the proximal position of the second wire feeder 67.

Next, in the first line 25, as in the second step (ST2), an end part of the flat wire W of a length sufficient for formation of the second coil part 12 is cut by driving the cutter unit 40, and the cut flat wire is introduced to the coil introduction guide 44. In addition, the cut end part of the flat wire W on the side of the first wire feeder 27 is returned from the cut position up to the winding start position by means of the first winding head 32.

On the other hand, in the second line 26, the flat wire W fed by reciprocation of the head feed unit 72 in place of the second wire feeder 67 is continuously subject to winding processing of the second coil part 12 by way of the action of the fixing jig 33A and the winding jig 33B, of the second winding head 82. At this time, the second wire feeder 67 is retracted in the direction spaced from the flat wire W, and thus, the first coil part 11 never interferes with the second wire feeder 67.

Next, as shown in FIG. 19, in the first line 25, after release of the grip of the flat wire W by means of the gripper main body 58 of the lead wire introduction mechanism 57, the movement cylinder 53 of the flat wire movement unit 50 is driven to move the coil introduction guide 44 from the first line 25 to the second line 26 on the coil placement unit 23. At the same time, winding processing of the first coil part 11 for forming the next linked coil 10 is started by way of a cooperative work between the first wire feeder 27 and the first winding head 32. On the other hand, in the second line 26, offset adjustment between the first and second coil parts 11 and 12 and interval adjustment are made by way of edge-feeding of the head feed unit 72 and action of the fixing jig 33A and the winding jig 33B, of the second winding head 82; the second coil part 12 formed at an end part of the flat wire W reaches a predetermined number of steps; and winding processing is completed, and one linked coil 10 is thereby completed.

Afterwards, in the first line 25, winding processing of the first coil part 11 is continued by way of a cooperative work between the first wire feeder 27 and the first winding head 32. On the other hand, in the second line 26, the completed linked coil 10 is gripped by means of the coil takeout unit 84, and is conveyed onto predetermined conveyance equipment.

Afterwards, the steps from the first step (ST1) to the fourth step (ST4) are repeated, and a desired quantity of linked coils 10 is produced.

Here, as shown in FIG. 19, upon completing the linked coil 10, when the final winding step is executed, the head feed unit 72 and the second winding head 82 are controlled by means of the arithmetic and control part 110; a flat wire conveyance mechanism of the head feed unit 72 is activated; edge-feeding as indicated by the arrow S (See FIG. 6) is performed; and offset adjustment of the linked part 13 between the first and second coil parts 11 and 12 is first performed. An interval between the first and second coils 11 and 12 is preset. In addition, as shown in FIG. 19, the linked coil 10 is completed in such a manner that: offset adjustment between the first and second coil parts 11 and 12 has completed and a predetermined interval has been obtained.

Next, the offset adjustment in the fourth step (ST4) will be described in detail referring to FIGS. 20 to 28. First, a relative interrelationship between the first and second coil parts 11 and 12 will be described referring to FIG. 20. A coil pitch X in the relative position view of the abovementioned coil parts 11, 12 is formed by the final turn of the winding step of the second coil part 12, in accordance with a value of a preset coil gap L2.

On the other hand, a coil displacement Y is positionally corrected so as to be zero in winding operation in short of two turns in the final step, i.e., so that the first and second coil parts 11 and 12 are arranged without being displaced from each other. The coil displacement Y is due to accumulation of a feed error, etc., of the flat wire W in the second coil winding step. In the method of forming linked coils by the linked coil formation device of the first embodiment, a distance from an arbitrary reference position to the first coil part 11 is measured at a time point while in the second coil winding; an offset part which is an adjustment substitute in accordance with the distance data is formed, thereby eliminating an accumulated error leading up to the time point of the second coil winding. Although this distance measurement must be executed at a position in short of two turns of the final step in which a position correction operation is to be performed, the measurement is desirable at a position immediately preceding the above position, i.e., a position in short of three turns of the final step, if possible.

As shown in FIG. 21, winding of the second coil part 12 advances; the first coil part 11 moves along a wire feed direction H, and further approaches the second coil part 12; for example, if a state in short of three turns or more (three-turn winding, each turn of which is at an angle of 90 degrees) from the completion of winding is established, a position of the first coil part 11 is detected by means of a coil measurement sensor 101 and a sensor dog 102 constructing the length measurement means 113; and information on the detected position is transmitted to the arithmetic and control part 110 (see FIG. 12).

The measurement sensor 101 is fixed at a reference position S for distance measurement in a sensor mount shaft 100, as described previously, and a sensor dog 102 corresponding thereto is mounted to the slider main body 89. A chuck part 92 for chucking the first coil part 11 is provided at the slider main body 89. Therefore, a position relationship between the first coil part 11 and the sensor dog 102 retained at the chuck part 92 is always kept unchanged, so that positional information of the first coil part 11 can be obtained by measuring a distance from the reference position S for distance measurement to the sensor dog 102. This measurement, as described previously, is performed at a position in short of 3 turns or more from the final turn, when the flat wire W is fed for the sake of the next bending processing.

When the flat wire W is fed by means of the head feed unit 72, a dive pulse is input to a control driver (not shown) of the motor 77. Since a movement quantity of the head feed unit 72 for one drive pulse is calculated from a deceleration ratio of a motor part and a screw lead length of a ball screw, the head feed unit 72 starts operation, and if the number of pulses required for the sensor dog 102 to reach the measurement sensor 101 (the number P of measured pulses in FIG. 22) is counted, the counted number can be converted to the distance from the sensor dog 102 to the measurement sensor 101 that is fixed at the reference position S for distance measurement.

A distance (the coil displacement Y) from the measurement sensor 101 (measurement reference position S) to the sensor dog 102, which is calculated based upon the measured pulse, is one of the three cases in which it is equal to: a reference length, namely appropriate distance as shown in FIG. 23; it is longer than the appropriate distance as shown in FIG. 24; and it is shorter than the appropriate distance as shown in FIG. 25.

In addition, as shown in FIG. 23, the fact that the distance between the sensor 101 and the sensor dog 102 is appropriate means that the distance between the first and second coil parts 11 and 12 is appropriate to form the linked coil 10, as shown in FIG. 23(B). That is, if winding is performed without positional correction, both of coil parts 11 and 12 is set free of the coil displacement Y, with the reference offset, as shown in FIG. 23(B).

In addition, as shown in FIG. 24, the fact that the distance between the sensor 101 and the sensor dog 102 is long means that the distance between the first and second coil parts 11 and 12 is longer than the appropriate value; and as shown in FIG. 24(B), when winding is performed without positional correction, the distance between the coil parts 11 and 12 is displaced to an positive side. Therefore, as shown in FIG. 24(C), the distance between the first and second coil parts 11 and 12 can be made appropriate by performing winding with the above displacement being offset to the positive side (with positional correction being performed).

Further, as shown in FIG. 25, the fact that the distance between the sensor 101 and the sensor dog 102 is short means that the distance between the first and second coil parts 11 and 12 is shorter than the appropriate value, and as shown in FIG. 25(B), when winding is performed without positional correction, the distance between the coil parts 11 and 12 is displaced to a negative side. Therefore, as shown in FIG. 25(C), the winding is performed with the above displacement being offset to the negative side (positionally corrected), and the distance between the first coil parts 11 and 12 is thereby allowed to be appropriate.

As described hereinabove, in the case where inter-coil lead length is different from another one, when winding has been completed without positional correction (with an offset part being provided) in order to form linked coils, and the interposition of the respective first and second coils 11 and 12 is displaced according to whether the inter-coil lead length is long or short. This method is to correct the coil displacement Y at the completion of the winding by varying the offset length accordance to whether the inter-coil lead length is long or short. Further, as shown in FIGS. 24 and 25, it is shown that the linked coil of the FIGS. 24(C) and 25(C) having wound after positional correction is free of the displacement of the interposition of the first and the second coil parts 11, 12, and consequently, whether the coil lead is long or short appears as the displacement of the offset part. Here, the reason why the inter-coil lead length in the case where winding is performed without interposition displacement without positional correction has been set as an appropriate length is that, when a coil of which an inter-coil lead length is shorter than the appropriate lead length is corrected and wound, the offset part which is an adjustment substitute is disallowed to appear in an internal diameter of the coil.

In FIG. 26, in the embodiment, a coil displacement is perceived as a gap from a reference position at which precise linking/winding is executed, if a wire feed quantity for one pulse P is L mm, a wire feed correction quantity F in the case of FIG. 26(A) is obtained based upon formula (1) below:

$$F=(P1-P0)\times L/2 \quad (1)$$

In supplemental explanation of formula (1) with reference to FIG. 27(A) and FIG. 27(B), in the measured two first coil parts 11, if offset quantities of the offset part 14 are different from each other by Δk, in FIG. 27(A) and FIG. 27(B), a wire rod length of that portion is obtained as 2×Δk. This is the reason why because (P1−P0)×L is divided by 2 in formula (1) above.

If a wire feed correction quantity F is set, the correction quantity F is defined as an offset dimension, namely adjustment substitute. In addition, as shown in FIG. 28(A), a correction feed dimension L1 obtained by adding the offset dimension F to an ordinary feed dimension (hereinafter, referred to as a long-edge dimension or equivalent) is set, and wire feeding is fed with a value of pulse P such that the correction feed dimension L1 is obtained. After a first coil part 11 has been then fed out the correction feed dimension L1, when the flat wire W is processed to be bent with the winding jig 33B being turned at an angle of 90 degrees as shown in FIG. 28(B), the long-edge dimension of the second coil part 12 of that portion appears as a dimension obtained by adding the abovementioned offset dimension F.

Next, as shown in FIG. 28(A), the wire is fed in an ordinary feed dimension, namely a feed dimension L3 for a length of a short edge of the first coil part 11 and a gap L2, and at that position, the winding jig 33B is turned at an angle of 90 degrees, as shown in FIG. 28(B), and when the flat wire W is thereby processed to be bent as a final flat winding step, the gap L2 between the coil parts 11 and 12 is precisely ensured. The abovementioned dimensional gap L2 is an indispensably determined dimension when axial centers W1, W2 of the coils 11, 12 are coincident with the coil pitch X, and the coil pitch X is specified in advance.

As described above, a distance between the axial centers W1 and W2 of the first and second coil parts 11 and 12 of the linked coil 10 is coincident with the preset (specified) coil pitch W, and two linear parts of the substantially ring-shaped linked core 2 can be thereby inserted.

Here, when the second wire feeder 67 is retracted from the second processing line 26, and then, a feed operation of the flat wire W by means of the second wire feeder 67 is stopped, in particular, a winding operation of the second coil part 12 from a state short of the final two turns up to the final rectangular winding is performed by: driving the arithmetic and control part 110 in accordance with an instruction of the input part 111; reciprocally moving the main body part 73 of the head feed unit 72 in the direction taken along the flat wire feed direction K2 by means of the arithmetic and control part 110; and turning the winding jig 33B at 90 degrees with reference to the fixing jig 33A at their respective positions.

That is, as shown in FIG. 28(A), when the number P of wire feed pulses is set to be the correction feed dimension L1 between the coil parts 11 and 12, the head feed unit 72 moves the second winding head 82 incorporating the fixing jig 33A and the winding jig 33B up to the position of S1, whereby: the flat wire W is fed out at a length corresponding to the correction dimension L1; and the fixing jig 33A and the winding jig 33B indicated by the virtual line, which have been set at the position S1, move up to a bending processing position S2, by returning of the head main body part 73 at the same length corresponding to the correction dimension L1, as described previously. At this time, a stopper function of the movement stopper mechanism 98 of the slider main body 89, which is amount base of the chuck part 92 gripping the first coil part 11, is actuated so as to disable the fed out flat wire W to return together with the second winding head 82. Afterwards, 90-degree bending processing is implemented at a position corresponding to the bending processing position S2, as shown in FIG. 23(B).

Similarly, at the final bending processing between the coil parts 11 and 12, as shown in FIG. 29(A), the fixing jig 33A and the winding jig 33B indicated by the virtual line that has been set at the position S2 move up to the bending position S3 by the head feed unit 72 moving by edge feeding, as described previously. At that position, 90-degree bending is then implemented, as shown in FIG. 29(B).

According to the first embodiment as described above, the following effects are attained.

(1) The first coil part 11 is formed at one end part of the flat wire W in the first coil winding processing line 25, and subsequently, the second coil part 12 is formed at the other end part of the flat wire W in the second coil winding processing line 26; in this duration, the flat wire W provided by the first coil part 11 is continuously transferred to the second coil winding processing line 26 via the coil placement unit 23; and therefore, the flat wire W is sequentially moved continuously in one direction from introduction to the end of processing of each of the coil parts 11, 12, so that each of the coil parts 11, 12 can be processed speedily and efficiently.

(2) Since the coil placement unit 23 is constructed to be compatible with the first and second coil winding processing lines 25, 26 disposed in parallel to each other, the flat wire W provided with the first coil part 11 formed in the first coil winding processing line 25 can be transferred smoothly and speedily to the second coil winding processing line 26 by means of the coil placement unit 23. As a result, processing/production efficiency of the linked coil 10 can be improved.

(3) Since the linking part 13 for linking the first and second coil parts 11 and 12 is provided continuous to both of the coil parts 11 and 12, the linking part 13 can be easily formed without need for welding or folding.

(4) Although winding processing is performed for the flat wire W fed from the second wire feeder 67 by means of the second wiring head 82, if the first coil part 11 approaches the second coil part 12 as winding processing of the second coil part 12, and then, the second wire feeder 67 is retracted in the Y-axis direction, the flat wire W is not fed from the second wire feeder 67. However, the second winding head 82 is provided on a top face of the head feed unit 72, and the head feed unit 72 can reciprocally move along the feed direction K2 of the flat wire W, so that processing leading up to the final winding processing can be performed, even if the working of the second wire feeder 67 is not attained.

(5) Since reciprocal movement of the main body part 73 of the head feed unit 72 is effected by screwing between the ball screw 78 directly coupled to the motor 77 and the nut 79 mounted to the main body part 73, precise reciprocal movement can be ensured, and the second coil part 12 can be thereby precisely processed to be wound.

Next, a second embodiment of the present invention will be described referring to FIGS. 30 to 37. A linked coil formation device 120 of the second embodiment allows a first forming unit 121 and a second forming unit 145 to be provided on the linked coil formation device 20 of the first embodiment, as shown in FIGS. 30 and 31.

That is, the forming units 121, 145 each serve to automatically form (bend) lead parts 11A, 12A of the first coil part 11 and the second coil part 12 by means of a foaming jig 136 and are arranged in a respective one of a first line 25 and a second line 26. As shown in FIG. 30, in the first line 25 of the linked coil formation device 120, the first forming unit 121 is arranged between the first winding head 32 and the cutter unit 40, and in the second line 26, the second forming unit 145 is arranged at the most downstream side of the flow of the flat wire W of the head unit 72.

Structures of the first and second forming units 121, 145 are identical to each other, whereas the second forming unit 145 is disposed with its orientation being varied by 180 degrees relative to the first forming unit 121. Therefore, the structure of the first forming unit 121 will be described hereinafter. The second forming unit 145 will be described later.

FIG. 32 is an entire side view of the first forming unit 121; FIG. 33 is an entire front view of the first forming unit in the view indicated by the arrow M of FIG. 32; and FIG. 34 is an entire plan view of the first forming unit 121 in the view indicated by the arrow N of FIG. 33.

As shown in these figures, FIGS. 32 to 34, the first forming unit 121 is provided with a support member 122 erected at intervals on a top face of the winder base 22 of the winding unit 21. The support members 122 each are formed in the shape of a rectangular plate, and a first cylinder 123 and a second cylinder 124 are provided in a horizontal direction, respectively, on an exterior face of a respective one of these support members 122 opposed to each other. Between these support members 122, two guide shafts 125 horizontally overhang at intervals in a widthwise direction thereof.

The first cylinder 123 serves to reciprocally move a lead wire clamper mechanism 126 in the feed direction and in the orthogonal direction, of a flat wire W, along the two guide shafts 125, and the second cylinder 124 serves to reciprocally move a forming jig 136 in the direction orthogonal to the feed direction of the flat wire W along the two guide shafts 125.

The lead wire clamper mechanism 126 is constructed, having: a first slide member 127 in the shape of a rectangular box, engaging with the two guide shafts 125 and moving along the guide shafts 125; columns erected 128 at four corners on a top face of the first slide member 127; a clamper 129 made of one pair of a lower clamper 129A and an upper clamper 129B provided at each of these columns 128; and a clamper drive cylinder 130 which is capable of vertically moving the upper clamper 129B relative to the lower clamper 129A.

A rod 123A of the first cylinder 123 is linked with one end part of the first slide member 127 and the rod 123A and the first slide member 127 are linked with each other via a linking member 139. Therefore, the first slide member 127 can be reciprocally moved along the guide shafts 125 by driving the first cylinder 123 to move the rod forward/backward.

The clamper 129 is formed in its entire shape of a rectangular column of a predetermined length. The upper clamper 129B is then thickly formed relative to the lower clamper 129A, and as shown in FIG. 32, a side end part of the second cylinder 124 of the upper clamper 129B is formed on an inclined face 129C retracting upward. Further, a part of a bottom face that follows the inclined face of the upper clamper 129B is thinly engraved so as to able to sandwich a thick part of the lead part 11A of the first coil part 11 between the upper clamper 129B, when lowered to its maximum, and the lower clamper 129A.

A guide member 131 formed in the shape of a round rod is vertically erected at the forward/backward position in the movement direction of the first slide member 127 of the lower clamper 129A. The guide member 131 is inserted into a through hole which is formed in the upper clamper 128B, and is formed in a length to such an extent as to enable vertical movement of the upper clamper 129B. Further, a cylinder mount plate 132 for fixing the guide member 131 is fixedly attached to an upper part of the guide member 131.

The clamper movement cylinder 130 for vertically moving the upper clamper 129B is mounted to the cylinder mount plate 132 with the cylinder being oriented upward, and a rod 130A of the cylinder is linked with a top face of the upper clamper 129B. Therefore, the upper clamper 129B moves vertically relative to the lower clamper 129B by driving the clamper movement cylinder 130 to move the rod 130B forward/backward.

A second slide member 135 disposed in opposite to the first slide member 127 is movably provided on the horizontal guide shafts 125. The second slide member 135 is formed in the shape substantially identical to that of the first slide member 127.

On a top face of the second slide member 135, a jig support member 137 which supports the forming jig 136 and is vertically movable is provided to extend upward. The jig support member 137, as shown in FIG. 32, is formed in a protrusive shape in its front shape, namely is formed of a lower part 137A and a protrusive part 137B provided thereon. In addition, the protrusive part 137B bifurcates, and the forming jig 136 in the shape of a disk is accommodated into the bifurcated part. The forming jig 136 is formed like a disk, and its thickness is set in dimensions to such an extent as to enable abutment against a substantial full width of the lead part 11A (12A). Such forming jig 136 is rotatably supported on the bifurcated part of the protrusive part 137B by means of a pin 138.

Vertical guide shafts 139 are provided at the lower part of the jig support member 137 and at both sides at which the protrusive part 137 is sandwiched. Lower ends of the guide shafts 139 are fixedly attached to the top face of the second slide member 135, and upper ends of these shafts is fixed to a guide fixing member 140. In addition, the guide fixing member 140 is arranged on a back face of a coil ejection guide 37.

A jig vertical movement cylinder 141 for vertically moving the jig support member 137 or the forming jig 136 is mounted to a bottom face of the second slide member 135. A rod of the jig vertical movement cylinder 141 is provided to vertically penetrate the second slide member 135, and a tip end of the rod is linked with a bottom face of the jig support member 137. Therefore, the jig support member 137 can move vertically along the guide shaft 139 if the jig vertical movement cylinder 141 is driven to move the rod forward/backward.

A side end part of the second cylinder 124 of the second slide member 135 is linked with a rod of the second cylinder 124 so that the second slide member 135 can move in a horizontal direction along the guide shaft 125, if the second cylinder 124 is driven to move the rod forward/backward. Therefore, the forming jig 136 can move horizontally and vertically.

The linked coil formation device 120 of the second embodiment, as described previously, allows the first and second forming units 121 and 145 to be provided in the linked coil formation device 20 of the first embodiment, and other structures are identical to those of the first embodiment. Therefore, like constituent elements and structures of the first embodiment are designated by like reference numerals.

Next, an operation of forming the lead parts 11A (12A) by means of the first forming unit 121 constructed as described hereinbefore will be described referring to FIG. 35(A) to FIG. 35(D). As shown in FIG. 35(A), when the wire of a length corresponding to one edge of the first coil part 11 and a length of the lead part 11A, at one end part of the flat wire W, are fed to an origin position, namely at a forming position at which the lead part 11A is to be bent, the forming jig 136 is on standby at its initial position. At this time, the clamper 129 is on standby at a position spaced at a predetermined distance from the forming jig 136, and is established in a state in which the upper clamper 129B rises and is spaced from the lower clamper 129A.

In this state or subsequent, as shown in FIG. 35(B), the clamper 129 advances in the direction indicated by the arrow P1 by driving the first cylinder 123, and at the same time, the upper clamper 129B is lowered in the direction indicated by the arrow Q1 by driving the clamper movement cylinder 130, and one edge part of the first coil part 11 of the flat wire W is gripped in conjunction with the lower clamper 129A. Afterwards, as shown in FIG. 35(C), the forming jig 136 is adapted to rise in the direction indicated by the arrow Q2, by driving the jig vertical movement cylinder 141, and the lead part 11A is pushed up with one edge part being sandwiched between the upper and lower clampers 129B and 129A.

Next, as shown in FIG. 35(D), the forming jig 136 is advanced in the direction indicated by the arrow P2 by driving the second cylinder 124, and the lead part 11A is then pushed and bent against the inclined face 129C of the upper clamper 129B. This inclination is adapted to allow for return of the lead part 11A due to a spring-back action when the forming jig 136 returned to its original position with the jig being released from being pushed against the inclined face. In this manner, the lead part 11A of the first coil part 11 is allowed to be erected from the top face of the first coil part 11. That is, the lead part 11A can be bent from a surface of the flat wire Win the direction that is substantially orthogonal to the surface. After the lead part 11A has been bent, the forming jig 136 is returned to its initial position and the clamper 129 is also returned to its origin position, owing to the movement reversed from the aforementioned movement. The upper clamper 129B is actuated so as to be on standby in an opened state relative to the lower clamper 129A.

Forming of the lead part 11A, as described above, is performed prior to forming the first coil part 11. That is, as shown in FIG. 36(A) to FIG. 36(C) through FIG. 37(D) to FIG. 37(F), the above forming of the lead part 11A is performed after the first winding processing, namely 90-degree bending processing, has been implemented for one side and the other side end part of the flat wire W. The reason why the above forming is also effected after the first winding processing is that, if the forming is performed in the case where the forming position is close to a first bending corner, it is possible to avoid the first winding processing from being disabled by the lead part 11A erected at an angle of 90 degrees interfering with the winding jig 33B.

First, as shown in FIG. 36(A), in the forward direction of the fixing jig 33A and winding jig 33B, of the first winding head 32, after a tip end part W1 of a length obtained by summing a length of a winding start lead part 11A (12A) and a length corresponding to one edge of the first coil part 11 has been fed out in the direction indicated by the arrow U1, the winding jig 33B is turned at an angle of 90 degrees in the direction indicated by the arrow R relative to the fixing jig 33A, and the tip end part W1 is then bent, as shown in FIG. 36(B).

Next, as shown in FIG. 36(C), the flat wire W is fed out in the direction indicated by the arrow U1 up to the forming position in order to form the lead part 11A (12A) of the bent tip end part W1. Afterwards, as shown in FIG. 37(D) and FIG. 37 (D1), the lead part 11A (12A) is bent in the direction that is substantially orthogonal to the surface of the flat wire W by the forming jig 136. Next, as shown in FIG. 37(E), the flat wire W is returned in the direction indicated by the arrow U2 up to a position between the fixing jig 33A and the winding jig 33B, for performing the second bending processing, in order to start winding processing of the first coil part 11 from the forming position; and as shown in FIG. 37(F), ordinary winding processing is started.

In this manner, in the first line 25, when the first coil part 11 is formed by means of the first winding head 32, winding is performed while the lead part 11A of the first coil part 11 is bent at an angle of 90 degrees upward in the direction orthogonal to the surface of the flat wire W.

When the second coil part 12 is formed at the other end part of the flat wire W of which the first coil part 11 is formed at one end part as well, the other end part is fed out up to the second forming unit 145 disposed at a tip side in the feed direction of the flat wire W of the second winding head 82; and the lead part 12A of the second coil part 12 is bent by means of action of the forming jig 136 or the like of the second forming unit 145, as described previously. Afterwards, the bent lead part is returned to the second winding head 82 as described previously; and winding processing of the second coil part 12 is started with the lead part 12A being bent.

According to the second embodiment as described above, in addition to the effects (1) to (5) or similar, the following effects are attained.

(6) A lead part 11A of a first coil part 11 and a lead part 12A of a second coil part 12 are bent to be erected in the direction that is substantially orthogonal to a flat face of a flat wire W, respectively, by means of a first forming unit 121 and a second forming unit 145 before winding processing of each of the coil parts 11, 12 is started, and in this state, winding processing is started. Therefore, even in the case of the final winding after advancement of the second coil part 12, the respective lead parts 11A, 12A do not interfere with the first and second coil parts 11 and 12, and a linked coil 10 with high winding precision can be thereby formed.

(7) The lead part 11A of the first coil part 11 and the lead part 12A of the second coil part 12 are allowed to be automatically bent, respectively, by the first forming unit 121 and the second forming unit 145, so that the linked coil 10 can be continuously formed more efficiently.

The present invention is not limitative to the embodiments described hereinbefore, and various alterations, modifications and the like to such an extent that the object of the present invention can be achieved are included in the present invention. For example, while, in the embodiments, a flat wire W was employed as a coil material, and a first coil part 11 and a second coil part 12 were formed at one end part and the other end part, of the flat wire W, respectively, the present invention is not limitative thereto. A wire rod such as a round rod may be employed as a coil material.

In addition, while, in the second embodiment, a tip end part W1 of a length obtained by summing a length of a winding start lead part 11A (12A) and a length corresponding to one edge of a first coil part 11 was fed out; and the lead part 11A of the first coil part 11 and the lead part 12A of the second coil part 12 was bent after being bent at an angle of 90 degrees by means of a fixing jig 33A and a winding jig 33B, the present invention is not limitative thereto. For example, after the tip end part W1 has been fed out, if the lead parts 11A, 12A are bent at a position taken along the feed direction of the tip end part, and thereafter, a length corresponding to one edge of the first coil part 11 is bent, winding processing of the first coil part 11 can be continued. As a result, the returning step subsequent to bending the lead part 11A and the second coil part 12 in the second embodiment is eliminated.

Further, while, in the foregoing, a flat wire W was adapted to be fed out by means of a head feed unit 72 after a second wire feeder 67 had been retracted, the present invention is not limitative thereto. A feed mechanism with a motor and a ball screw corresponding to the head feed unit 72 may be provided on the slide drive side of a slider main body 89, which is a mount base of a chuck part 92 for gripping the first coil part 11, so as to feed out the flat wire W via the first coil part 11 gripped by the chuck part 92 on the slider main body 89, in place of the head feed unit 72.

INDUSTRIAL APPLICABILITY

The present invention is available when forming linked coils employed as coils for rectors, for example.

BRIEF DESCRIPTION OF THE DRAWINGS

FIG. 28 It is a set of operational views each showing a state immediately preceding final winding, of the embodiment, wherein.

FIG. 29 It is a set of operational views each showing a state immediately preceding the final winding, of the embodiment, wherein.

EXPLANATION OF LETTERS OR NUMERALS

Figure 1:
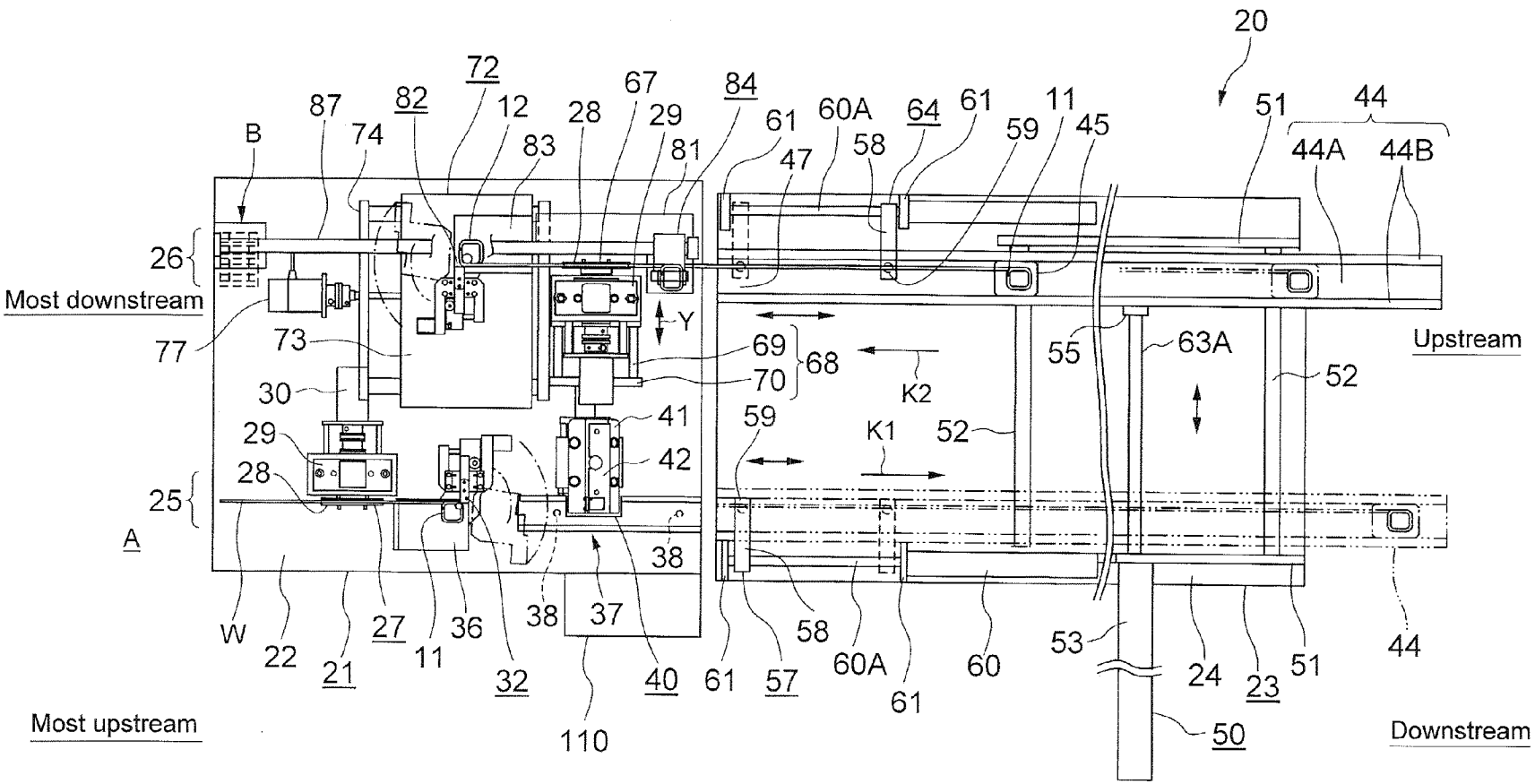
FIG. 1 It is an entire flat view showing a first embodiment of a linked coil formation device according to the present invention.
Figure 2:
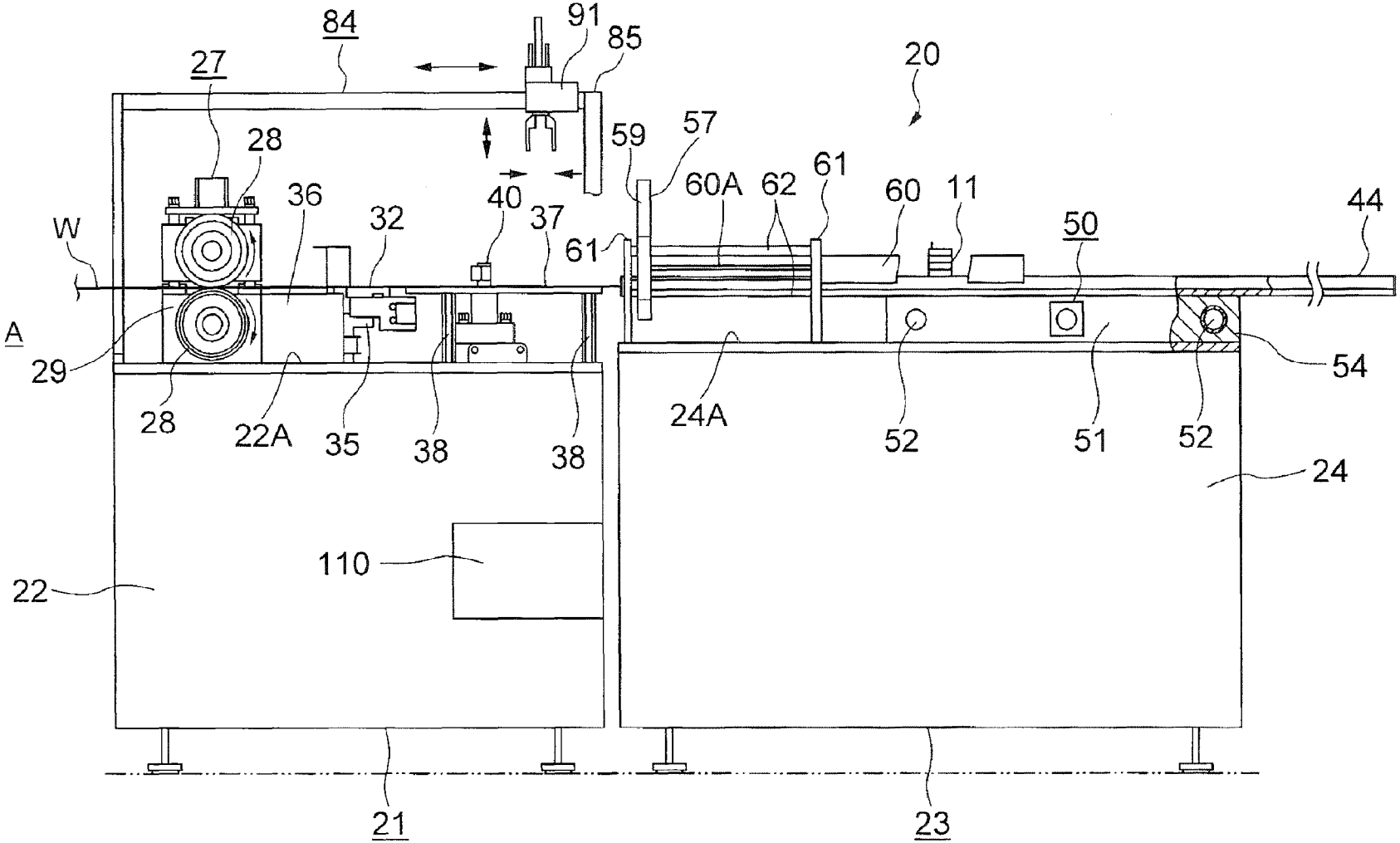
FIG. 2 It is an entire side view showing the linked coil formation device of the first embodiment.
Figure 3:
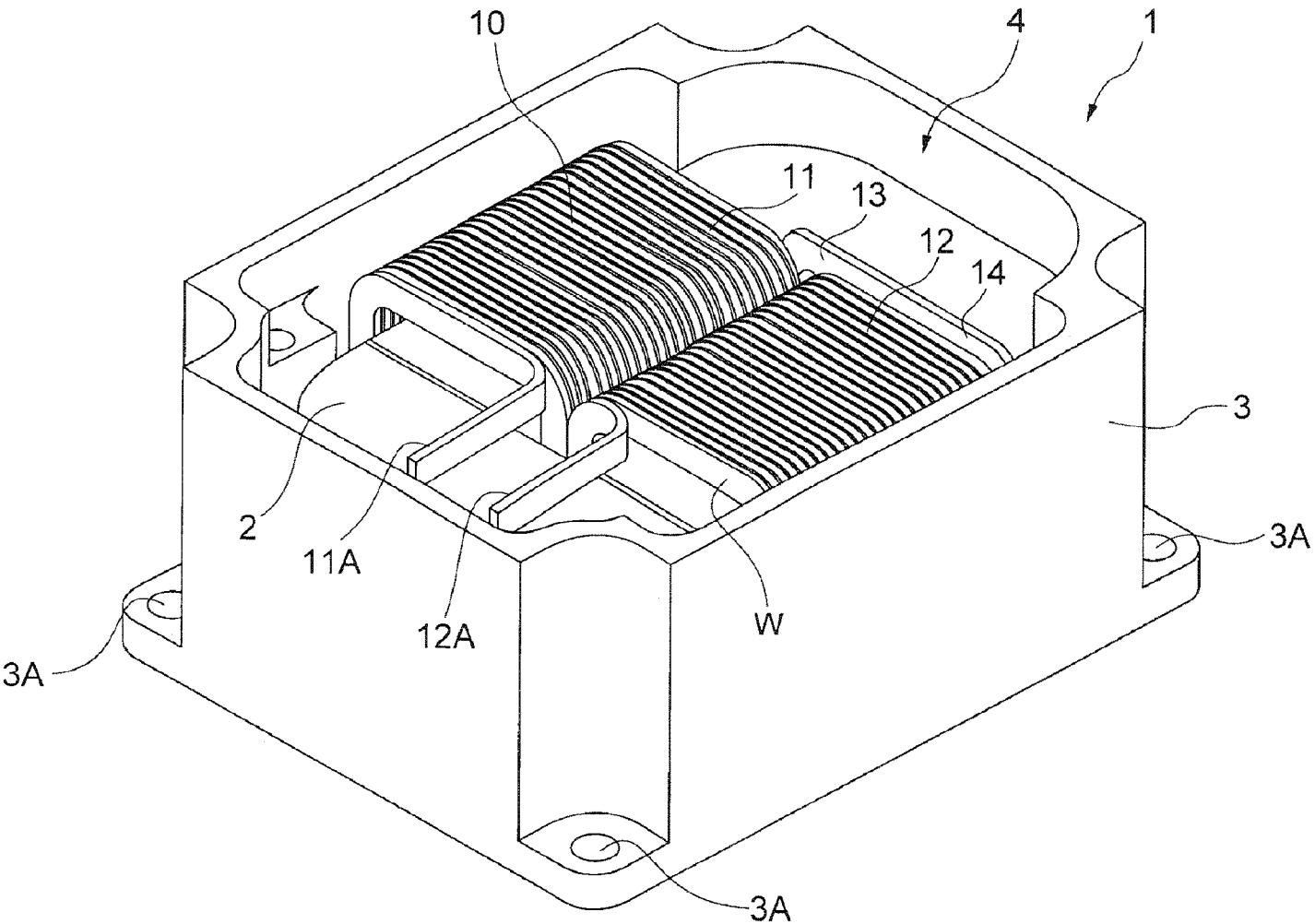
FIG. 3 It is an entire perspective view of a reactor accommodating a linked coil formed by means of the linked coil formation device according to the present invention.
Figure 4:
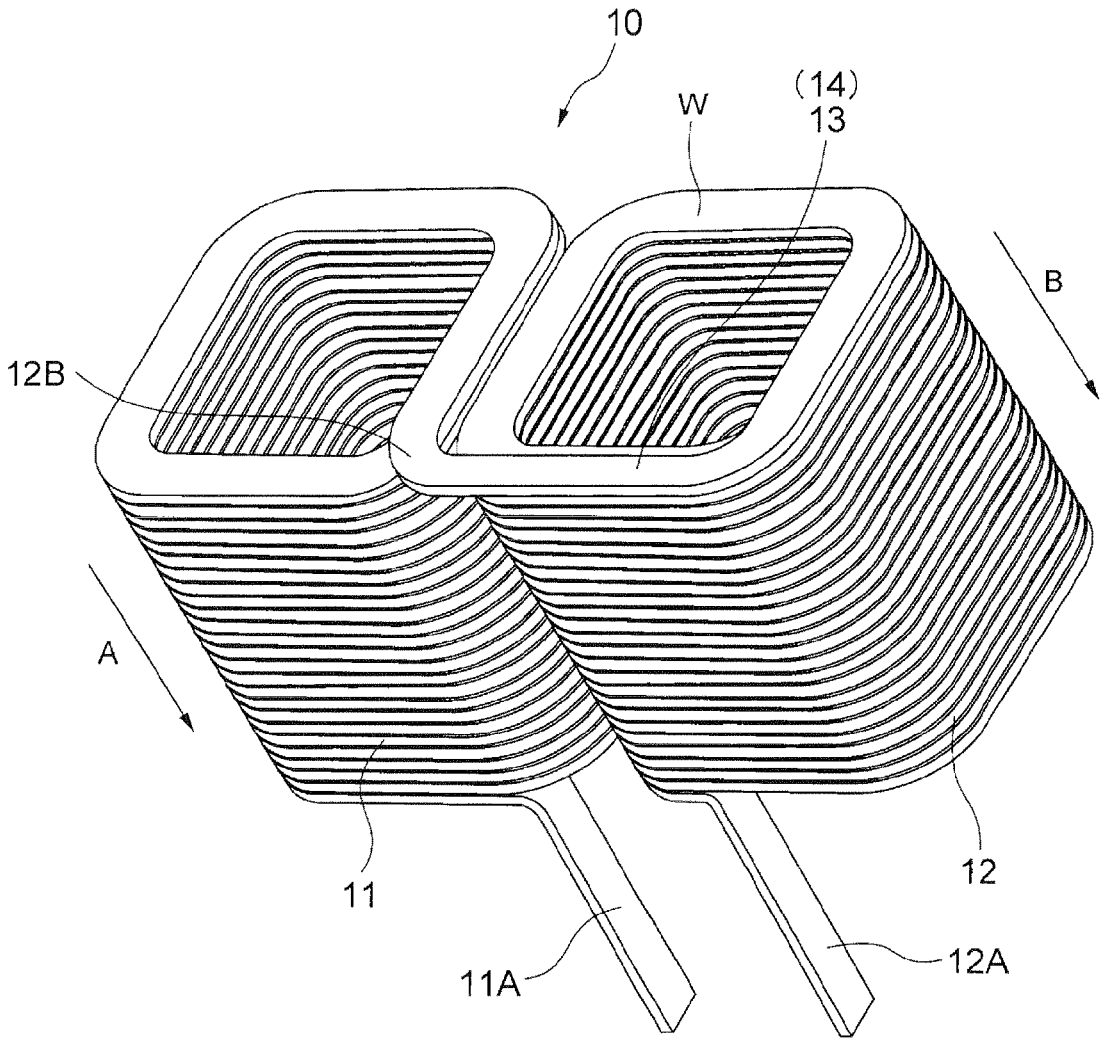
FIG. 4 It is an entire perspective view showing the linked coil formed by the linked coil formation device according to the present invention.
Figure 5:
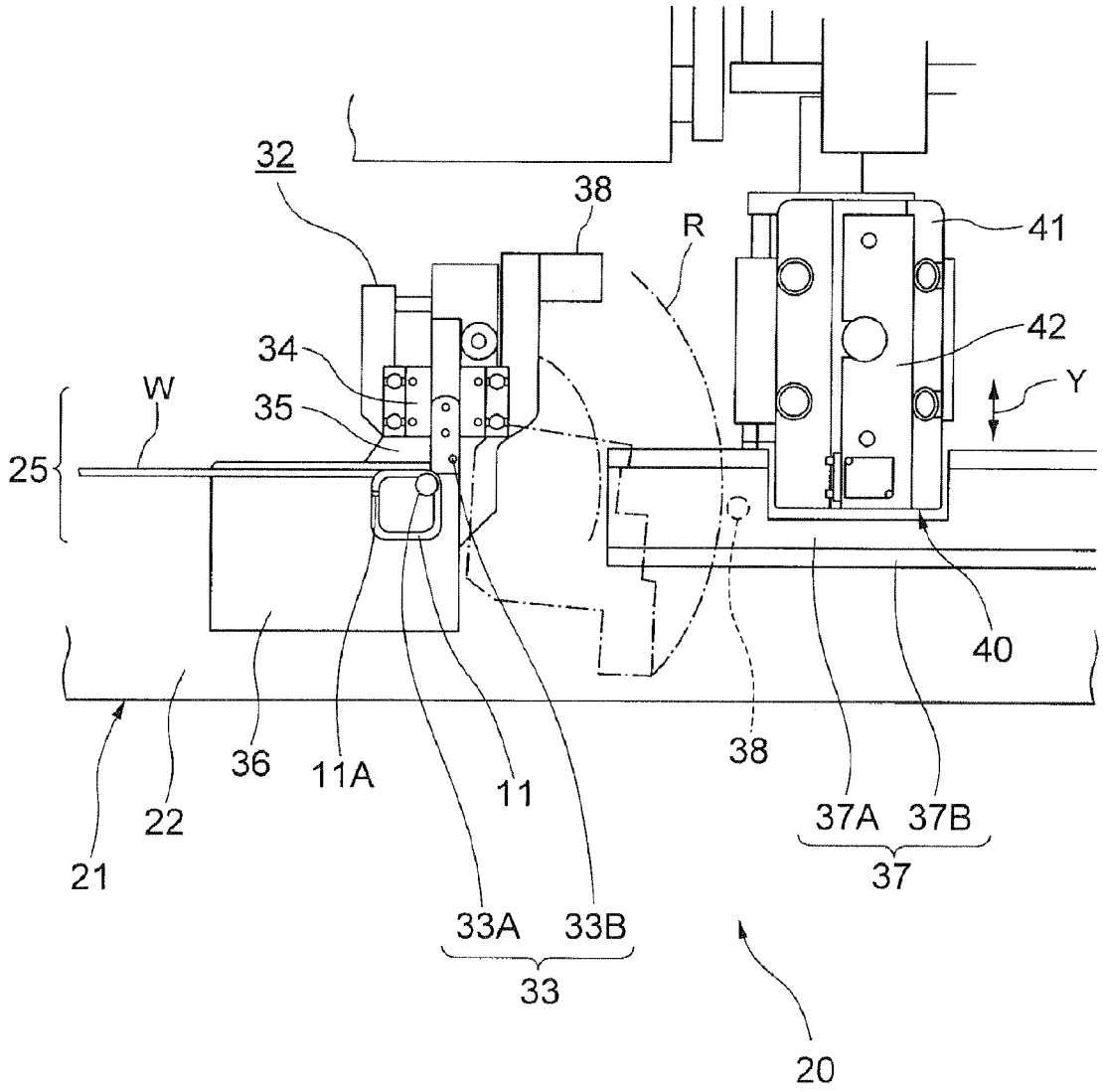
FIG. 5 It is an enlarged view showing a portion "a" of FIG. 1.
Figure 6:
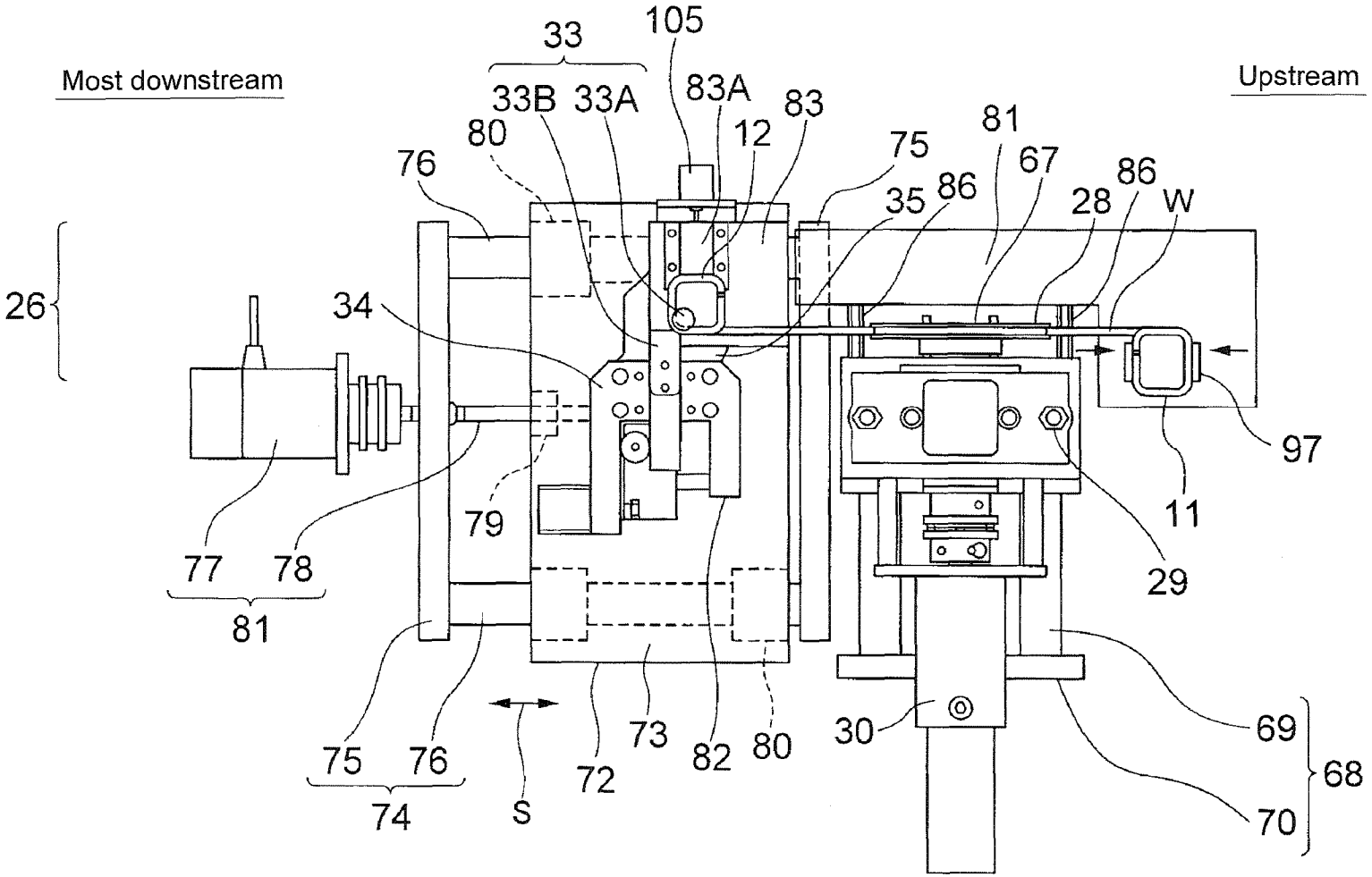
FIG. 6 It is a detailed plan view showing an initial position of a head feed unit of the linked coil formation device.
Figure 7:
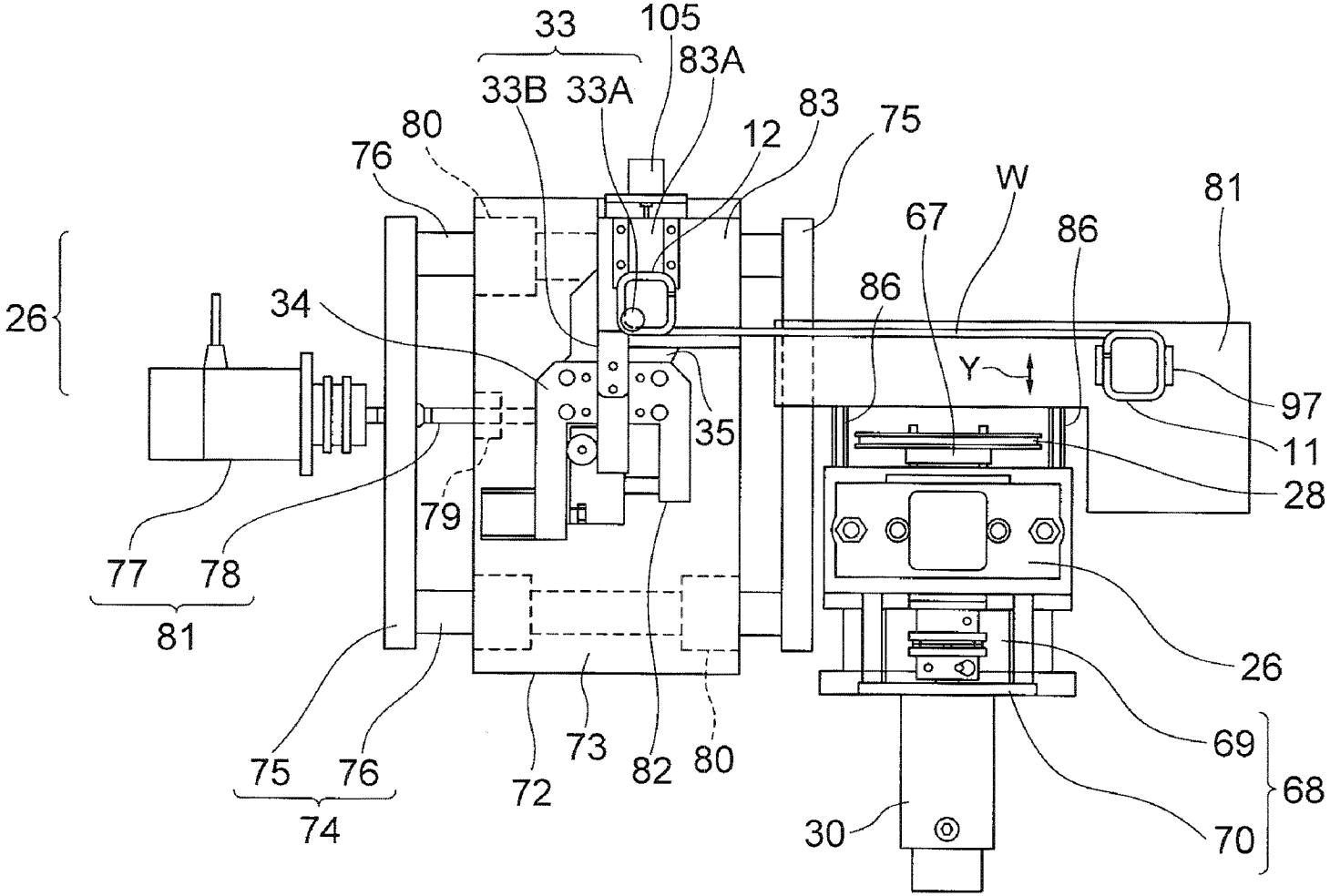
FIG. 7 It is a detailed plan view showing a state in which the head feed unit of the linked coil formation device has moved.
Figure 8:
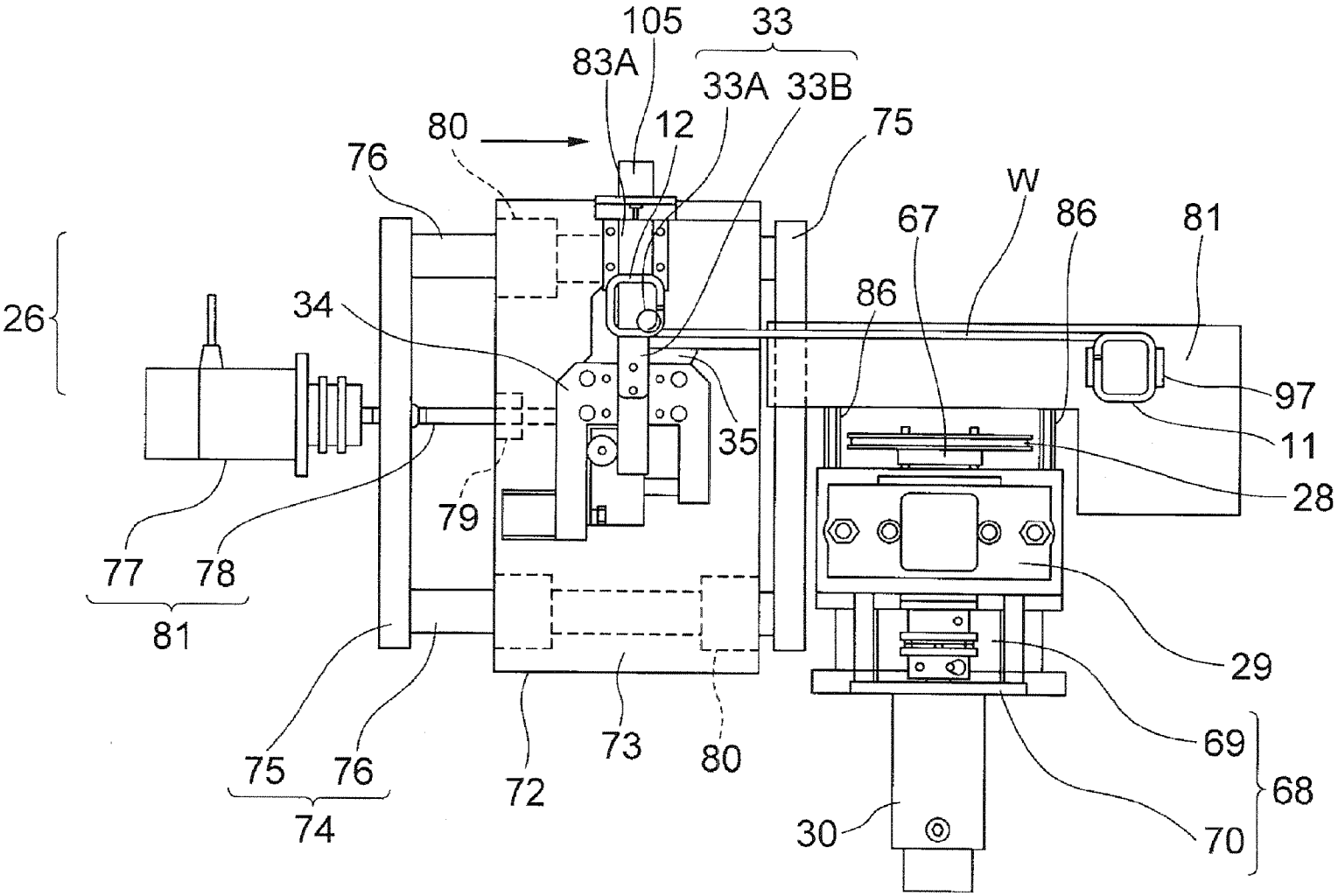
FIG. 8 It is a detailed plan view showing a state in which the head feed unit of the linked coil formation device has returned to its initial position.
Figure 9:
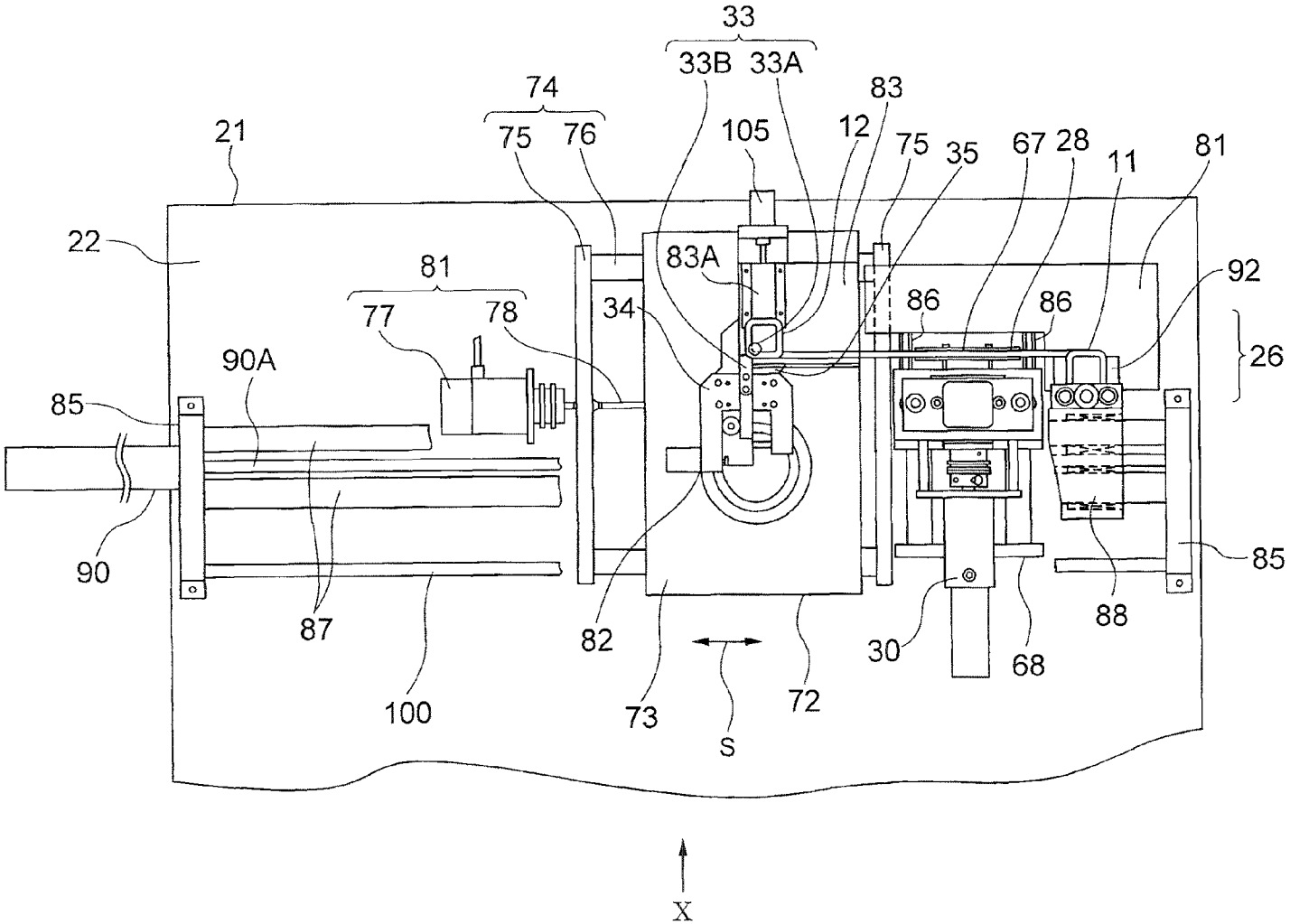
FIG. 9 It is a plan view showing members on a second line of a winder base of the linked coil formation device.
Figure 10:
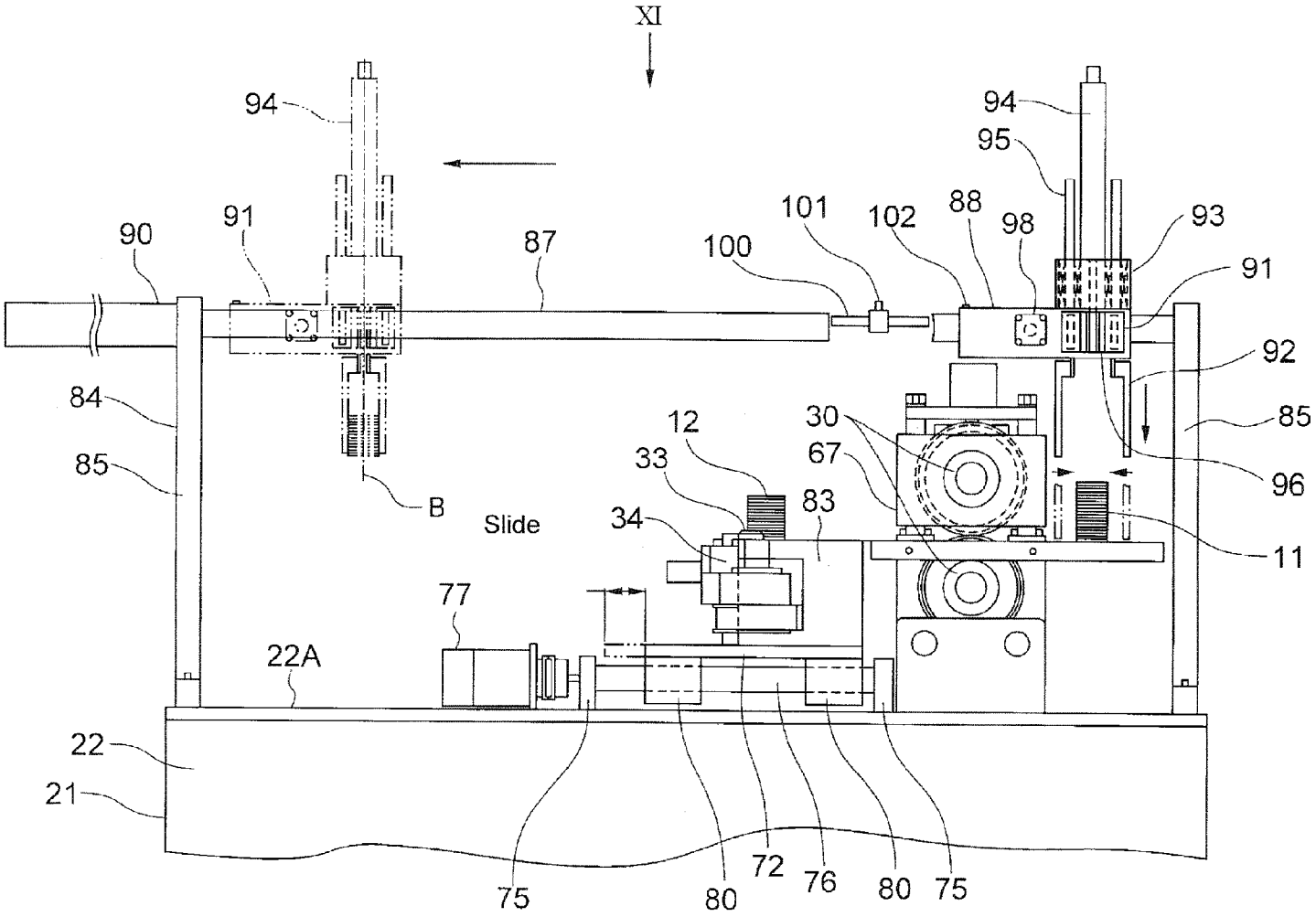
FIG. 10 It is a view indicated by the arrow X in FIG. 9.
Figure 11:
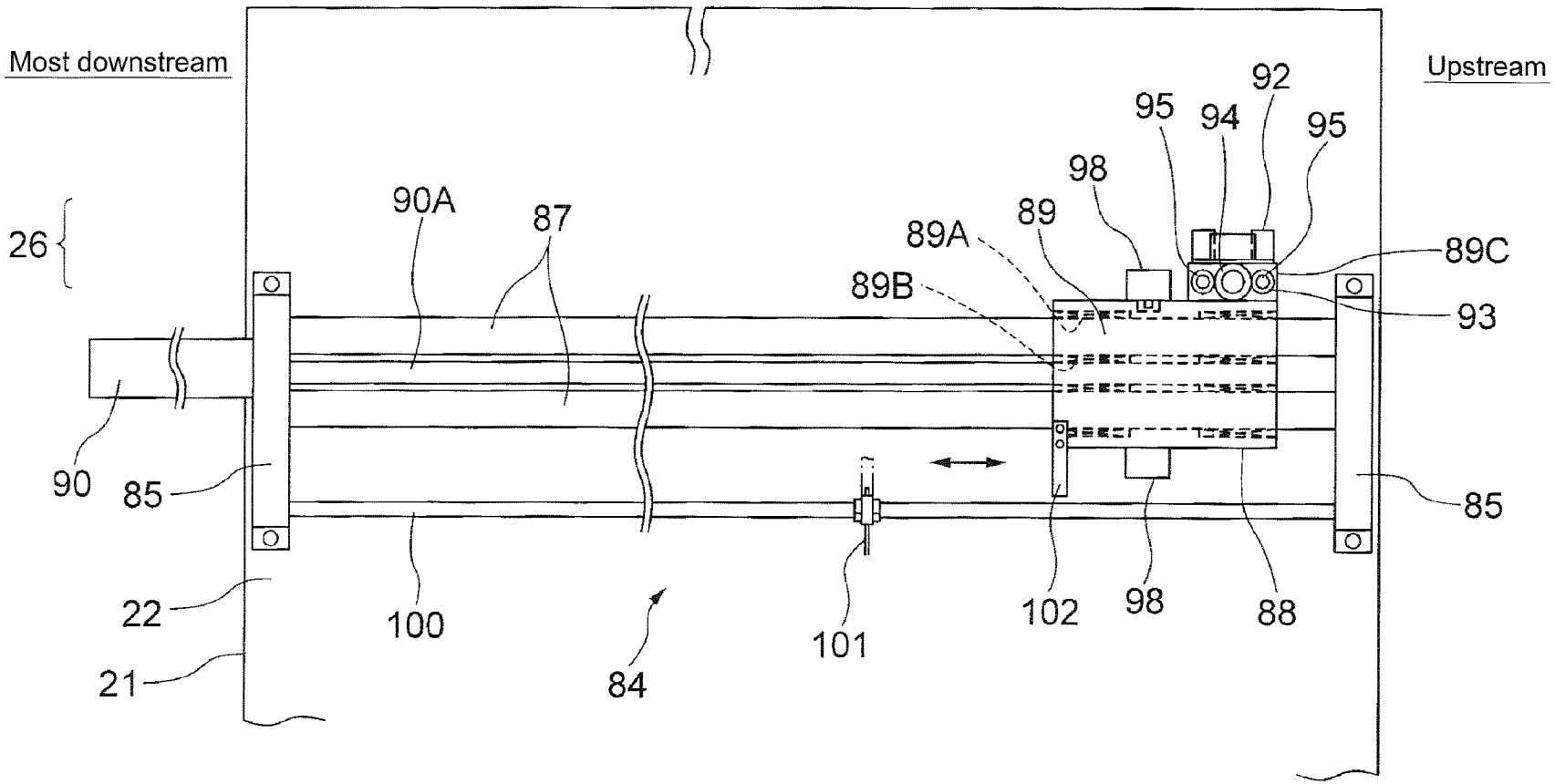
FIG. 11 It is a plan view showing only a coil take-out unit in the view indicated by the arrow XI of FIG. 10.
Figure 12:
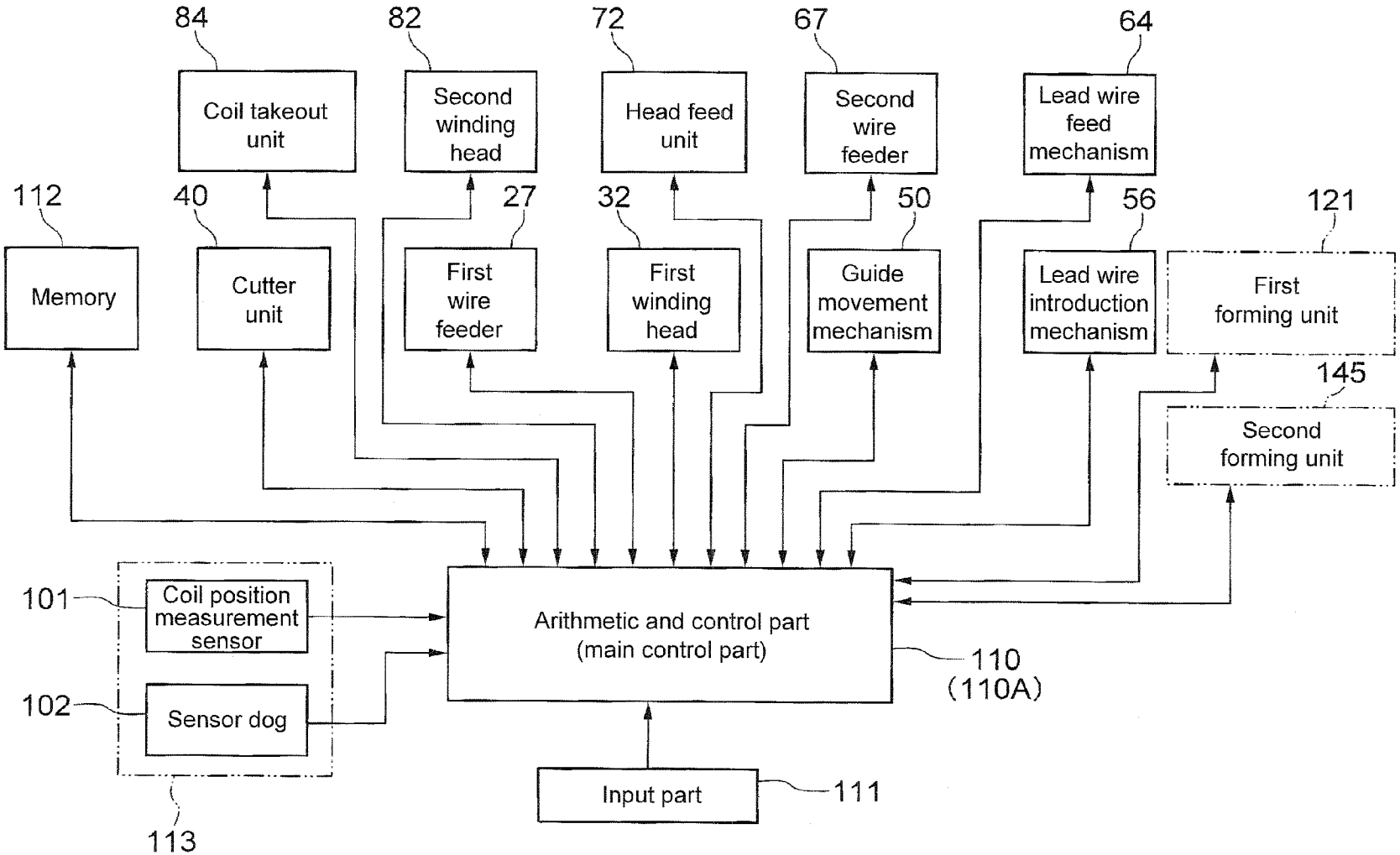
FIG. 12 It is a schematic view showing an arithmetic and control part of the embodiment.
Figure 13:
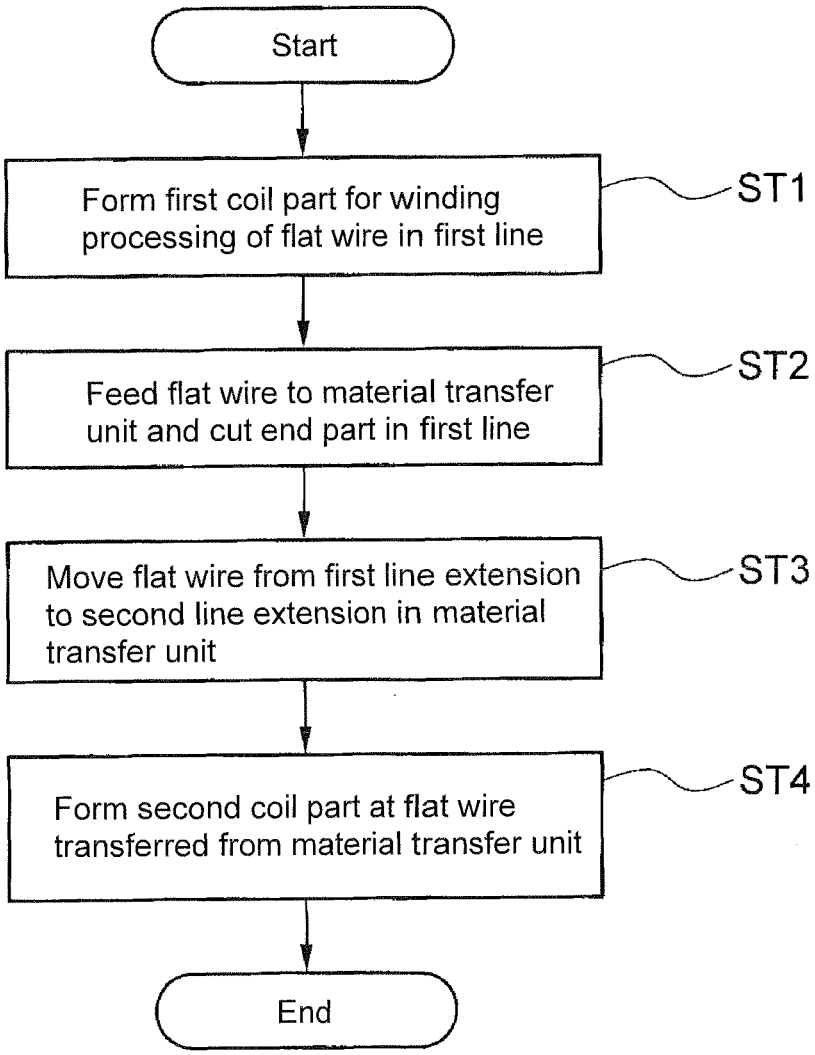
FIG. 13 It is a flowchart of a method of forming linked coils, of the embodiment.
Figure 14:
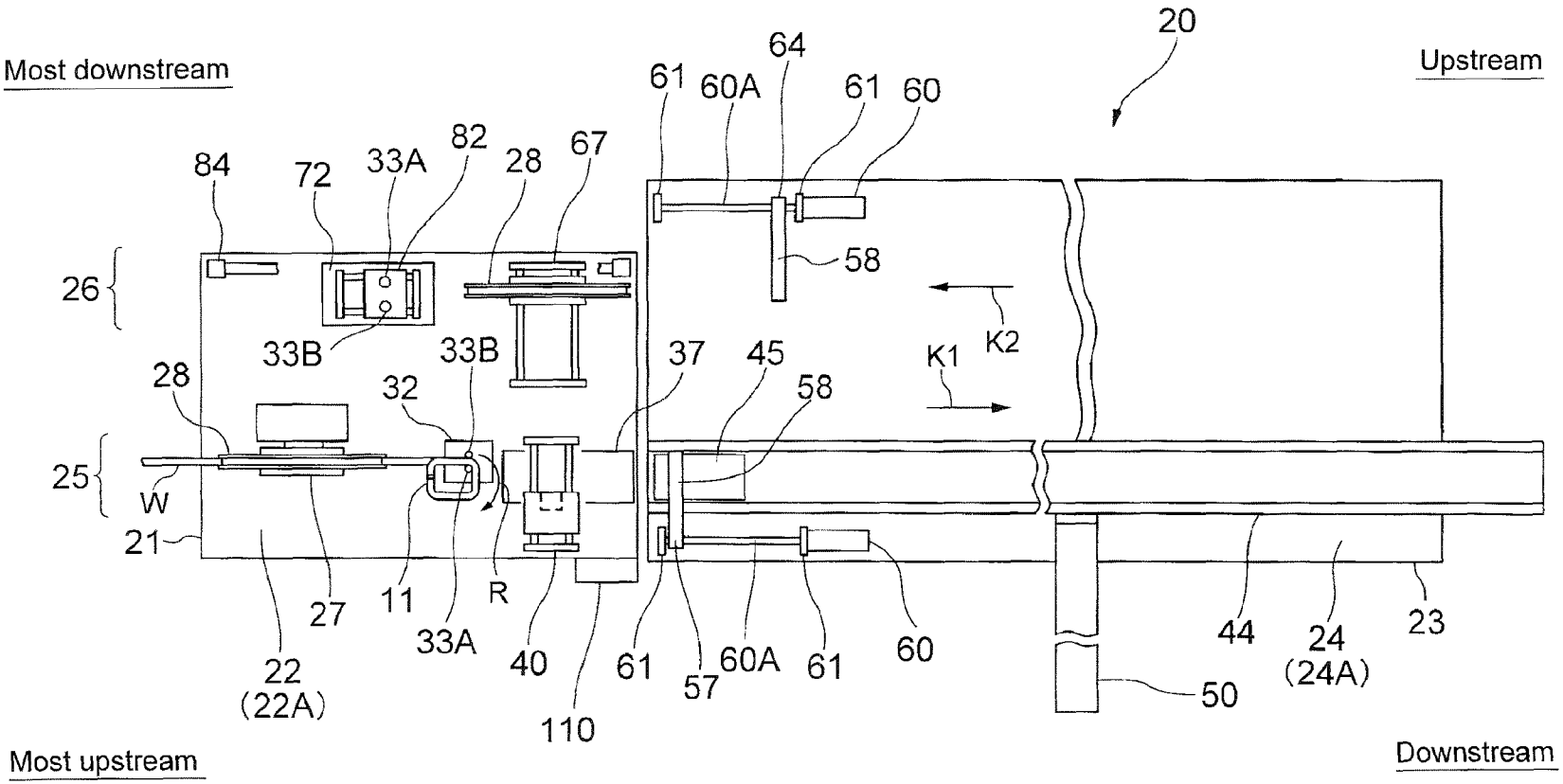
FIG. 14 It is a view showing a first step of the method of forming linked coils in the embodiment.
Figure 15:
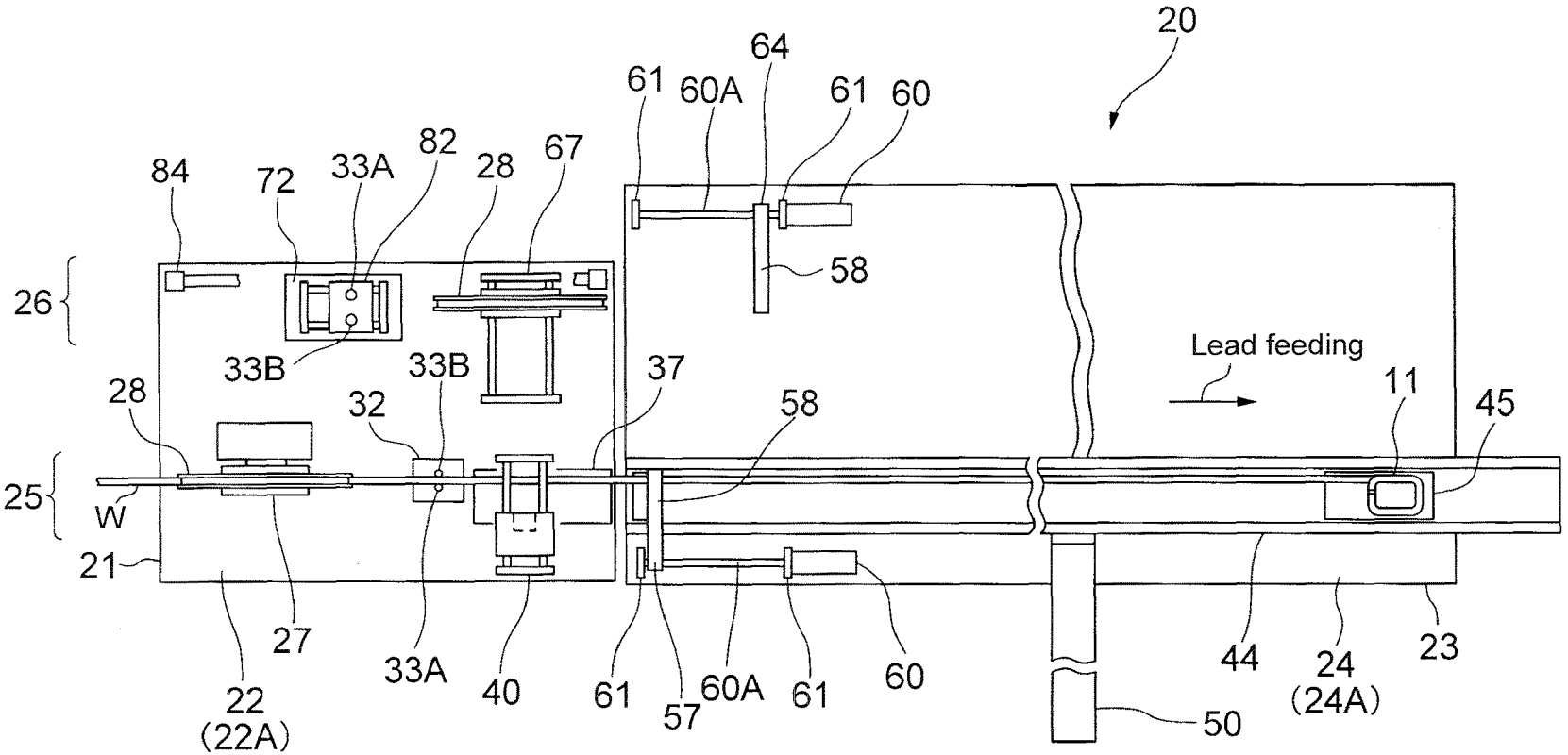
FIG. 15 It is a view showing a second step of the method of forming linked coils, in the embodiment.
Figure 16:
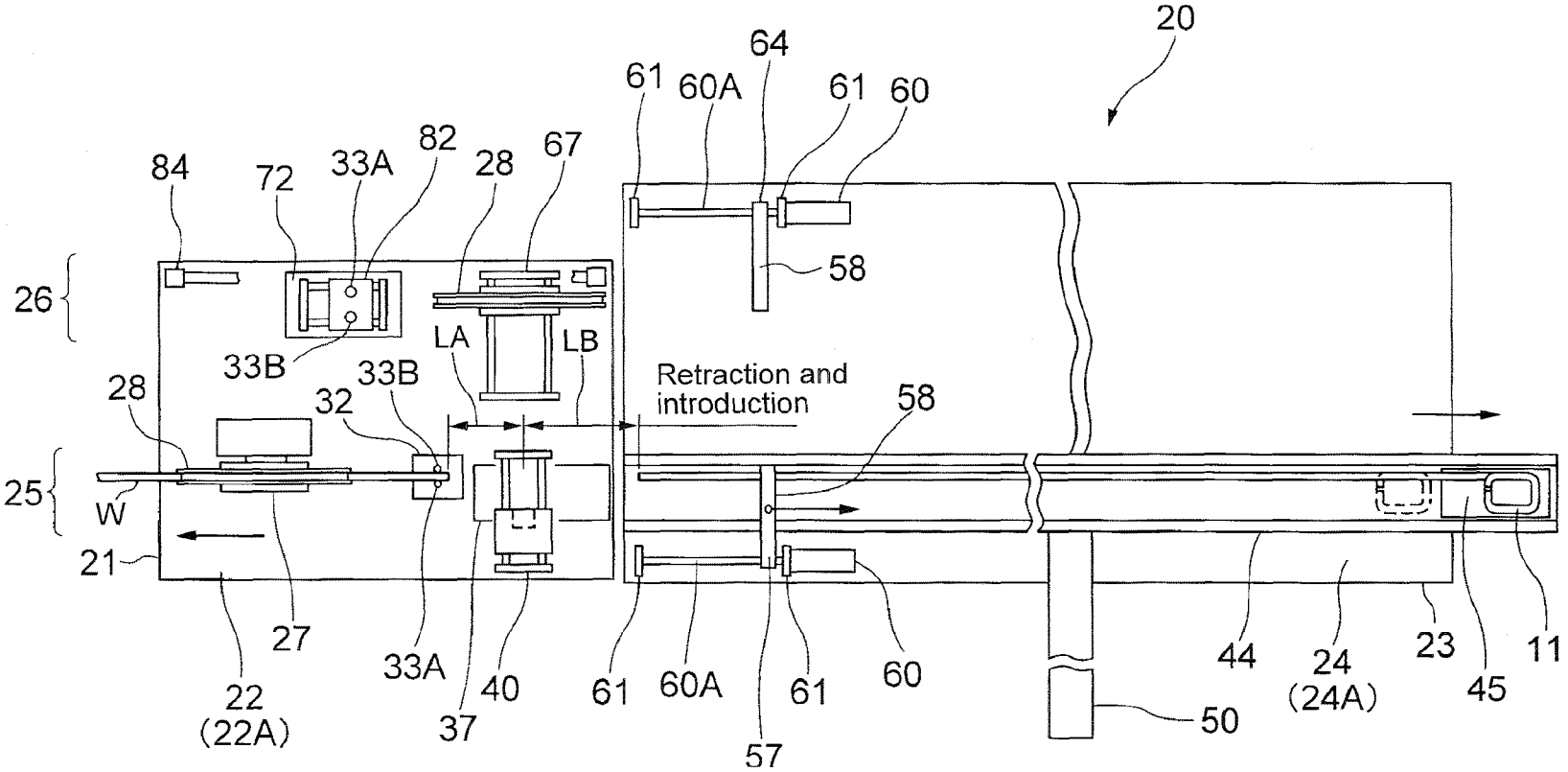
FIG. 16 It is a view showing the second step of the method of forming linked coils in the embodiment.
Figure 17:
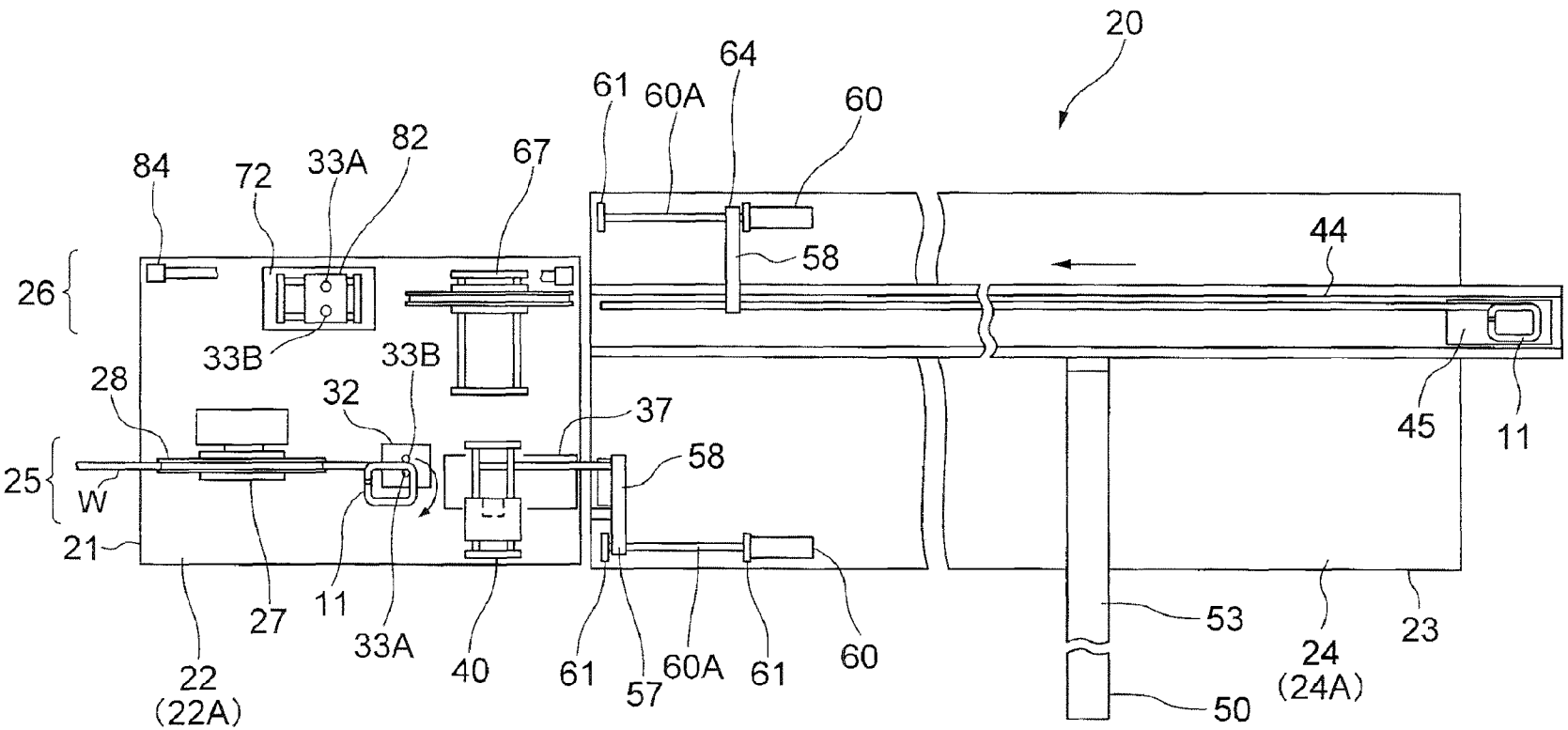
FIG. 17 It is a view showing a third step of the method of forming linked coils in the embodiment.
Figure 18:
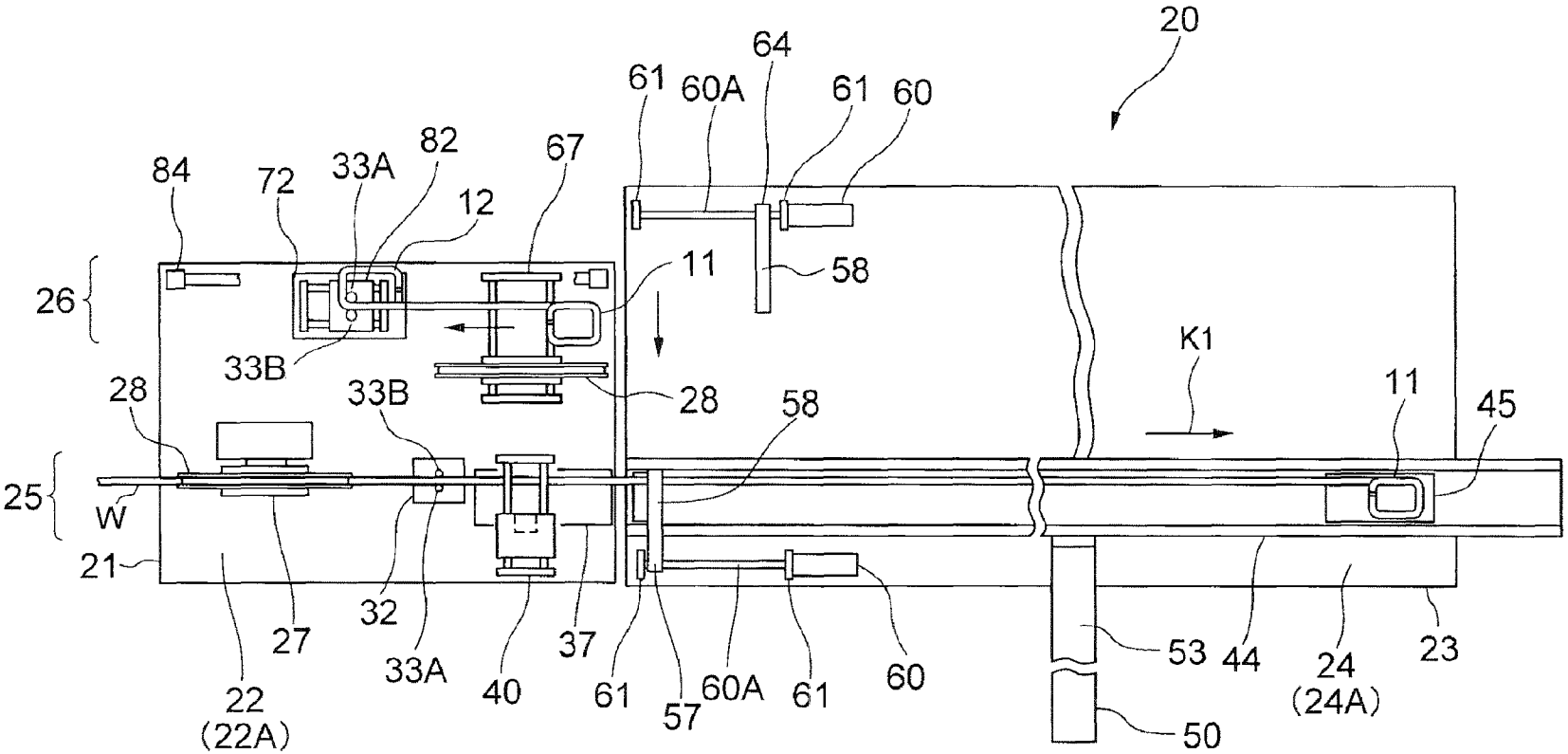
FIG. 18 It is a view showing a fourth step of the method of forming linked coils in the embodiment.
Figure 19:
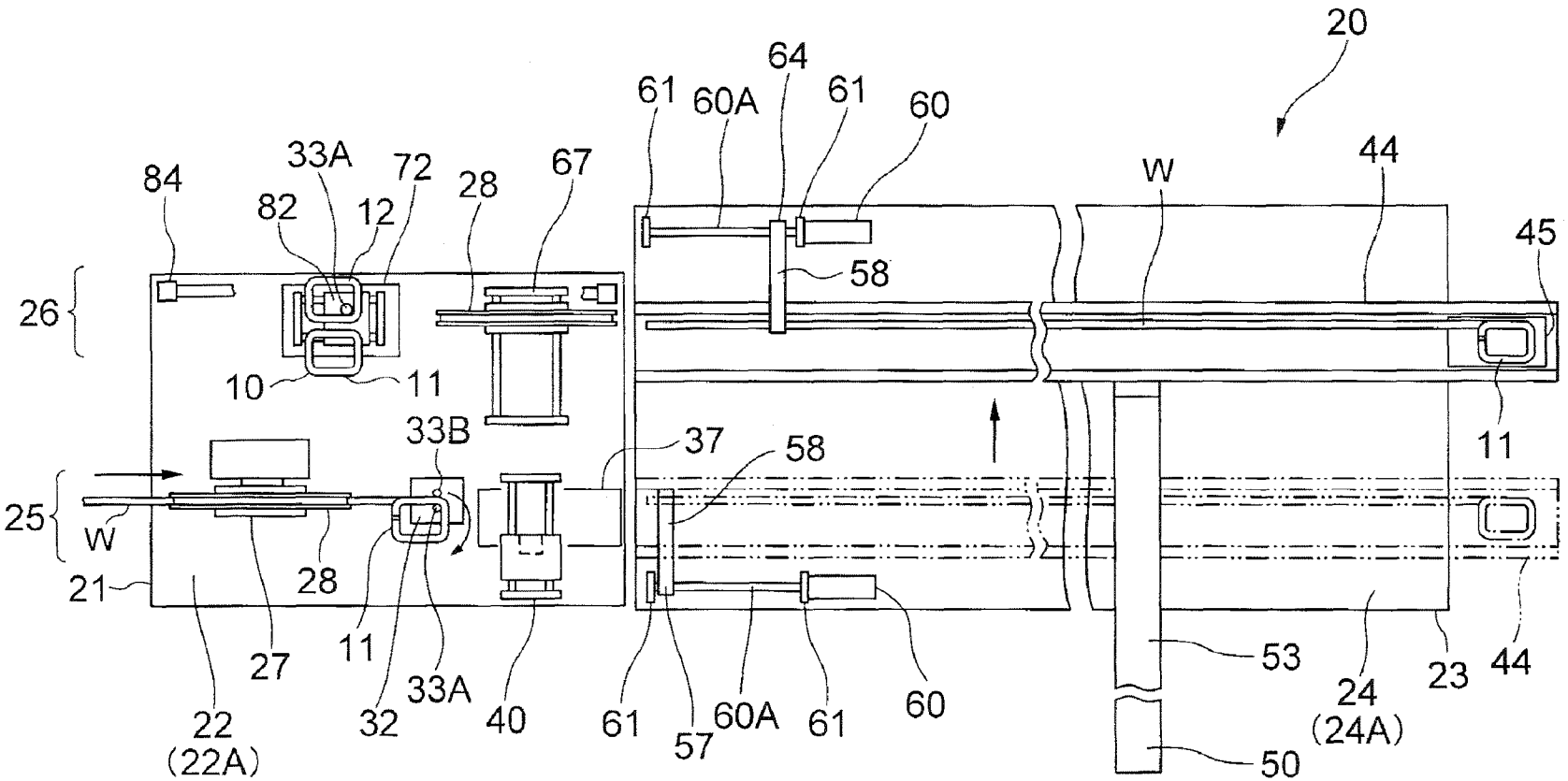
FIG. 19 It is a view showing the fourth step of the method of forming linked coils in the embodiment.
Figure 20:
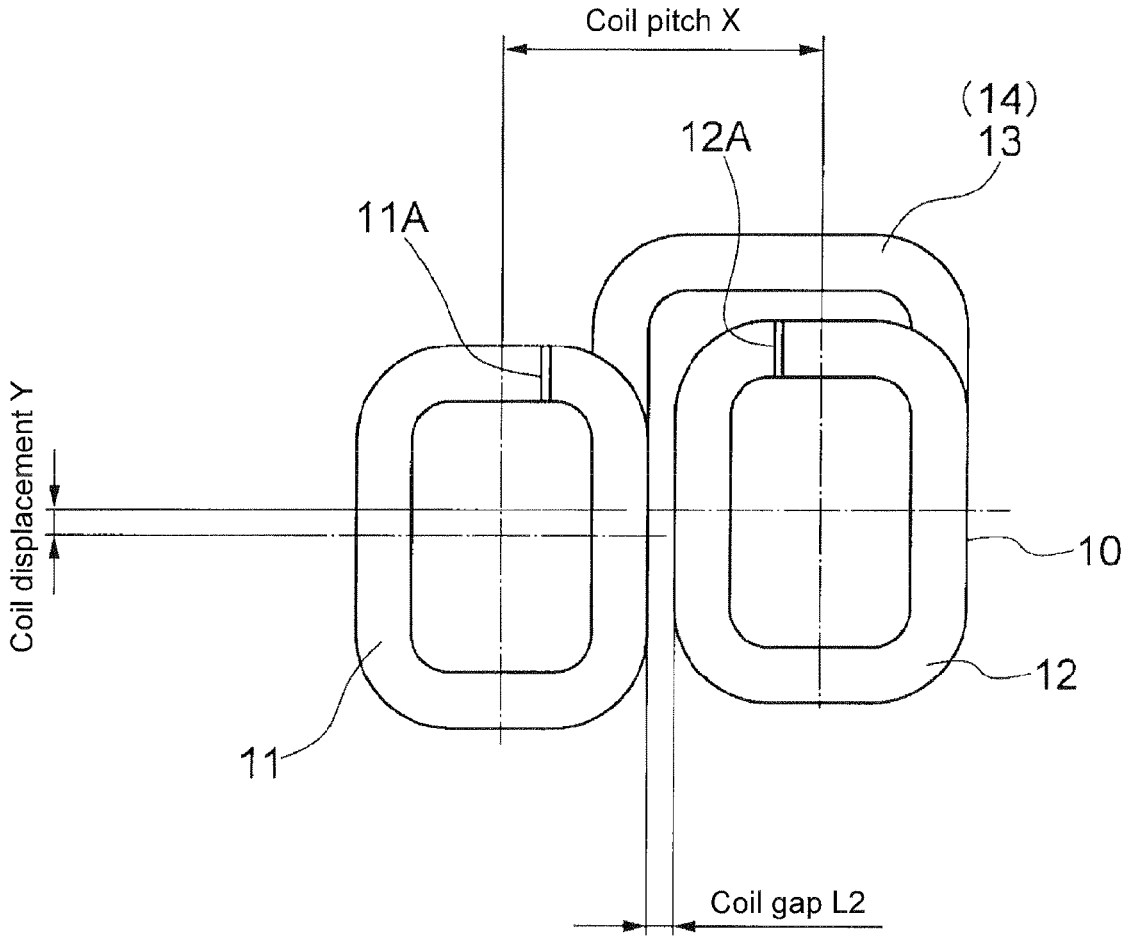
FIG. 20 It is a plan view showing a relative positional relationship between a first coil part and a second coil part, of the embodiment.
Figure 21:
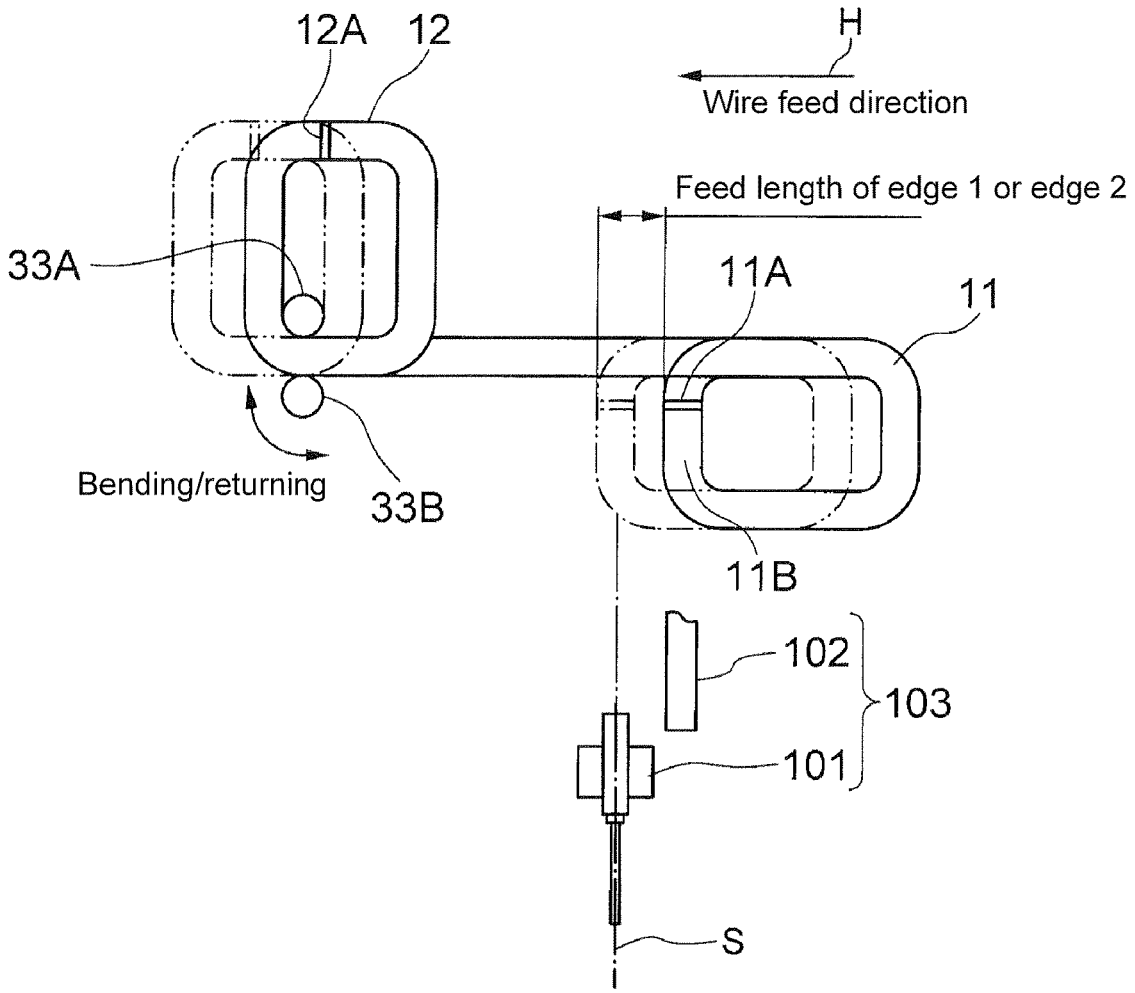
FIG. 21 It is a view showing a coil position measurement method of the embodiment.
Figure 22:
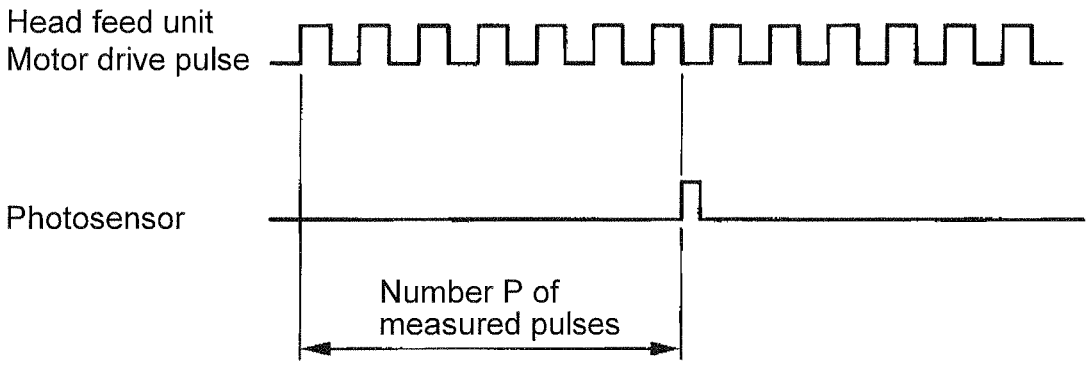
FIG. 22 It is a view showing a waveform of measured pulses of the embodiment.
Figure 23B:
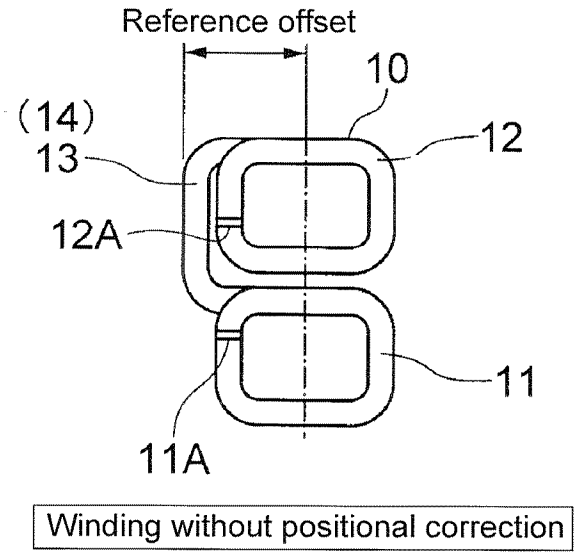
FIG. 23 It is a view showing a case in which an inter-coil lead is a reference length as a result of coil position measurement of the embodiment.
Figure 23A:
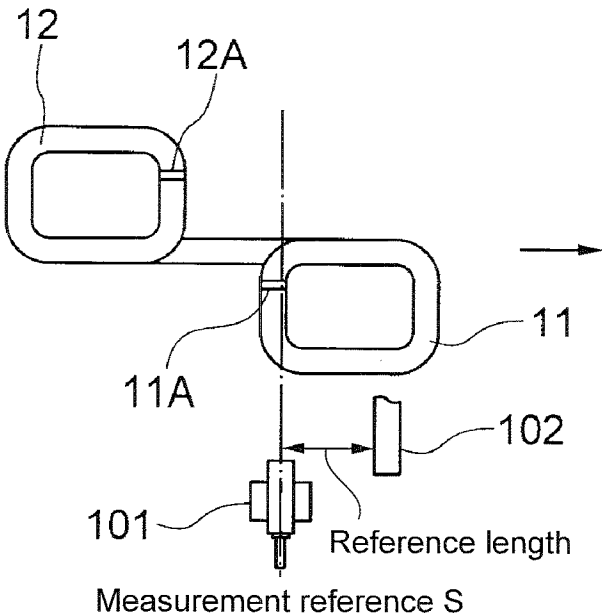
Figure 24A:
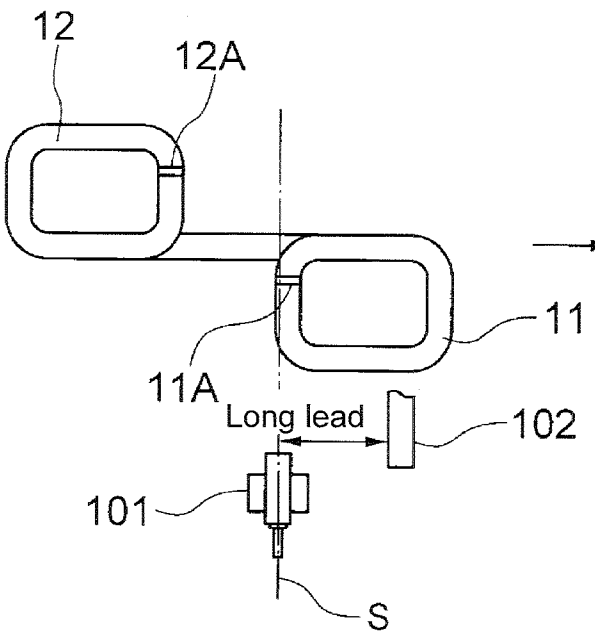
FIG. 24 It is a view showing a case in which the inter-coil lead is long as the result of coil position measurement of the embodiment.
Figure 24B:
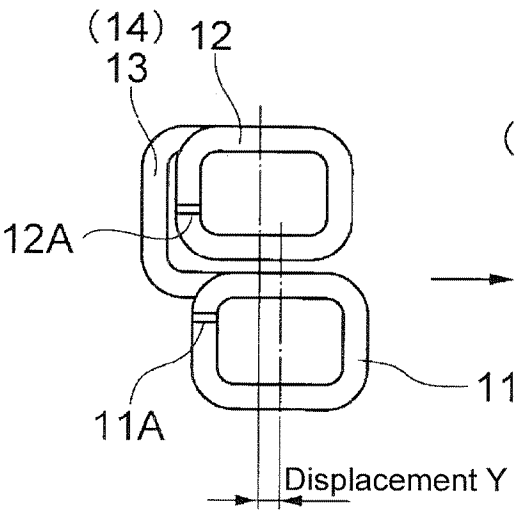
Figure 24C:
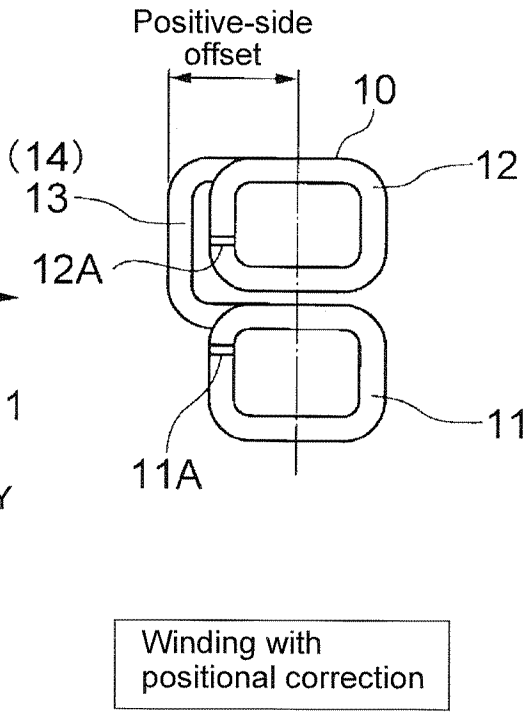
Figure 25A:
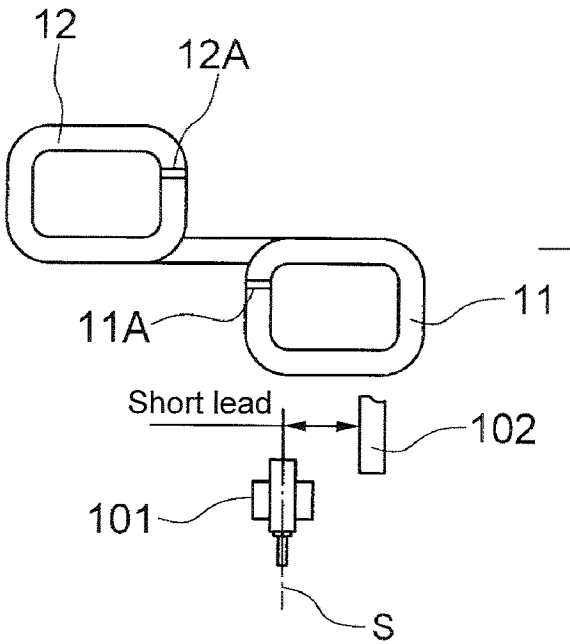
FIG. 25 It is a view showing a case in which the inter-coil lead is short as the result of coil position measurement of the embodiment.
Figure 25B:
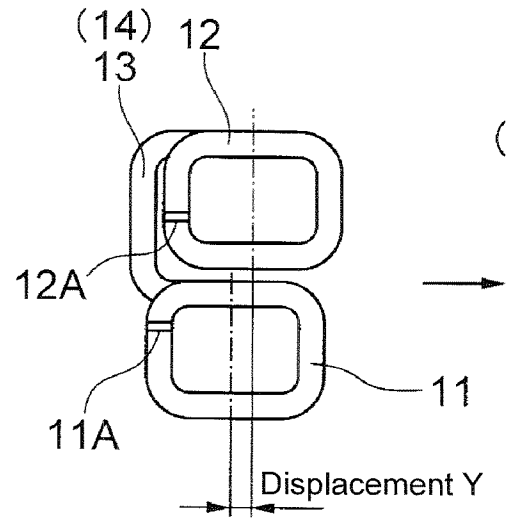
Figure 25C:
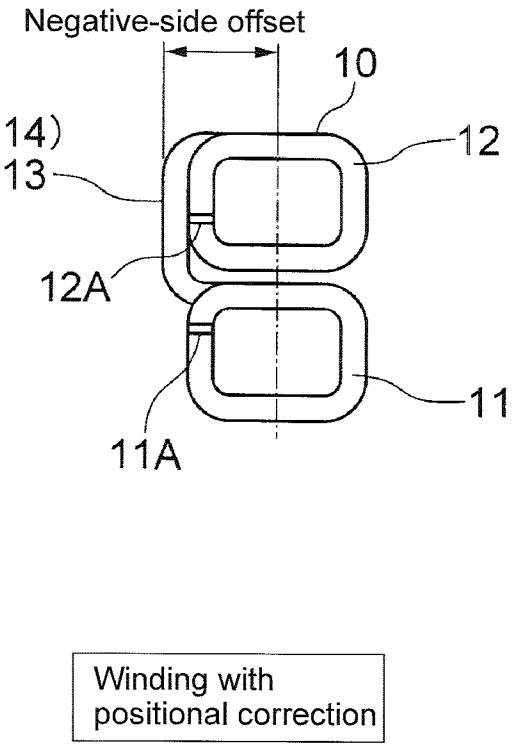
Figures 26A, 26B:
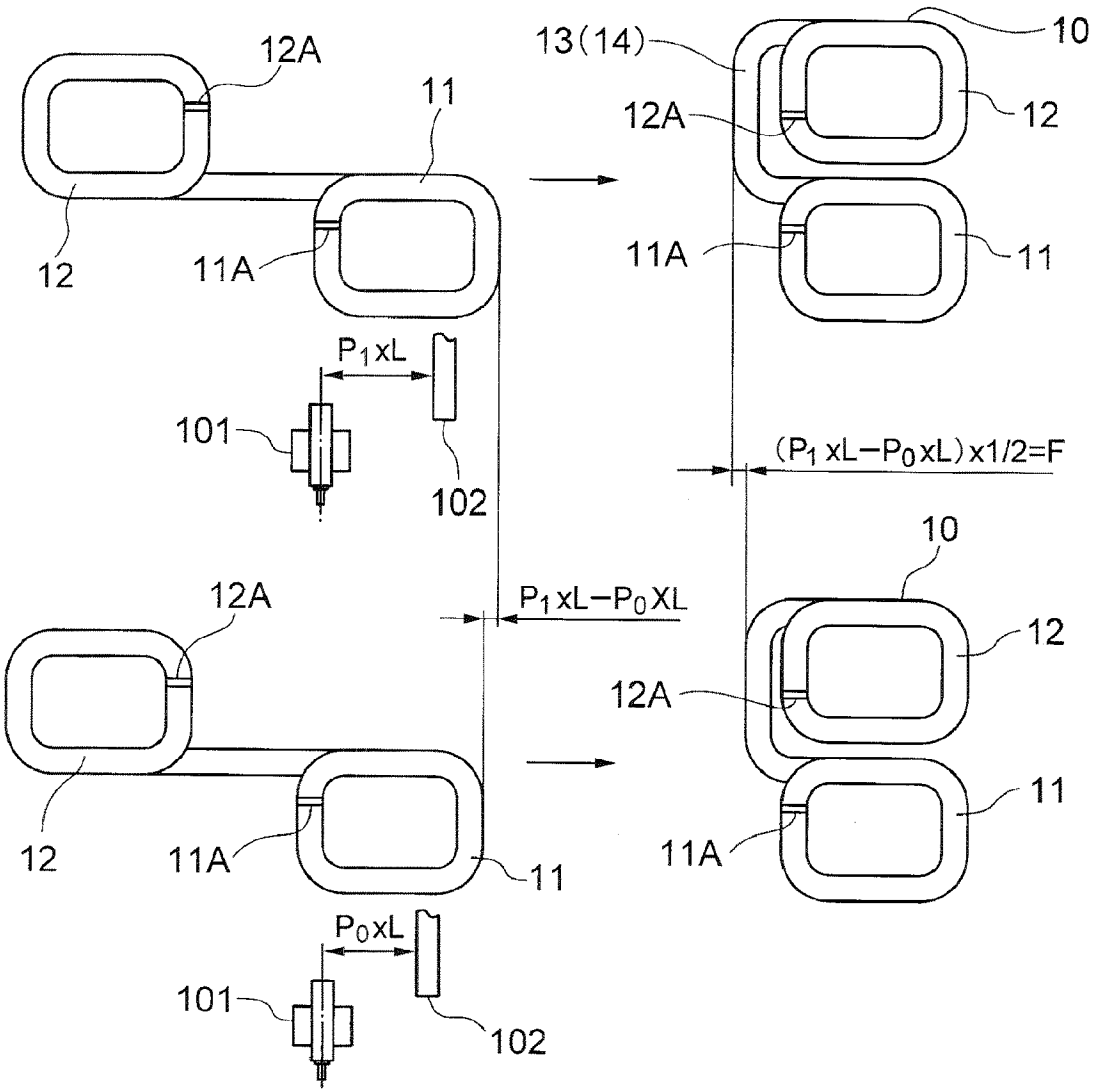
FIG. 26 It is an explanatory view showing a method of obtaining correction dimensions of the coil of the embodiment.
Figure 27A:
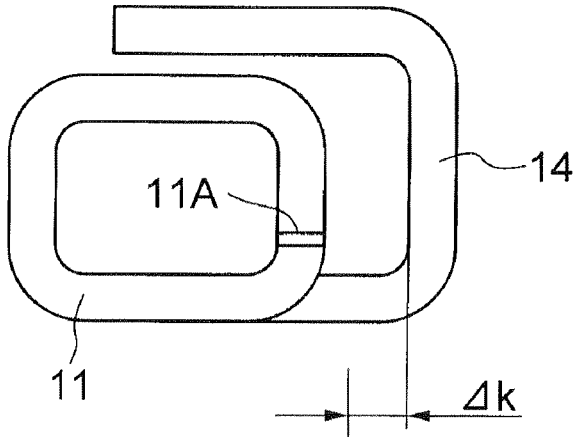
FIG. 27 It is an explanatory view showing that correction values are different from each other depending upon two coils of the embodiment.
Figure 27B:
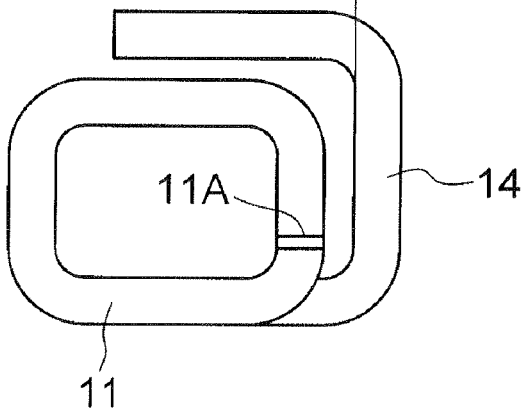
Figure 28A:
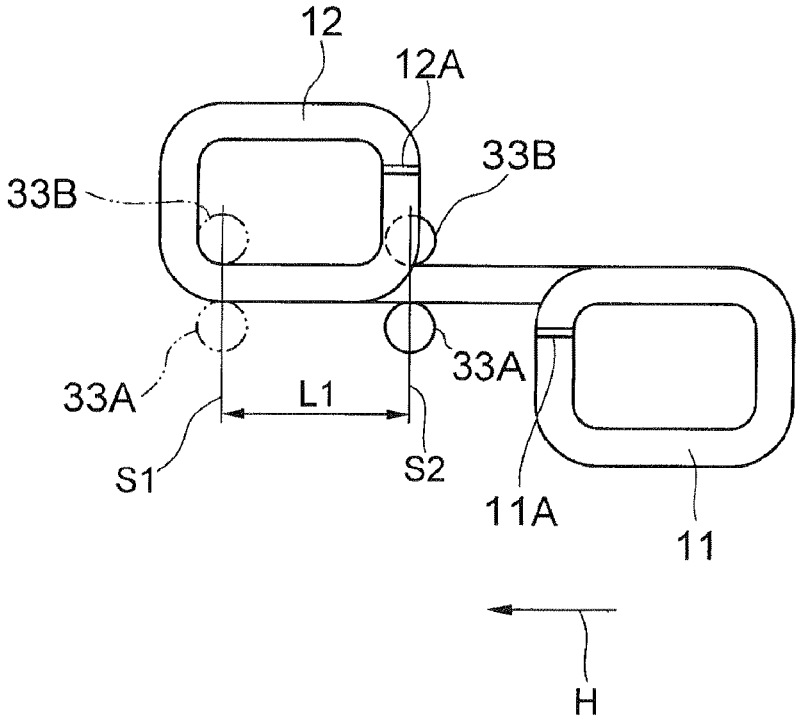
FIG. 28A is an operational view of a state in which winding is short of two turns.
Figure 28B:
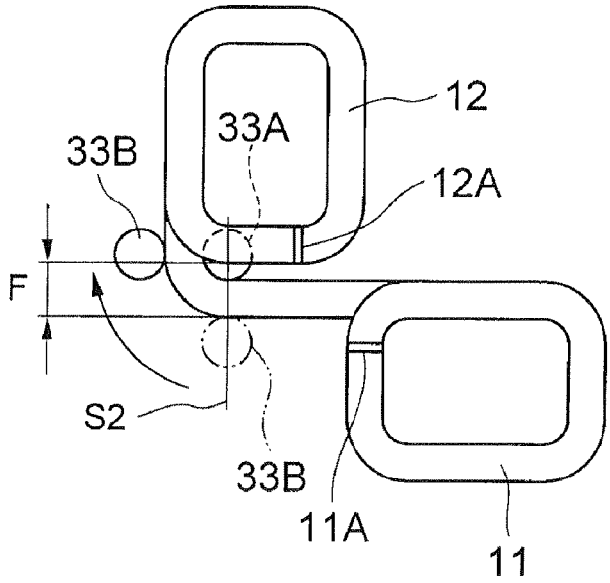
FIG. 28B is an operational view of a state in which turning is performed by an angle of 90 degrees from the state of FIG. 29A.
Figure 29A:
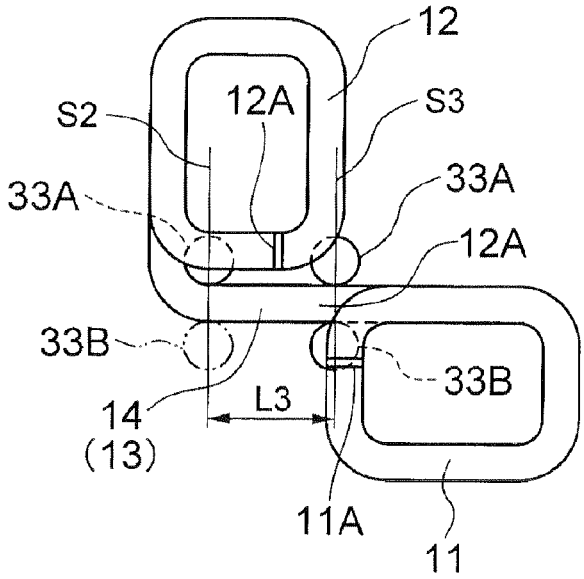
FIG. 29A is an operational view of a state in which a turned position is identical to of FIG. 28B.
Figure 29B:
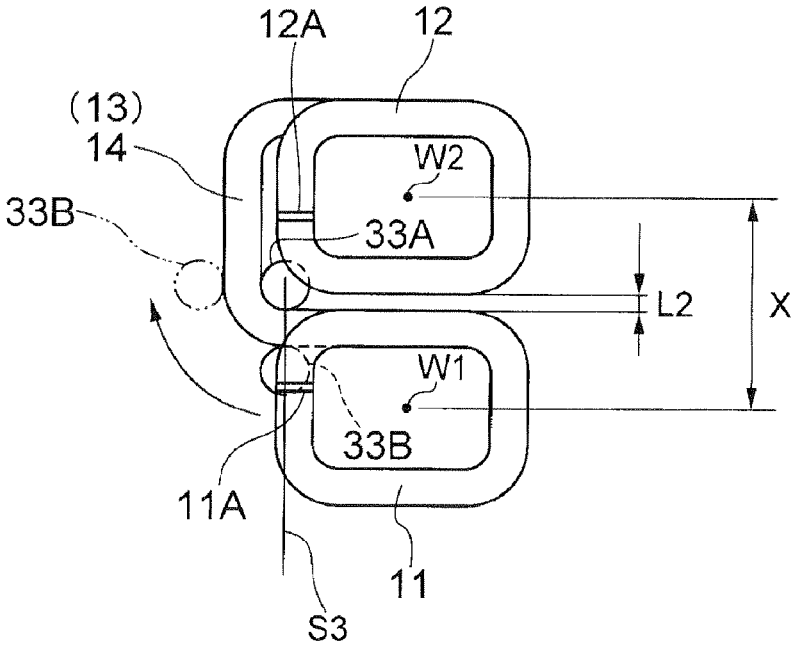
FIG. 29B is an operational view showing a state in which turning is done at an angle of 90 degrees.
Figure 30:
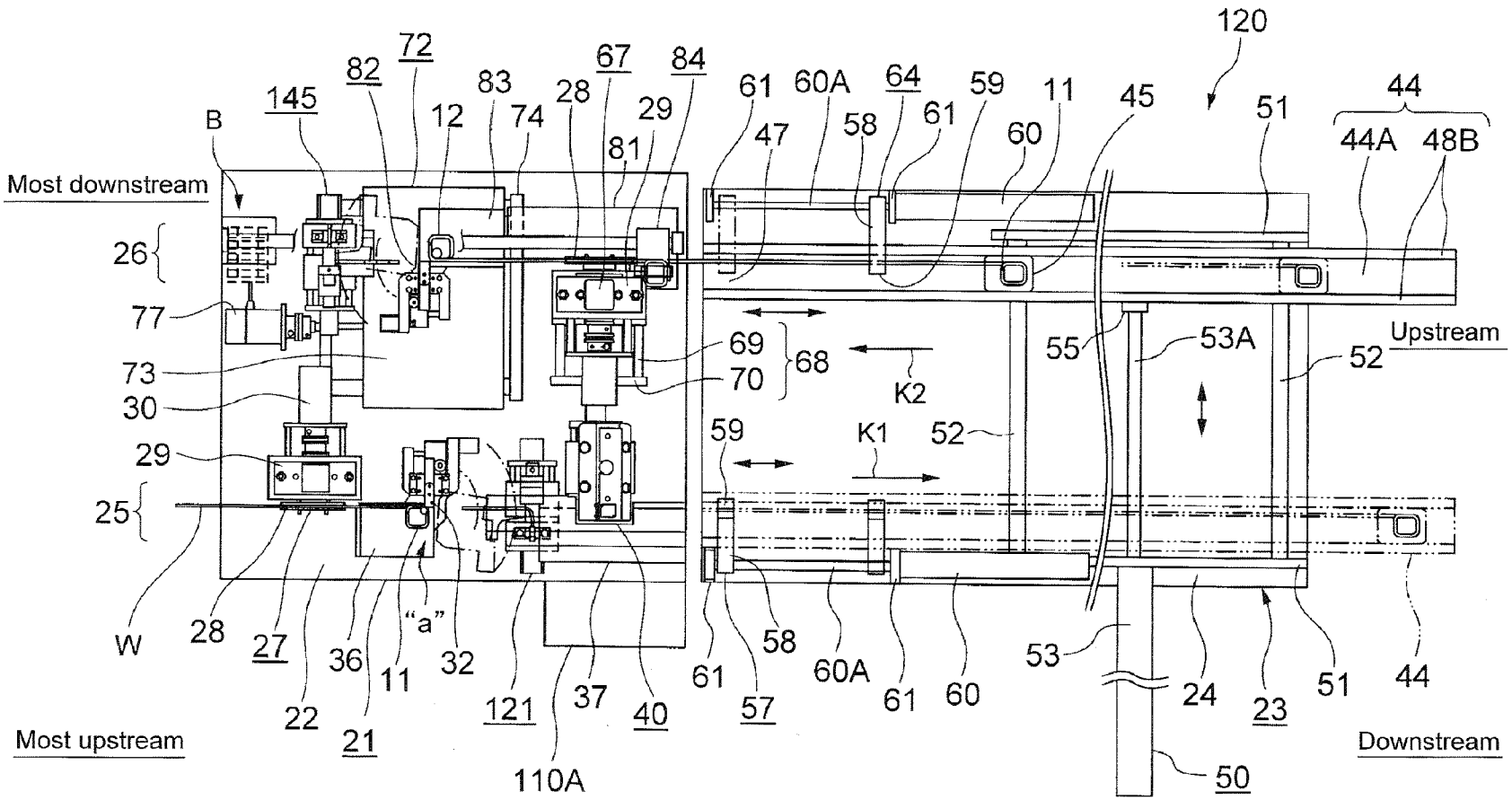
FIG. 30 It is an entire plan view showing a second embodiment of the linked coil formation device according to the present invention.
Figure 31:
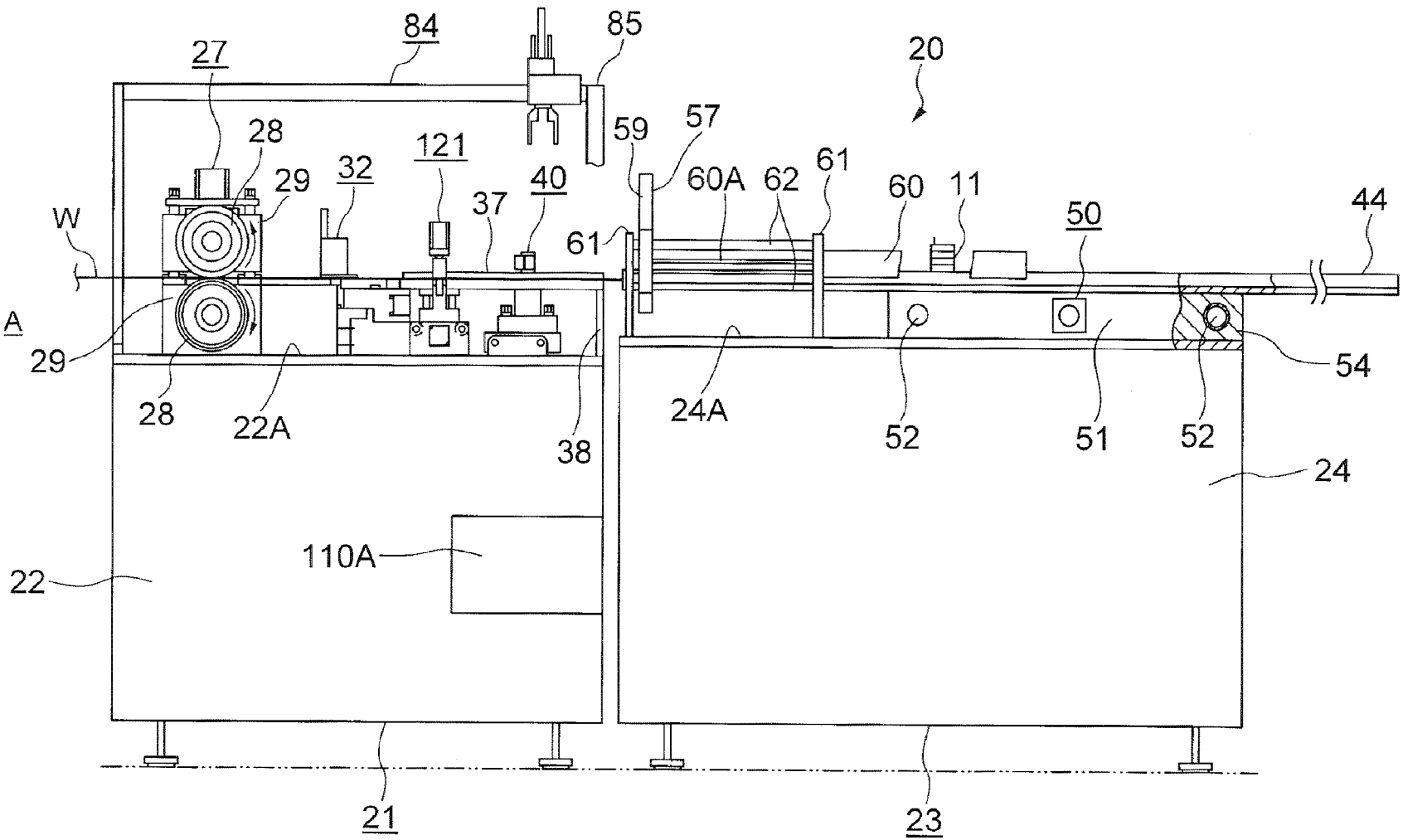
FIG. 31 It is an entire side view showing the linked coil formation device of the second embodiment.
Figure 32:
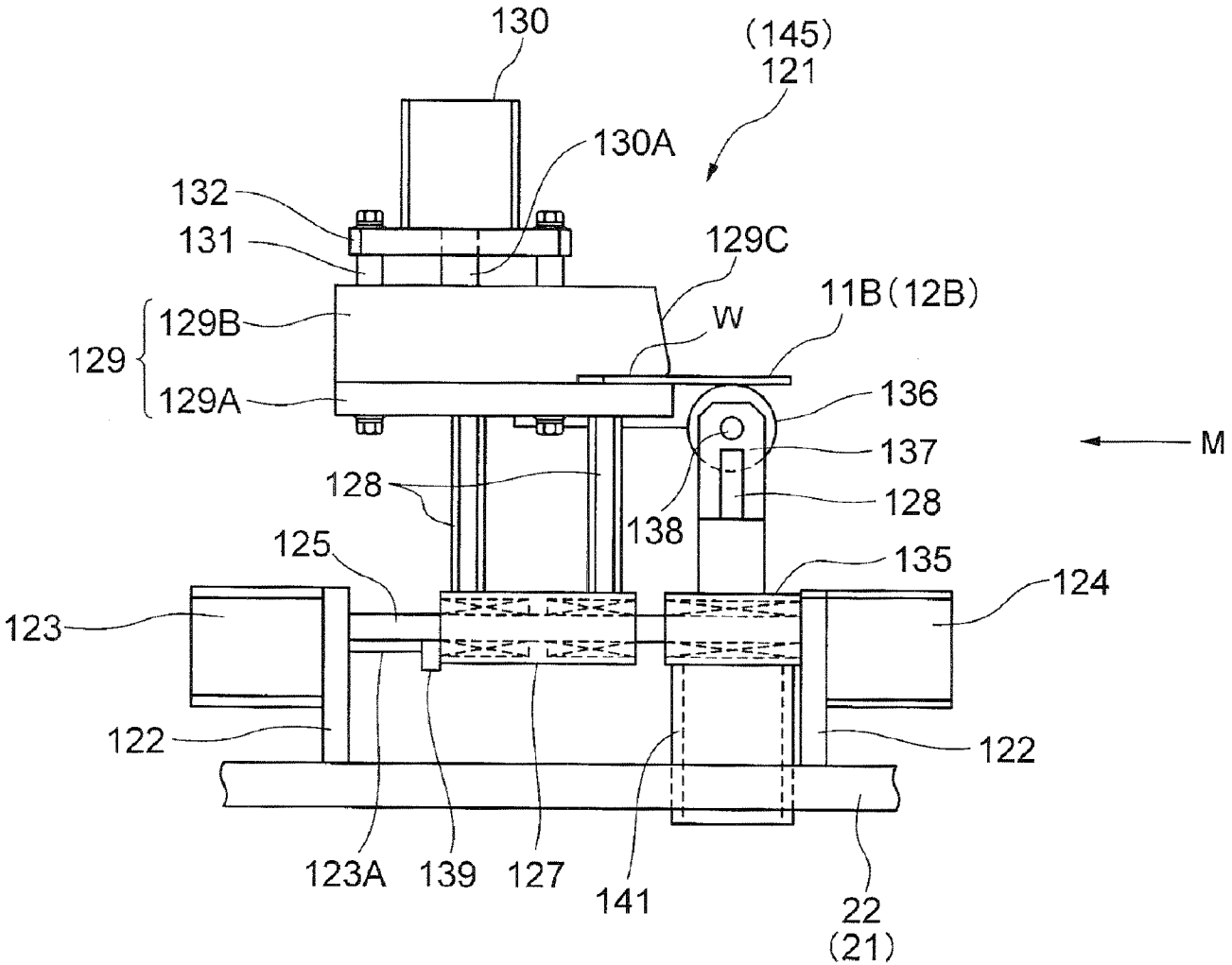
FIG. 32 It is an entire side view showing a forming unit of the second embodiment.
Figure 33:
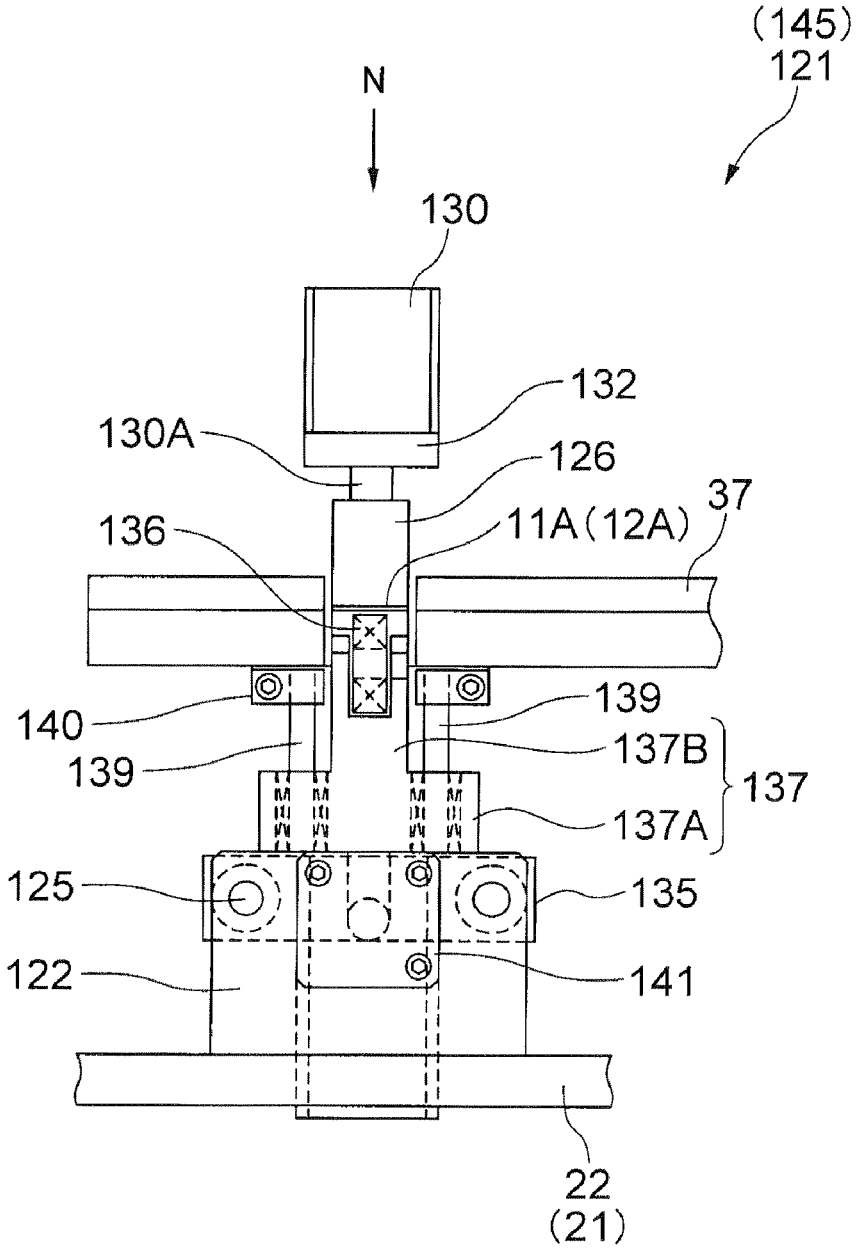
FIG. 33 It is an entire front view of the forming unit in a view indicated by the arrow M of FIG. 32.
Figure 34:
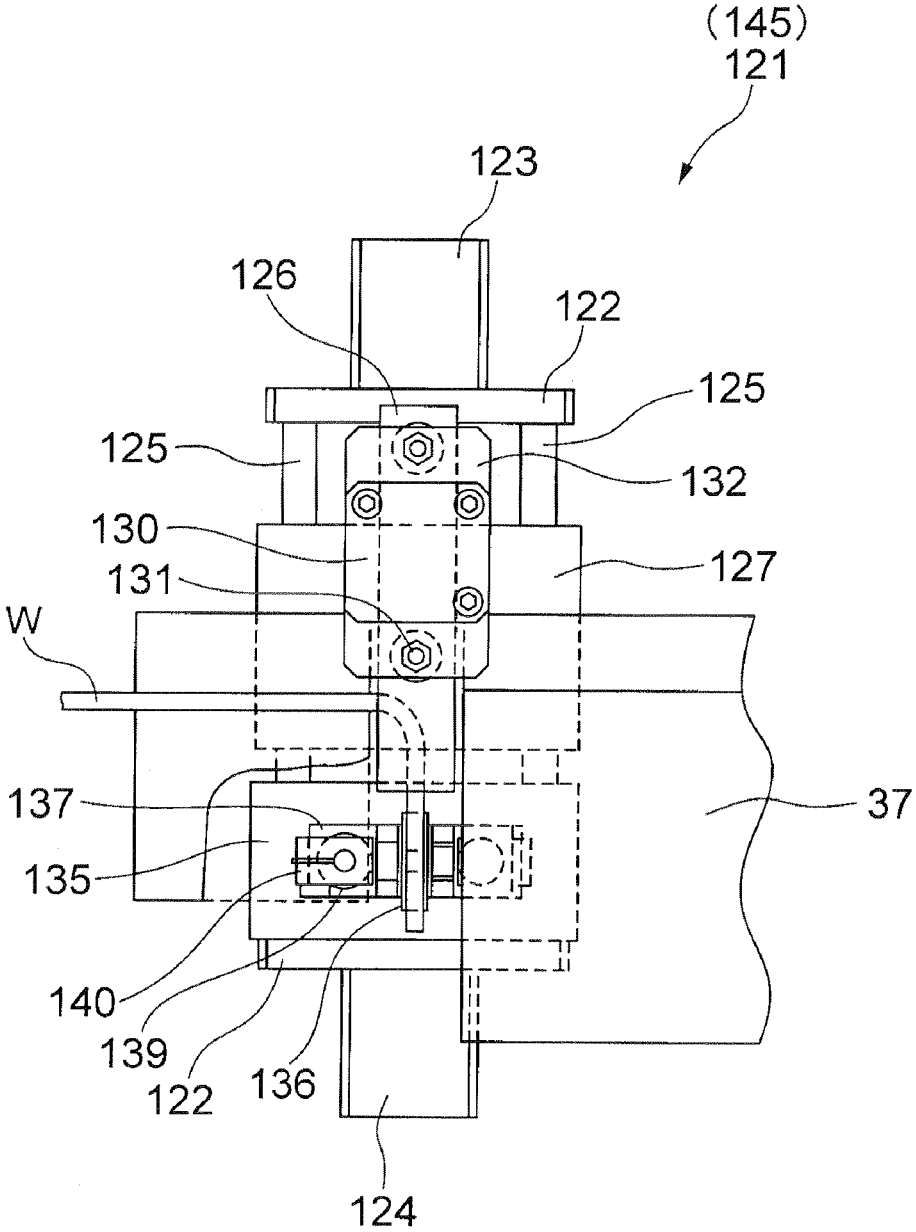
FIG. 34 It is an entire plan view of the forming unit in a view indicated by the arrow N of FIG. 33.
Figure 35A:
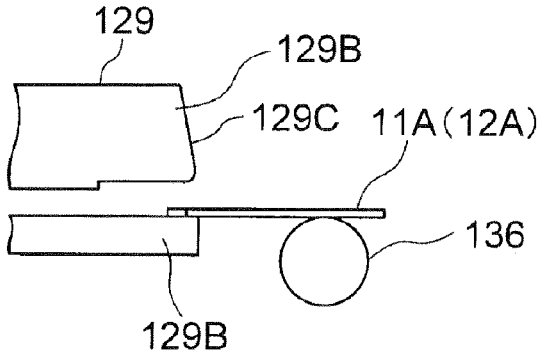
FIG. 35 It is a view showing a procedure for bending a lead part by means of the forming unit of the second embodiment.
Figure 35B:
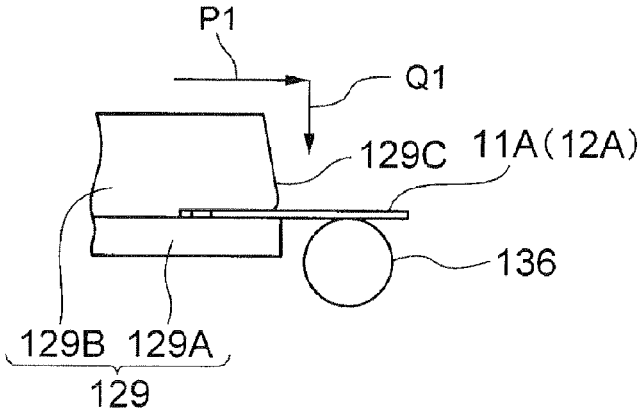
Figure 35C:
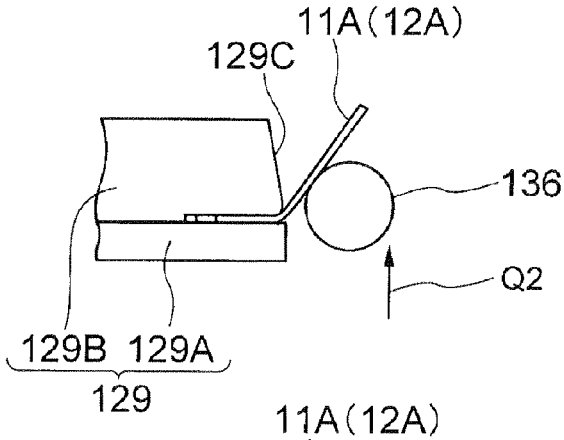
Figure 35D:
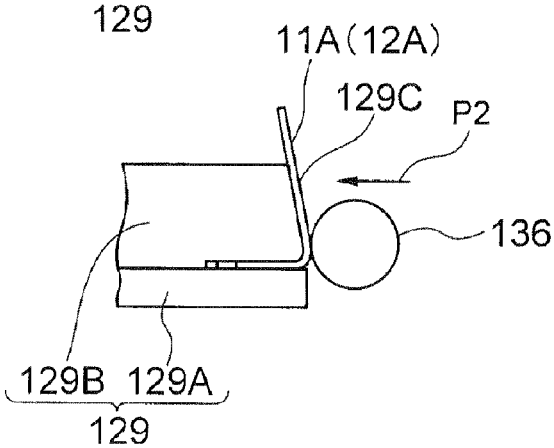
Figure 36A:
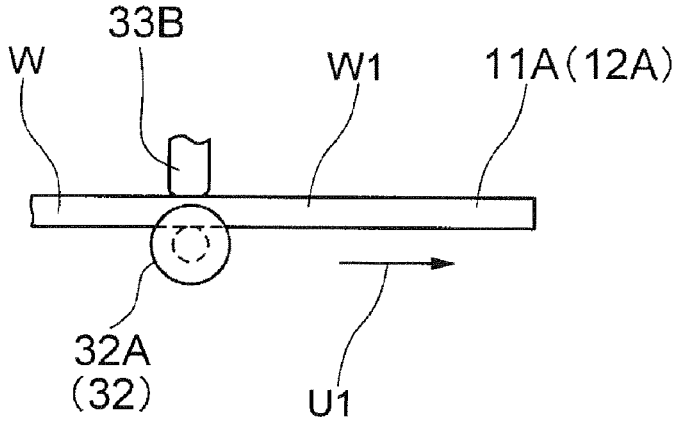
FIG. 36 It is a view showing a relationship between bending the lead part and winding processing by means of the forming unit of the second embodiment.
Figure 36B:
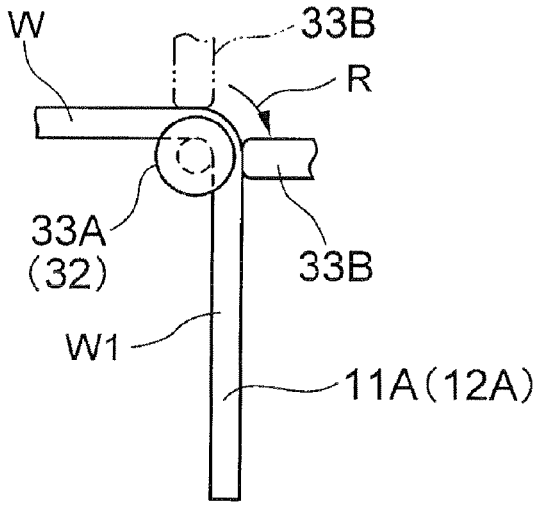
Figure 36C:
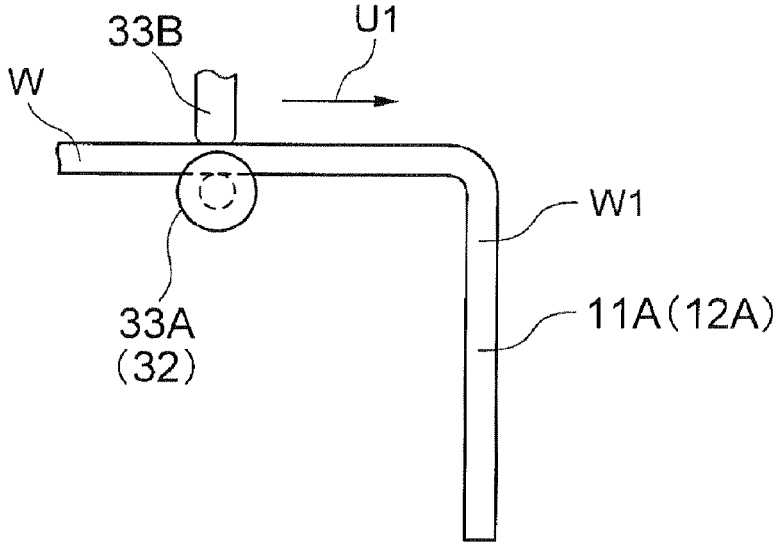
Figure 37D:
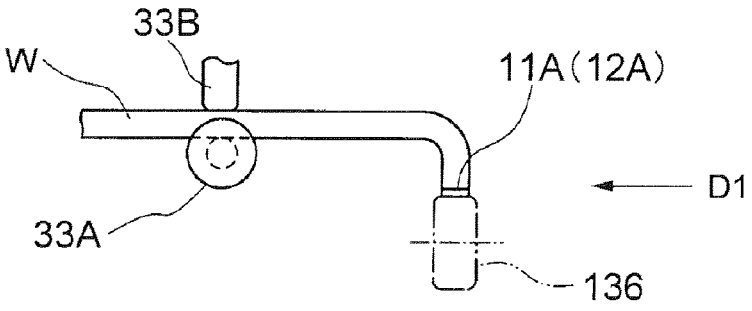
FIG. 37 It is a view representing a relationship between bending the lead part and winding processing by means of the forming unit of the second embodiment, the view showing the subsequent steps to those of FIG. 36.
Figure 37D:
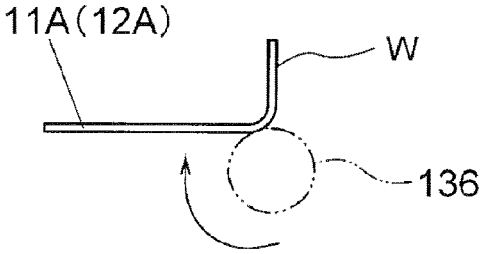
Figure 37E:
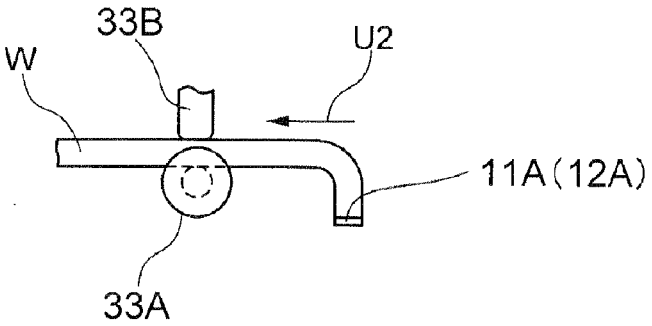
Figure 37F:
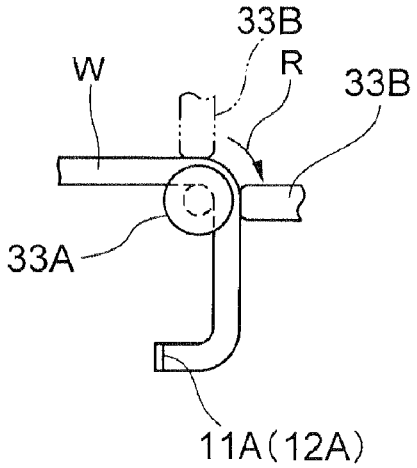

1 Reactor
10 Linked coil
11 First coil part
12 Second coil part
13 Linking part
14 Offset portion
20 Linked coil formation device
21 Winder unit
23 Coil placement unit which is material transfer unit
25 First coil winding processing line

26 Second coil winding processing line
27 First wire feeder
32 First winding head
33 Winding part
33A Fixing jig
33B Winding jig
37 Coil feed guide
40 Cutter unit
44 Coil introduction guide
45 Coil conveyance tray
50 Flat wire movement unit
57 Lead wire introduction mechanism which is first conveyance device
60 Movement cylinder
64 Lead wire feed mechanism which is second conveyance device
67 Second wire feeder
72 Head feed unit
82 Second winding head
84 Coil take-out unit
88 Chuck unit
91 Chuck mechanism
92 Chuck part
94 Vertical movement cylinder
98 Movement stopper mechanism
101 Coil position measurement sensor
102 Sensor dog
110 Arithmetic and control part as main control part
111 Input part
112 Memory
113 Length measurement means
120 Linked coil formation device of the second embodiment
121 First forming unit
126 Lead wire clamper mechanism
127 First slide member
129 Clamper
129A Upper clamper
129B Lower clamper
135 Second slide member
136 Forming jig
145 Second forming unit
A Flat wire feed part which is material feed area
B Take-out position
W Flat wire which is coil material
K1 Feed direction of flat wire in first coil winding processing line
K2 Feed direction of flat wire in second coil winding processing line

The invention claimed is:

1. A linked coil formation device, comprising:

a first coil winding processing line having a first winding head employing a flat wire introduced from a material feed area, as a coil material, and sequentially winding one end part thereof in a rectangular shape, to form a first coil part in a shape of a rectangular cylinder;

a second coil winding processing line having a second winding head which is disposed in parallel to the first coil winding processing line at predetermined intervals to form a second coil part in the shape of the rectangular cylinder at the other end part of the coil material and to arrange the second coil part to be adjacent to the first coil part on an identical face; and a material transfer unit for conveying the coil material having the first coil part formed in the first coil winding processing line into the second coil winding processing line on an extension of each of the first and second coil winding processing lines at an opposite side of the material feed area.

2. The linked coil formation device set forth in claim 1, wherein the first coil winding processing line comprises:

a first wire feeder for linearly disposing the coil material introduced from the material feed area and support the disposed coil material, followed by feeding out the supported coil material in a direction of the material transfer unit;

the first winding head for forming the first coil part by winding and processing the coil material fed out from the first wire feeder; and a cutter unit for cutting a continuum of the coil material fed out to the material transfer unit at a length required to form the second coil part.

3. The linked coil formation device set forth in claim 1 or claim 2, wherein the second coil winding processing line comprises:

a second wire feeder for acquiring the coil material fed via the material transfer unit from the other end thereof and allowing passing of the first coil part formed at one end part of the coil material;

the second winding head for winding and processing the second coil part at the other end part of the coil material fed from the second wire feeder; and a head feed unit reciprocally moving along a movement direction of the coil material with the head feed unit being equipped with the second winding head, and assisting in execution of winding processing by means of the second winding head.

4. The linked coil formation device set forth in claim 1, wherein the first coil winding processing line comprises:

a first wire feeder for linearly disposing the coil material introduced from the material feed area and support the disposed coil material, followed by feeding out the supported coil material in a direction of the material transfer unit;

the first winding head for forming the first coil part by winding and processing the coil material fed out from the first wire feeder;

a cutter unit for cutting a continuum of the coil material fed to the material transfer unit at a length required to form the second coil part; and a first forming unit which is disposed between the first winding head and the cutter unit, for bending one end part of the coil material as a lead part for terminal mounting from a surface of the coil material in a direction orthogonal to the surface, prior to forming the first coil part by means of the first winding head.

5. The linked coil formation device set forth in claim 1 or claim 4, wherein the second coil winding processing line comprises:

a second wire feeder for acquiring the coil material fed via the material transfer unit from the other end part thereof and allowing passing of the first coil part formed at one end part of the coil material;

the second winding head for winding and processing the second coil part at the other end part of the coil material fed out from the second wire feeder;

a head feed unit reciprocally moving along a movement direction of the coil material with the head feed unit being equipped with the second winding head, and assisting in execution of winding processing by means of the second winding head; and a second forming unit which is disposed on a tip side in a feed direction of the coil material of the head feed unit, for bending the other end part of the coil material as a lead part for terminal mounting from a surface of the coil material in a direction orthogonal to the surface, prior to forming the second coil part by means of the second winding head.

6. The linked coil formation device set forth in any one of claim 1, 2 or 4 wherein a coil take-out unit is provided on a side of the material transfer unit on the second coil winding processing line, for gripping the first coil part formed at said one end part of the coil material fed from the coil material transfer unit and moving on the second coil winding processing line, subsequent to a winding processing operation of the second coil part by means of said second winding head.

7. The linked coil formation device set forth in any one of claim 1, 2 or 4 wherein a coil feed guide for guiding a coil material with the first coil part, fed out from the first winding head, to the material transfer unit, is arranged on a side of the material transfer unit of the first coil winding processing line.

8. The linked coil formation device set forth in claim 3, wherein the first wire feeder, the first winding head, the cutter unit, and the first forming unit on the first coil winding processing line; and the second wire feeder, the second winding head, the head feed unit, and the second forming unit on the second coil winding processing line are arranged on a winder base.

9. The linked coil formation device set forth in claim 1, having an arithmetic and control part for correcting a coil displacement at an end of winding by varying an offset length in accordance with whether an inter-coil length is long or short in relative position between the first coil part and the second coil part of the linked coil.

10. A method of forming linked coils of which a first coil part and a second coil part are linked with each other on an identical face via a linking part and are disposed in parallel to each other, said method comprising:

providing a first coil winding processing line, a second coil winding processing line disposed in parallel to the first coil winding processing line at predetermined intervals and a material transfer unit disposed on an extension of each of the first and second coil winding processing lines at an opposite side of a material feed area, introducing a coil material such as a flat wire from the material feed area into the first coil winding processing line, and sequentially winding one end part thereof in a rectangular shape on the first coil winding processing line to form the first coil part in the shape of a rectangular cylinder;

feeding a side of the first coil part of the coil material having the first coil part formed in the first step at one end part thereof to the material transfer unit and cutting a length of the coil material at a length required for the second coil part to be formed at the other end part thereof;

transferring the coil material for which the other end part is specified as a site for forming the second coil onto the second coil winding processing line by actuating the material transfer unit; and conveying the coil material transferred via the material transfer unit from the other end part thereof into the second coil winding processing line, forming the second coil part in a shape of a rectangular cylinder at the other end part of the coil material, and arranging the second coil part to be adjacent to the first coil part on an identical face.

11. The method of forming linked coils, set forth in claim 10, comprising, in the first step, prior to forming the first coil part, a bending processing step of bending and processing at an angle of 90 degrees a tip end part including a lead part for mounting one end side and a terminal, of the coil material, and one edge of the first coil part;

a first forming step of bending the lead part bent and processed out of the tip end part from a surface of the coil material in a direction which is substantially orthogonal to the surface; and a positioning step of positioning the coil material that follows the tip end part having the bent lead part in a location corresponding to one edge of the first coil; and in the conveying step, prior to forming the second coil part, a bending processing step of bending and processing at an angle of 90 degrees a tip end part including a lead part for mounting the other end and a terminal, of the coil material, and one edge of the second coil part;

a second forming step of bending the lead part bent and processed out of the tip end part from a surface of the coil material in a direction which is substantially orthogonal to the surface; and a positioning step of positioning the coil material following the tip end part having the bent lead part in a location corresponding to one edge of the second coil part.

12. The method of forming linked coils, set forth in claim 10, wherein a coil displacement at an end of winding is corrected by varying an offset length in according to whether an inter-coil length is long or short in relative position between the first coil part and the second coil part of the linked coil.

* * * * *